US007814975B2

(12) United States Patent
Hagen et al.

(10) Patent No.: US 7,814,975 B2
(45) Date of Patent: Oct. 19, 2010

(54) HEAVY OIL RECOVERY WITH FLUID WATER AND CARBON DIOXIDE

(75) Inventors: David L. Hagen, Goshen, IN (US); Ian Wylie, Naperville, IL (US); L. Allan McGuire, Elkhart, IN (US); Gary Ginter, Chicago, IL (US)

(73) Assignee: Vast Power Portfolio, LLC, Elkhart, IN (US)

( * ) Notice: Subject to any disclaimer, the term of this patent is extended or adjusted under 35 U.S.C. 154(b) by 0 days.

(21) Appl. No.: 12/233,503

(22) Filed: Sep. 18, 2008

(65) Prior Publication Data

US 2009/0071648 A1 Mar. 19, 2009

Related U.S. Application Data

(60) Provisional application No. 60/994,196, filed on Sep. 18, 2007, provisional application No. 60/994,361, filed on Sep. 19, 2007.

(51) Int. Cl.
*E21B 43/243* (2006.01)

(52) U.S. Cl. ..... 166/257; 166/260; 166/261; 166/266; 166/272.1

(58) Field of Classification Search ..... None
See application file for complete search history.

(56) References Cited

U.S. PATENT DOCUMENTS 3,651,461 A 3/1972 Holt
4,217,956 A 8/1980 Goss et al.
4,344,485 A 8/1982 Butler
4,388,288 A 6/1983 Dupin et al.
4,565,249 A 1/1986 Pebdani et al.
5,056,596 A 10/1991 McKay et al.
5,109,927 A 5/1992 Supernaw et al.

(Continued)

OTHER PUBLICATIONS

Deo et al., "Solubility of Carbon Dioxide in Tar Sand Bitumen: Experimental Determination and Modeling", Ind. Eng. Chem. Res. 1991, vol. 30, pp. 532-536.

(Continued)

*Primary Examiner*—Zakiya W. Bates
(74) *Attorney, Agent, or Firm*—Ostrolenk Faber LLP

(57) ABSTRACT

Diluted wet combustion forms a hot process fluid or VASTgas including carbon dioxide ($CO_2$) and fluid water which is delivered to geologic formations and/or to surface mined materials to reduce the viscosity and/or increase hydrocarbon extraction. High water and/or $CO_2$ content is achieved by reducing non-aqueous diluent and/or adding or recycling $CO_2$. Power recovered from expanding the VASTgas may be used to pressurize the VASTgas for delivery by partial expansion through a Direct VAST cycle, and/or by diverting compressed oxidant through a parallel thermogenerator in a Diverted VAST cycle. Pressurized VASTgas may be injected into a well within the hydrocarbon formation or with mined material into a heavy hydrocarbon separator vessel to heat, mobilize, solubilize and/or extract heavy hydrocarbons. Light hydrocarbons may be mixed in with the hot process fluid to enhance hydrocarbon mobilization and recovery. Microwaves may further heat the VASTgas and/or hydrocarbon. Sulfur oxidation, calcining limestone and/or recycling may increase $CO_2$. Oxygen enrichment may increase the specific power. VASTgas may be delivered through and back injection wells and/or production wells, and/or between sequential injection wells in alternating and/or paired zigzag formations with multiple wells per VAST combined heat and power recovery system.

46 Claims, 18 Drawing Sheets

U.S. PATENT DOCUMENTS

| | | | | |
|---|---|---|---|---|
| 5,233,016 | A | 8/1993 | Kanaka et al. | |
| 5,407,009 | A | 4/1995 | Butler et al. | |
| 5,607,016 | A | 3/1997 | Butler | |
| 5,617,719 | A | 4/1997 | Ginter | |
| 5,743,080 | A | 4/1998 | Ginter | |
| 5,925,291 | A | 7/1999 | Bharathan et al. | |
| 6,230,814 | B1 | 5/2001 | Nasr et al. | |
| 6,289,666 | B1 | 9/2001 | Ginter | |
| 6,318,468 | B1 * | 11/2001 | Zakiewicz | 166/305.1 |
| 7,021,063 | B2 | 4/2006 | Viteri | |
| 7,115,847 | B2 | 10/2006 | Kinzer | |
| 7,416,137 | B2 | 8/2008 | Hagen et al. | |
| 2004/0219079 | A1 | 11/2004 | Hagen et al. | |

OTHER PUBLICATIONS

Jiang et al., "Development of the Steam and Gas Push (SAGP) Process", GravDrain, Paper No. 59, pp. 1-18, 1998.

* cited by examiner

HEAVY OIL RECOVERY WITH FLUID WATER AND CARBON DIOXIDE

CROSS-REFERENCE TO RELATED APPLICATIONS

This application claims priority under 35 U.S.C. §119(e) of U.S. Provisional Patent Application No. 60/994,196, filed 18 Sep. 2007, entitled HOT FLUID RECOVERY OF HEAVY OIL WITH ENHANCED WATER AND CARBON DIOXIDE and also of U.S. Provisional Patent Application No. 60/994,361, filed 19 Sep. 2007, entitled STEAM, CARBON DIOXIDE AND VAPOR EXTRACTION PROCESS, the complete disclosures of which are hereby incorporated by reference for all purposes. This application also incorporates by reference for all purposes the entire disclosure of International Patent Application No. PCT/US2008/001896, filed 11 Feb. 2008, entitled HOT FLUID RECOVERY OF HEAVY OIL WITH STEAM AND CARBON DIOXIDE, which in turn incorporates and claims priority of U.S. Provisional Patent Application Ser. No. 60/900,587, filed 10 Feb. 2007 entitled HEAVY OIL EXTRACTION USING COMBUATION GASSES WITH HIGH WATER AND CARBON DIOXIDE CONCENTRATIONS, and also of U.S. Provisional Patent Application Ser. No. 60/925,971, filed 24 Apr. 2007 entitled HOT FLUID RECOVERY OF HEAVY OIL WITH ENHANCED WATER AND CARBON DIOXIDE.

BACKGROUND OF THE INVENTION

1. Field of the Invention

This invention relates to using multiple fluids and energy to enhance recovery of viscous carbonaceous materials from geological resources.

2. Description of Related Art

Global demand for petroleum products continues to increase led by strong growth in China, India and the USA. However, discovery of conventional oil reserves has been declining since the mid 1960s. This is causing a strong growing demand for the recovery and conversion of heavy oil, bitumen from oil sands, kerogen from oil shale, and residual higher viscosity oil contained within conventional reservoirs, etc., (herein collectively termed, "heavy hydrocarbons"). Such alternative hydrocarbon resources have been more difficult, complex and expensive to recover and process than conventional petroleum resources.

Large deposits of oil sands are found in the Canadian province of Alberta and in the Orinoco region of Venezuela. Each reports total reserves in excess of one trillion barrels of oil equivalent (TBOE). Shallow minable, bitumen deposits are under heavy development, especially in Alberta. However, most bitumen in place is not economically recoverable using conventional surface extraction techniques.

The "energy returned on energy invested" (EROEI) strongly influences profitability and has been higher then 30:1 for conventional petroleum. However, the energy used to extract heavy hydrocarbons (especially oil shale) using conventional techniques may exceed the energy recovered (i.e. EROEI <1.0). Increasing rates of depletion and the maturity of conventional oil fields is generating strong demand to improve the EROEI for heavy hydrocarbons. This has led to several technological solutions to improve extraction efficiency and EROEI for these heavy hydrocarbon reserves.

For example, the Steam Assisted Gravity Drainage process (hereinafter SAGD) to extract bitumen from subsurface oil sands, was taught by Butler in U.S. Pat. No. 4,344,485, and by Nasr et al. in U.S. Pat. No. 6,230,814. Similarly, the Steam Assisted Gas Push (hereinafter SAGP) technique described in U.S. Pat. No. 5,407,009, and U.S. Pat. No. 5,607,016, both to Butler, et al., is a related technique. These have been described as recovering 40% to 50% of the bitumen in place.

The SAGD process injects steam into underground bitumen formations through horizontally drilled wells. The high enthalpy steam heats the bitumen, reducing its viscosity sufficiently to pump a portion of it out of geological formations using relevant art pump technologies, e.g., through a second parallel extraction or production well typically drilled about 5 m (17 ft) below the first injection well.

Carbon dioxide ($CO_2$) has been used to increase the extraction rate of bitumen and other heavy hydrocarbons as well as other carbonaceous materials such as carbon tetrachloride. The extraction rate is defined as the rate at which the target material is being removed or delivered in either volume or mass terms. Deo, et al., Industrial Eng. Chem. Res., Vol. 30, No. 3, 1991, detailed the specific solubility of $CO_2$ in various bitumens versus temperature and pressure. They reported decreases in viscosity with increasing solvation by $CO_2$, e.g., in Athabasca (Alberta) & Tar Sand Triangle (Utah) bitumens and other similar heavy hydrocarbons.

Other patents, e.g., U.S. Pat. No. 4,217,956 to Goss, et al., and U.S. Pat. No. 4,565,249 to Pebdani, et al., detail other variations of the increase in bitumen or other heavy hydrocarbon extraction using $CO_2$. In U.S. Pat. No. 4,565,249, the increase in bitumen or heavy oil extraction rate from oil sands increased by 36% by addition of 200 standard cubic feet (SCF) of $CO_2$ per barrel of steam (1.6 vol % of $CO_2$ in $H_2O$) as compared to the case of pure steam extraction. The increase in extraction rate reaches a "plateau" with increasing $CO_2$. In U.S. Pat. No. 4,217,956, bitumen recovery rates are at least doubled by the injection of $CO_2$. The $CO_2$ concentration used for those results was 750 SCF per barrel of steam (~6.0 vol % of $CO_2$ in $H_2O$) at an ambient pressure of 300 pounds per square inch (psi) or 20.4 atmospheres (atm).

In U.S. Pat. No. 5,056,596 to McKay, et al., $CO_2$ was dissolved in water at an alkaline pH (e.g., above 10.5) to enhance bitumen recovery rates. The $CO_2$ is more soluble in alkaline solutions. However $CO_2$ is often difficult to obtain near heavy hydrocarbon resources. Long expensive pipelines are typically used to deliver $CO_2$.

The significant decrease in the viscosity of bitumen both with increasing solvation by $CO_2$ and at increasing temperatures are important factors that underly the improvement in heavy hydrocarbon extraction efficiency with $CO_2$. One objective of this invention is efficiently generate $CO_2$ and enhance the extraction rate of heavy hydrocarbons.

Natural gas is a commonly used to heat heavy hydrocarbons and for power requirements in Western Canada's oil fields and oil sand processing plants because it is currently in relatively abundant supply in those locations. However, natural gas would be much better spent for premium applications requiring very low emissions. A catalytic desulfurization process or "Claus Process", e.g. as described in U.S. Pat. No. 4,388,288 to Dupin, is currently used to remove the sulfur (usually found there in the form of hydrogen sulfide, $H_2S$) from natural gas.

Heavy hydrocarbons including bitumen are similarly desulfurized during refining to synthetic crude oil. The market for elemental sulfur is currently saturated. Millions of tons of sulfur are currently stockpiled in the open air in Western Canada. A process to utilize some of this sulfur and other local raw materials for increasing the efficiency of heavy hydrocarbon extraction is therefore desired.

Other techniques have been utilized to add energy to the fluids used in the recovery of hydrocarbons from buried formations. For example, radio-frequency, (hereinafter, "RF", including microwave) heating of the hydrocarbons in place are taught by Supernaw, et al. in U.S. Pat. No. 5,109,927, and by Kinzer in U.S. Pat. No. 7,115,847.

Other objectives are to increase the amount of bitumen recoverable, and to access deeper formations in an energy efficient manner. In addition, the energy costs of hydrocarbon extraction processes are a key area for potential improvement.

With respect to improving efficiency of energy production and costs, water has been used to control the combustion temperature and pollutant emissions in gas turbines for power production and other purposes (e.g., clean water production) as described in VAST (Valued Added Steam Technology) U.S. Pat. No. 3,651,461 to Ginter, U.S. Pat. No. 5,743,080 to Ginter, U.S. Pat. No. 5,617,719 to Ginter, U.S. Pat. No. 6,289,666 to Ginter, pending U.S. patent application Ser. No. 10/763,047 by Hagen, et al., and U.S. patent application Ser. No. 10/763,057 by Hagen, et al., herein incorporated by reference. Other references have proposed adding liquid water into the combustor to reduce nitrogen oxide (NOx) emissions but with corresponding increases in carbon monoxide (hereinafter, CO) emissions.

More careful control of adding liquid water (and/or steam) may simultaneously reduce both the CO and NOx emissions as described in the above-mentioned VAST cycle references. NOx is formed at high temperatures and CO is often formed when there is insufficient time for equilibration of the reaction products of a combustion reaction or when burning a fuel rich mixture. Conventional turbines using the "Simple cycle" or "Brayton Cycle" typically produces high lateral and axial temperature differentials which may lead to NOx formation at peak and high temperature locations regions in the combustor. Lateral temperature differentials (e.g., centerline to wall of outlet) as high as 500° C. are not uncommon at the outlet of such combustors.

VAST combustors may reduce these differentials to less than 100° C. This reduces peak temperatures with major reductions in NOx and CO formation, with more efficient operation. Well head crude combustion has been demonstrated in a VAST thermogenerator. VAST wet cycles recover exhaust heat to steam and hot water, resulting in large improvements in thermal efficiency and power density of gas turbines.

Consequently, an objective of the present invention is the use of VAST wet cycle combustion to produce combustion gases and heat for the efficient extraction or production of heavy hydrocarbons, and more particularly the use of alternative fuels, and improvements in hydrocarbon extraction efficiency by altering the fuel mix and combustion by-product composition.

Steam raised in boilers has been used or proposed to heat and recovery bitumen, kerogen, heavy oil, shale oil, residual oil, and other hydrocarbons from geological resources, alternately termed heavy hydrocarbons, HeavyHCs or HHCs. Carbon dioxide has been used for tertiary recovery of hydrocarbon resources. High levels of carbon recycle have been proposed to further recover such HeavyHCs. The cost of purchasing and delivering carbon dioxide, and the recycle costs are major costs for such $CO_2$ enhanced HHC recovery.

The products of combustion, comprising steam or water vapor, and carbon dioxide, are commonly exhausted to the atmosphere when raising steam, resulting in loss of latent heat of combustion and carbon dioxide. Similarly the products of combustion (herein POC) from combustion power systems are commonly lost in recycling carbon dioxide for HHC recovery.

Some models and experiments suggest that vapor recovery hydrocarbon recovery rates may be about half that of Steam Assisted Gravity Drainage (herein SAGD) hydrocarbon recovery rates. Combining vapor recovery with SAGD may further enhance early HHC recovery. It can further enhance heat recovery from previous steam delivery.

BRIEF DESCRIPTION OF THE DRAWINGS

These and other features and advantages of the present invention will become apparent from the following description of the invention which refers to the accompanying drawings, wherein like reference numerals refer to like structures across the several views, and wherein.

SUMMARY OF THE INVENTION

Figure 1:
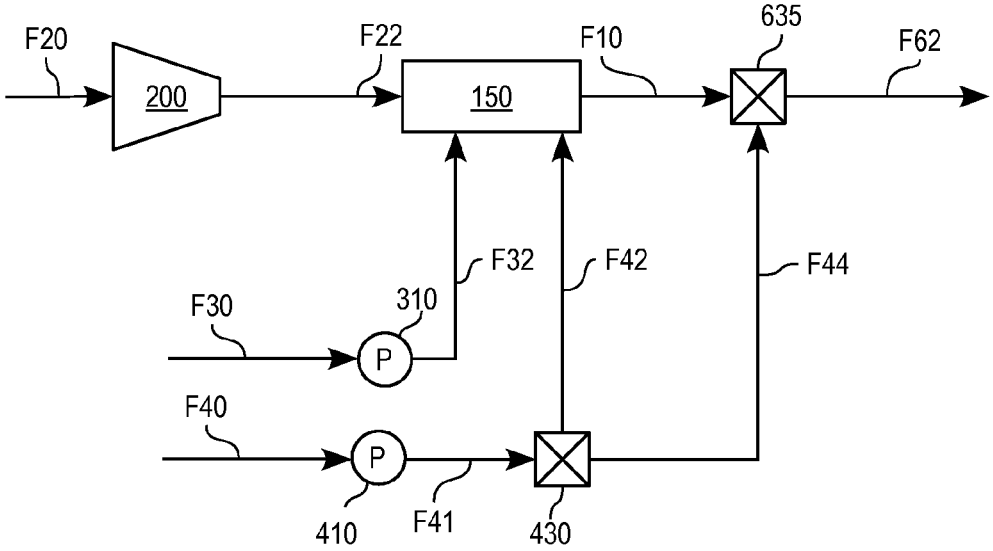
FIG. 1 schematically illustrates a water-cooled thermogenerator delivering pressurized VASTgas.

Thus, the present invention seeks to overcome or mitigate limitations of the above mentioned processes for extraction of heavy hydrocarbons, and provide improvements.

Aspects of the present invention provide for delivery of a hot process fluid comprising combustion gases from wet cycle combustion, e.g., wet combustion VAST gases, for extraction of heavy, viscous or difficult to extract hydrocarbons from geologic formations or mined materials containing them. The heavy hydrocarbon bearing material may e.g. comprise one of petroleum, shale, heavy oil, bitumen, and kerogen. In some embodiment, an energetic fluid comprising products of combustion, (e.g. steam and carbon dioxide) may be used to heat an HHC resource and enhance recovery by reducing the HHC viscosity. In some embodiment, for at least a portion of the extraction process, the energetic fluid may comprise hydrocarbon vapor to assist in HHC recovery (herein HC vapor). During the extraction process, one or more of HC vapor, carbon dioxide, and/or water may be separated from produced fluid and recycled back to the hydrocarbon resource to improve the extraction process.

At least a portion of one or more of recycled water, carbon dioxide ($CO_2$), and/or HC vapor may be used to control the outlet fluid temperature of a combustor. A further portion of water, carbon dioxide water and/or HC vapor may be mixed in with the combustor outlet fluid downstream of the combustor and/or downstream of an expander.

This energetic fluid comprising one or more of steam, carbon dioxide and hydrocarbon vapor is herein termed the SCOVAP fluid.

One aspect of the present invention provides a method for hot fluid recovery of heavy hydrocarbons from heavy hydrocarbon bearing material comprising:

introducing into a combustion system a combustion mixture of fuel, oxidant and water, wherein the water to fuel ratio is at least 1:1 by mass;

combusting the mixture to generate a hot process fluid comprising combustion gases, $CO_2$ and water;

delivering the hot process fluid to the heavy hydrocarbon bearing materials, for recovery of at least a portion of the heavy hydrocarbon, and.

recycling a portion of the carbon dioxide.

The use of such combustion gases has the potential to both improve the efficiency of heat transfer between the combustion system and the heavy hydrocarbons in question, and a reduction in the amount of heat required for a given amount of heavy hydrocarbon extraction, thereby improving the energy return on energy investment (EROEI).

Aspects of the invention provide for addition of water to the combustion mixture comprising water in one of a gaseous, liquid or vapor phase or a mixture thereof. The water to fuel ratio may be at least 4:1 by mass.

If required, additional water in gaseous, liquid or vapor phase, which may be pre-heated in an economizer, may be mixed with the combustion fluid after combustion and before delivering the hot process fluid to the heavy hydrocarbon bearing material.

Beneficially the process comprises delivering to the heavy hydrocarbon bearing material hot process fluid comprising at least 20 volume % of water. It is contemplated that this level of water composition will provide sufficient heat flow.

The method may generate hot process fluids with enhanced water and carbon dioxide, and greater flexibility in controlling composition of the hot process fluid, in particularly varying water, and carbon dioxide in response to changing extraction requirements over the duration of the extraction process, e.g. from an initial charging phase to a steady phase.

The fuel may comprise one or more of natural gas, coke, coal and diesel. The process is also tolerant of contaminants in fuels such as sour gas and bitumen. Water and $CO_2$ are produced from the fuel mixture in the combustion chamber, in quantities depending on the input fuel, and oxidant, water and combustion conditions (temperature and pressure). Additional water and $CO_2$ may be added to the hot process fluid after combustion, before delivery to the heavy hydrocarbon material.

Advantageously, the method comprises delivering to the heavy hydrocarbon bearing material hot process fluid comprising more than 1% $CO_2$ by volume. The method may comprise delivering to the heavy hydrocarbon bearing material hot process fluid comprising at least 3% $CO_2$ by volume. Enhancing $CO_2$ improves hydrocarbon extraction efficiency. Improvements in extraction efficiency are expected up to at least 6% by volume.

Generation of $CO_2$ may be controlled in part during combustion, for example the method may comprise a mixture of fuel, oxidant and water comprises a near stoichiometric ratio of oxidant to fuel. The oxidant may comprise air, or air with an enhanced $O_2$ concentration. Oxidant comprising air, or enhanced oxygen may be advantageous to increase $CO_2$ and reduce other unwanted combustion gases. The oxidant may comprise greater than 50% $O_2$ by volume. Where economical, hot fluid comprising 99% $O_2$, or comprising 85-95% $O_2$ (such as produced by pressure swing technology or membrane separation) are expected to be beneficial. Higher levels of $O_2$ tend to provide higher specific power levels and lower net capital costs per unit of heavy hydrocarbon extracted. Pressure swing oxygen separation is a relatively low cost method of oxygen purification.

Thus another advantage of high water to fuel ratios is that the air to fuel ratio may be close to stoichiometric. Wet combustion provides improved combustion temperature control over Brayton (dry) combustion cycles.

DETAILED DESCRIPTION OF THE PREFERRED EMBODIMENTS

This invention uses hydrocarbon vapor, fluid water and/or CO2 to enhance hydrocarbon recovery. It recycles CO2 and/or light hydrocarbons with related water vapor or steam to improve hydrocarbon recovery rate and extraction.

An advantage of producing hot process fluids by wet cycle combustion with high water to fuel ratios, wherein the water to fuel ratio is at least 1:1 by mass is effective heat transfer into the exhaust combustion gases which are delivered as hot process fluid to the heavy hydrocarbon.

Oxidant may be compressed for delivery to the combustion system and/or the method may comprise pressurizing the fuel mixture before combustion. Optionally the method comprises pressurizing the hot process fluid after combustion before delivery to the heavy hydrocarbon material. Additional $CO_2$ may also be added after combustion before delivering the hot process fluid to the heavy hydrocarbon bearing material.

For example, additional $CO_2$ may be generated by heating of limestone, or generated by reaction of carbonate containing material with acid. When the heavy hydrocarbon bearing material comprises carbonate, additional $CO_2$ may be generated by reaction of carbonate with acid constituents of the hot process fluid. For example, when the fuel mixture contains acid generating constituents, and additional $CO_2$ is generated by reaction of acid in the hot process fluid with carbonate materials associated with the heavy hydrocarbon bearing materials. When the fuel contains acid generating constituents, additional $CO_2$ is generated by reaction of acid in the hot process fluid with carbonate materials located near heavy hydrocarbon bearing materials in a well, The latter process may have the added benefit of generating additional heat and pressure to assist extraction ($CO_2$ assisted push) in a well.

When the fuel contains acid generating constituents, and one or both of water in the fuel mixture and water added to the process fluid after combustion contain carbonate, additional $CO_2$ is generated by reaction of acid in the hot process fluid with carbonate containing water.

Aspects of the invention thus beneficially provide for recycling of wastewater and gases, and the method is tolerant of contaminants. For example, in the combustion mixture of fuel, oxidant and water may comprise water containing a portion of hydrocarbon, such as that produced as effluent from the recovery and extraction process. Alternatively, the combustion mixture of fuel, oxidant and water may comprise water containing a contaminant, e.g. sulfur. When the hot process fluid comprises at least 1% sulfur by mass. Oxides of sulfur produced by combustion are acid producing constituents provide for generation of additional $CO_2$ by reaction with carbonates in the hot process fluid.

Additional $CO_2$ may also be recovered from another combustion process, or from effluent from heavy hydrocarbon material recovery, and may redirected into the hot process fluid, or sequestered for future use, for example by adding calcium chloride to precipitate carbonate.

The wet combustion system may comprise a gas turbine, or thermogenerator (combustor), and more particularly a VAST gas system using a direct or diverted flow system. The method may include delivering the hot process fluid from the combustion system directly to the hydrocarbon bearing material, mined material in a separator vessel or in a well. The hot process fluid may be pressurized for delivery directly to the heavy hydrocarbon bearing material. Delivery to a deep well formation may require significant pressurization.

In a diverted system, the method comprises diverting part of the hot process fluid before delivering hot process fluid to the hydrocarbon bearing material, for example diverting part of the hot process fluid to generate one of mechanical energy and electricity for pressurization. The method may also include diverting part of the hot process fluid to an economizer to heat water for injection into the hot process fluid before delivering hot process fluid to the heavy hydrocarbon materials.

Diversion of hot process fluid may be used also for generating power for compression or refrigeration, e.g. recovery of waste products may include generating power for refrigeration to condense $CO_2$ in waste products after recovery.

Systems may include a plurality of coupled turbines or thermogenerators, or may be used in cooperation conventional Brayton cycle (dry cycle) combustion systems, e.g. for steam generation.

Beneficially in addition to sulfur mentioned above, the fuel may comprise other acid-producing constituent, e.g. one or more of sulfur, phosphorus, chlorine, fluorine, or bromine and compounds thereof. Thus the process is tolerant of sour gas as a fuel and the may beneficially contains concentrations of greater than ten parts per million (ppm) of one or more of sulfur, phosphorus and nitrogen, particularly when the combustion mixture comprises water containing limestone or other carbonate reacts with acid to form additional $CO_2$ to benefit the process.

When hydrocarbon-bearing material is mined material in a separation vessel and hot process fluid is delivered to the extraction vessel, hot process fluid may be injected at bottom of the vessel to cause agitation, with delivery of hot process fluid sufficient causes local boiling in separation vessel. Exhaust gas and heat is recycled into an economizer for heating water. Agitation may be caused by local generation of $CO_2$ bubbles causing frothing, local boiling, and injection of hot process fluid may cause temperature inversion and convection.

Waste water from the process may be recycled and fed into the combustion chamber, or directed to another combustion chamber for treatment and generation of heat and/or electricity.

When the heavy hydrocarbon bearing material is located in a well, the process comprises delivering hot process fluid, typically at higher pressures, to heavy hydrocarbon bearing material located in geologic formations in a well.

In some cases local heating may be used in the combustion system, in a separation vessel or in a well formation. Local heating of the heavy hydrocarbon bearing material may comprise radio frequency heating or resistive heating.

Thus aspects of the invention provide methods and systems for hot fluid recovery of heavy hydrocarbons with enhanced water concentrations to deliver effective heat transfer. Appropriate combinations of fuel, oxidant and water ratios, temperature and pressure may be used to improve or optimize extraction and energy efficiency. Sequestering of $CO_2$ for reuse may assist in reducing unwanted emissions.

Moreover, in view of the relatively high efficiency and heat generation in wet cycle combustion, it is feasible to diver t some of the hot process fluid, for example, for generation of heat, electricity, or energy for compression, for pressurizing input gases, refrigeration for recovery of exhaust by products; driving an economizer for preheating water for injection into the combustion chamber or into the hot process fluid after combustion.

Wet Combustion VASTgas for Heavy Hydrocarbon Extraction

Example 1

100° C. Atmospheric VASTgas from Natural Gas Fuel (Water/Fuel=W/F=ω=10.6)

Referring to FIG. 1, in one embodiment, a fuel fluid comprising fuel F30 is pressurized by a pressurizer, pump, blower, or compressor 310 which delivers a pressurized fuel fluid F32 to a VAST combustor, or thermogenerator 150. An oxidant fluid comprising an oxidant F20 is pressurized by a pressurizer, pump, blower, or compressor 200 which delivers a pressurized oxidant fluid F22 to the combustor 150. oxidant and fuel are combusted to form products of combustion. Diluent fluid F40 is pressurized by a pressurizer, pump, blower, or compressor 410 to form pressurized diluent fluid F41.

A portion of diluent fluid F41 may be distributed by splitter distributor 430 to deliver combustor diluent fluid F42 upstream of the outlet of combustor 150 to form VASTgas or process fluid F10 comprising products of combustion and vaporized thermal diluent. Another portion F44 of diluent fluid F41 may be mixed with the VASTgas F10 in mixer 635 to form diluted VASTgas F62.

For example, natural gas as fuel F30 may be delivered and combusted with a modest amount of air as oxidant fluid F20 forming products of combustion comprising fluid water and carbon dioxide. Water as diluent F40 may be delivered upstream of the combustion system outlet to form VASTgas F10 comprising products of combustion and steam.

The VASTgas may then be delivered to heat and extract heavy hydrocarbons from surface mined oil sands. The VASTgas may be configured for temperatures from about 50° C. to more than 1500° C. at pressures ranging from one atm to more than 300 atm. The diluted VASTgas may be delivered in a range from about 50° C. to 400° C. over a range from about one atmosphere to at least 220 atm.

In one configuration C1A, the VAST thermogenerator may operate on natural gas with water flow F40 controlled to deliver diluted VASTgas F62 at a pressure of about one atmosphere and a nominal temperature of 100° C. The results of thermo-economic modeling of this configuration C1A are shown in Table 1 and Table 2 including the composition and pressure of VASTgas and diluted VASTgas. (e.g., using the power industry-standard numerical modeling program Thermoflex version 15).

In this configuration, an "atmospheric" VAST cycle burner may be operated to burn natural gas (NG) at a combustor outlet temperature of about 482.2° C. (900° F.) with a small amount of excess air (about 5% over the amount of oxidant required for stoichiometric combustion of the natural gas fuel, i.e., a "relative oxidant" "ratio to stoichiometric combustion", hereinafter Lambda λ, at λ=1.05). The resulting mol or volume fraction compositions in percentage terms (hereinafter, v %) of input gases/fuel and VASTgas or conventional combustor outputs are shown in Table 1.

Water may be added to the combustion gases in a prescribed amount to adjust the temperature of the delivered VASTgas in this configuration to 100° C. The input flow rates of fuel, air, and water were 0.45 kg/s, 8.18 kg/s, and 4.82 kg/s respectively, which produced a water to fuel ratio (hereinafter, W/F or ω) of 10.6 by mass. The input fluid flow temperatures were 15° C. for air and water and 25° C. for fuel. The relative humidity of the input air was 60%. The water and fuel in this and subsequent examples are delivered at pressures somewhat higher than the combustion chamber pressure to inject them into the chamber.

In this configuration model, a flow of 2.91 kg/s of additional water at 15° C. was added to the combustion gases after exiting the combustor with a direct contact heat exchanger ("water spray") to reduce their temperature from the 482.2° C. combustor outlet temperature to 100° C. (The total water flow including the water delivered directly to the combustor and after exiting the combustor=7.73 kg/s). This was adjusted to maximize the amount of steam in the VASTgas without condensation. This example shows the minimum exhaust temperature and the maximum amount of water addition that may be accomplished without condensing liquid water from the VASTgas.

The amount of water delivered into the VASTgas may be controlled according to the desired temperatures for heavy hydrocarbon extraction. Within such extraction temperature ranges, and desired combustion temperatures, the VASTgas temperature is fully adjustable by the amount of water added.

A similar thermo-economic simulation was conducted, using similar equipment, and the same initial input fluid flows, for a combustion temperature of 1035° C. (1895° F.). The combustor is configured to handle such higher temperatures with less water injected into the combustor itself while more water injected into the discharged gases downstream of the combustor.

The same process fluid flow, process fluid composition, and process heat were produced and the overall system thermal efficiency was the same as the case of 482.2° C. at the combustor outlet (same amount of fuel and same fuel/air ratio). For the case of 1035° C. combustor outlet, the water flow to the combustor was 2.18 kg/s (ω=4.8), and the water added to the discharged gas downstream of the combustor outlet was 5.55 kg/s (total water flow=7.73 kg/s, the same as 482.2° C. combustion). The temperature of the consequent VASTgas was therefore the same as the previous example, i.e. 100° C.

VAST thermogenerator configuration C1A may be used produce VASTgas and a summary of the flow data and thermal efficiency derived from the thermoeconomic modeling for 1 atm combustion (1035° C.) is shown schematically in FIG. 1. Referring to FIG. 1, modeled results of a similar configuration C1B with 30 atm VASTgas at the outlet of thermogenerator 150. (e.g., delivering 15.9 kg/s of process fluid flow, with a process heat flow of 20.7 MW and a system thermal efficiency of 41% in the enthalpy delivered in the diluted VASTgas delivered to the wellhead).

The delivered system thermal efficiency to the well head includes the fuel fluid, oxidant fluid and diluent fluids shown entering the embodiments and the fuel used to generate electricity to run fluid pressurizers including compressors and/or pumps.

This includes input fluid flow temperatures of 15° C. for air and water, and 25° C. for fuel. The relative humidity of the input air is assumed 60%. In the figures described below, separation work for oxygen enriched air is not included in the system efficiency.

In configuration 1B as shown in FIG. 1, pressurized air may be provided by an electrically driven air compressor 200. The electricity was assumed to be provided by a fuel powered gas turbine with a thermal energy to electricity efficiency of 40%. The net energy consumption to compress air is the principal reason for the significant reduction in total system thermal efficiency (i.e. 99% for 1 atm combustion and 41% for 30 atm combustion, respectively).

Example 2

1 atm VAST Cycle Burning Coke Fuel (Water/Fuel = ω=7.1)

In another configuration C1C, an atmospheric VAST cycle burner was modeled burning coke with combustion gases diluted to a temperature of 482° C. (900° F.) with a small excess air as oxidant fluid. Coke composition: 79.7% C, 4.47% S, 2.3% H, 10.6% $H_2O$, 0.27% ash; 5% excess air. i.e. Λ=1.05). Table 1 shows the mole fraction compositions of input gases/fuel and VASTgas outputs. The input flow rates of fuel, air and water were 0.45 kg/s, 5.32 kg/s, and 3.20 kg/s respectively, giving a W/F ω of 7.1. The input temperatures were 15° C. for air and water, and 25° C. for fuel.

The energetic fluid (VASTgas) temperature for this example is 100° C. Additional water at 1.86 kg/s is added to the combustion gases to reduce their temperature from the 482.2° C. combustor outlet temperature to 100° C. (total water flow=5.07 kg/s). Delivering VASTgas at 100° C. provides the maximum steam in the VASTgas without condensation.

The $CO_2$ content of the VASTgas using coke fuel is 8.37 v % as it exits the combustor and 6.50 v % after water addition as compared to 4.64 v % for the case C1A of natural gas (hereinafter, NG) fuel as it exits the combustor and 3.63 v % after additional water is added to reduce the temperature to 100° C. Configurations using other carbonaceous fuels such as diesel fuel or heavy hydrocarbons will deliver a $CO_2$ content intermediate the extremes of NG and coke. i.e. Between high hydrogen content of about 4:1 H:C, or about 25% H content by mass, and very low hydrogen content, of less than about 3% by mass.

This invention may use variable fuel mixtures to adjust the concentration of $CO_2$ in VASTgas across a range of a factor of about 2. Additional $CO_2$ may be added from other sources. Coke is readily available and is a relatively inexpensive fuel since it is a byproduct of the common refining of bitumen to synthetic crude oil in Alberta. The burning of such a fuel in a VAST cycle produces a relatively high fraction of $CO_2$ in the VASTgas. This is projected to increase the recovery rate after injection of VASTgas into heavy hydrocarbon material if the hydrocarbon is not already saturated with $CO_2$ at a given temperature and pressure. Such high $CO_2$ production would conventionally considered a disadvantage. However, in some configurations, VAST cycles may use enhanced $CO_2$, to enhance heavy hydrocarbon extraction efficiency as compared to "cleaner burning" natural gas.

In some configurations, a heavy hydrocarbon, such as bitumen, extracted or mined from a hydrocarbon resource may be used directly to produce more VASTgas. When extracting a heavy hydrocarbon from a well using VASTgas, a portion of that hydrocarbon may be used to provide the energy needed. Bitumen, heavy oil, coke and other heavy hydrocarbons, have a higher carbon content than natural gas. In such configurations, the $CO_2$ fraction of the consequent VASTgas will be higher than that listed in Table 1 for NG but lower than that listed for coke. Heavy hydrocarbons extracted using this elevated $CO_2$ method will typically contain residual dissolved $CO_2$. This produces additional $CO_2$ in the combustion chamber which further increases the amount of $CO_2$ in the VASTgas and the hydrocarbon extraction efficiency.

In another configuration, coke may be used as fuel. This configuration was modeled with the same input fluid flows to give a combustion temperature of 1035° C. Further water may be injected into the exhaust downstream of the combustor outlet to give the same process fluid (VASTgas) flow, process heat flow and process fluid composition as that for 482.2° C. delivery temperature. The results of the simulations at 482.2° C. and 1035° C. and the composition of the input gases/fuel and VASTgas outputs are shown in Table 1 along with those for NG combustion.

Example 3

Diverted VAST Cycle Gas Turbine Combustion Gases

Gas turbines are highly efficient means to produce both electricity and mechanical energy at high specific power levels from various fuels. The use of high water (liquid water or steam) injection levels to increase the specific power of such systems is well known in the art, e.g., U.S. patent application Ser. No. 10/763,057 (Hagen et al.). Using water allows higher fuel injection levels for a given input fluid flow (water and air). This is due to the higher specific heat of water as compared to air and the corresponding ability of water to provide greater cooling for a given mass flow of fuel being combusted.

TABLE 1

VAST Thermogenerator wet combustion vs dry combustion.

| | INPUT GASES/FUEL | | | OUTPUT GASES | | | | | |
|---|---|---|---|---|---|---|---|---|---|
| | | | | VAST | VAST | VAST | VAST | Dry | Dry |
| Atom or Molecule | Coke Fuel v % at 25° C. | NG Fuel v % at 25° C. | Air v % at 15° C. RH 60% | Gas v % at 482° C. (coke) | Gas v % at 100° C. (coke) | Gas v % at 482° C. (NG) | Gas v % at 100° C. (NG) | Combustion v % at 1035° C. (NG) | Combustion v % at 100° C. (NG) |
| $O_2$ | | 0.07% | 20.7% | 1.0% | 0.8% | 1.1% | 0.9% | 11.5% | 6.9% |
| $N_2$/Ar | | 3.6% | 78.2% | 39.2% | 30.6% | 38.5% | 30.2% | 75.0% | 45.2% |
| $CO_2$ | | 0.3% | 0.03% | 8.4% | 6.5% | 4.6% | 3.6% | 4.3% | 2.6% |
| S | 4.5% | | | | | | | | |
| $H_2O$ | 10.6% | | 1.0% | 51.5% | 62.1% | 55.7% | 65.3% | 9.2% | 45.3% |
| $CH_4$ | | 87.0% | | | | | | | |
| $C_2H_6$ | | 8.5% | | | | | | | |
| $C_2H_4$ | | 0.03% | | | | | | | |
| H | 2.3% | 0.4% | | | | | | | |
| C | 79.7% | | | | | | | | |

Table 1 was Thermoflex modeled as a VAST thermogenerator with 482° C. outlet temperature with atmospheric combustion of natural gas and coke with input and output fluid flow compositions before and after addition of extra water to bring temperature to 100° C. (NG λ=1.05, ω=10.6; coke λ=1.05, ω=7.1).

In another embodiment, a wet combustion cycle using modified or diverted gas turbine (hereinafter, Diverted VAST GT) may be used to produce VASTgas with high water and $CO_2$ content, as shown schematically in FIG. 2. This may be configured as a low pressure configuration C2A such as FIG. 2 with 2 atm pressure ratio VAST GT.

Another configuration C2B may deliver a medium pressure VASTgas such as with a 30 atm pressure ratio VAST GT. The thermoeconomic modeled results for configurations C2A and C2B are summarized in Table 1 and Table 2. The input fluid flow rates and compositions (e.g., 0.45 kg/s of NG fuel at 25° C. and 15° C. air and water), air to fuel ratios (near stoichiometric with λ=1.05) and a combustion temperature of 1035° C. are those used for the VAST combustion configuration C1A and C1B as depicted in FIG. 1.

portion of VASTgas F17 may be diverted deliver VASTgas F61 to use to extract heavy hydrocarbons.

The VASTgas portion F17 may be further mixed in mixer 635 with a portion F77 of heated diluent F76 from splitter 431. The portions may be controlled to control the temperature of F61 within a prescribed hydrocarbon deliver range. Expander 600 may drive compressor 220 via shaft 850. In further configurations, splitter 630 may be replaced by equivalent valves downstream of the expander 600 and of the mixer 635. This enables use of lower temperature valves.

In a model of this Diverted VAST GT configuration C2A, the first flow F15 is modeled as sufficient to extract enough mechanical energy to operate the compressor 220. The second flow F17 is modeled as comprising the remainder of the combustion gases exiting the combustor, is mixed with additional water F77, using a mixer or direct contact heat exchanger 635. e.g., such as shown U.S. Pat. No. 5,925,291 (Bharathan), to lower its temperature and increase its steam content. The composition and heat content of the resulting combustion gas/water mixture or VASTgas F61 is shown in Table 2 for configurations C2A and C2B.

TABLE 2

VASTgas from VAST burner and VAST cycle Gas Turbine (GT) for NG combustion, with extra water added (λ = 1.05, ω = 10.6)

| | INPUT GASES/FUEL | | | OUTPUT GASES | | | | |
|---|---|---|---|---|---|---|---|---|
| Atom or Molecule | Nat. Gas Fuel v % at 25° C. | Air v % at 15° C. 60% RH | VAST Gas v % at 482° C. 1 atm (NG) | VAST Gas v % at 100° C., 1 atm (NG) | VAST cycle GT v % at 113° C. 2 atm (NG) | VAST cycle GT v % at 158° C. 9 atm (NG) | VAST cycle GT v % at 196° C. 20 atm (NG) | VAST cycle GT v % at 217° C. 30 atm (NG) |
| $O_2$ | 0.07% | 20.7% | 1.1% | 0.9% | 0.8% | 0.8% | 0.8% | 0.8% |
| $N_2$/Ar | 3.6% | 78.2% | 38.5% | 30.2% | 27.0% | 26.9% | 26.5% | 26.3% |
| $CO_2$ | 0.3% | 0.03% | 4.6% | 3.6% | 3.3% | 3.2% | 3.2% | 3.2% |
| $H_2O$ | | 1.0% | 55.7% | 65.3% | 69.0% | 69.1% | 69.5% | 69.8% |
| $CH_4$ | 87.0% | | | | | | | |
| $C_2H_6$ | 8.5% | | | | | | | |
| $C_2H_4$ | 0.03% | | | | | | | |
| H | 0.4% | | | | | | | |
| System thermal efficiency from Thermoflex | | | | | 90.0% | 86.4% | 83.0% | 80.7% |

Figure 2:
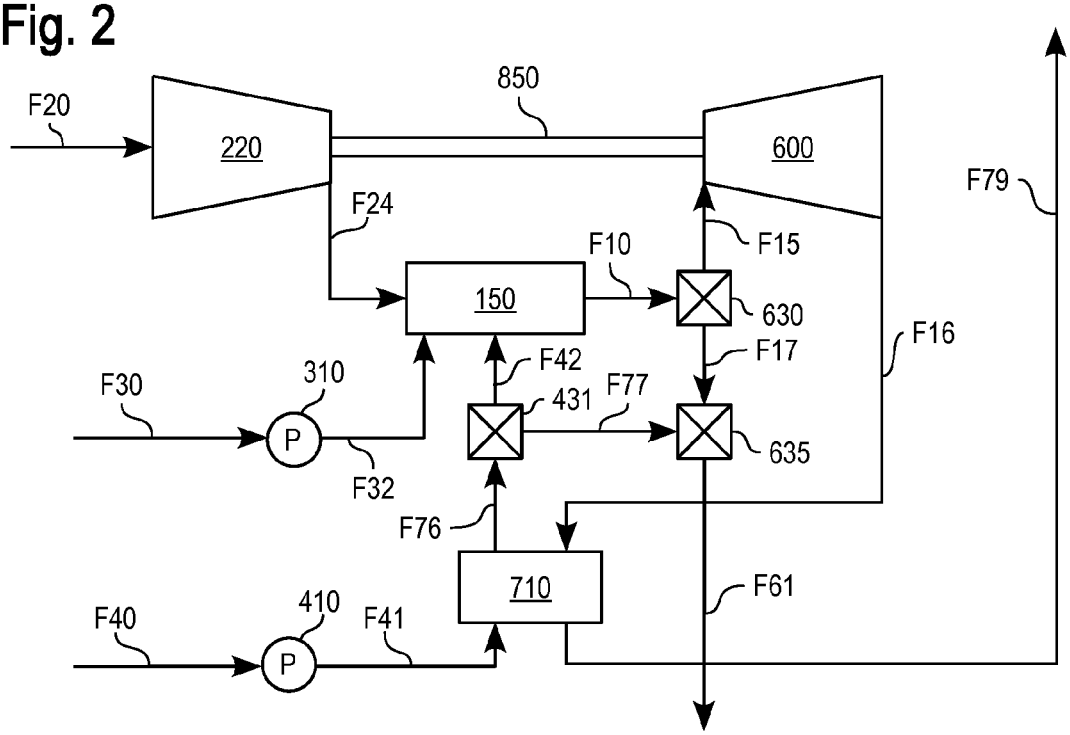
FIG. 2 schematically illustrates a VAST Diverted Gas Turbine delivering pressurized process VASTgas.

The Diverted VAST GT configuration of FIG. 2 may use portions of the VAST thermogenerator configuration of FIG. 1 as described herein. Instead of pressurizer 200, this configuration may use pressurizer or compressor 220 to deliver compressed oxidant fluid F24 to combustor 150 with a combustor inlet pressure. A portion of pressurized diluent F41 may be directed through heat exchanger 710 to recover heat from expanded fluid F16 from expander 600 and form heated diluent F76. A portion F42 of heated diluent may be directed by mixer 431 to thermogenerator 150 upstream of the outlet. Products of combustion from combusting fuel fluid F32 with oxidant fluid F24 with mixed with diluent F42 are delivered from the thermogenerator F150 as VASTgas F10.

For the diverted GT embodiment shown in FIG. 2, the VASTgas F10 exiting the combustor 150 may be split through splitter or diverter 630 into two flows F15 and F17. The first flow F15 is directed through expander 600 to extract mechanical energy forming an expanded fluid F16 that is preferably directed through heat exchanger 710. The second A summary of the process gas compositions and system thermal efficiencies to well head resulting from various pressure ratio VAST GT's as modeled in FIG. 2 are shown in Table 2. e.g., configurations C2A and C2B at intermediate pressure ratios of 9.2 atm, 15 atm, and 20 atm are shown in Table 2. The mol % or v % of $CO_2$ in the resulting process gas (or VASTgas) in these configurations are somewhat lower than that formed in a VAST burner (3.2 v % for the VAST GT and 3.6 v % for a VAST combustor) but the water content may be higher (~69 v % instead of ~65 v % respectively).

The amount of enthalpy or heat flow contained in the VASTgas in these configurations C2A and C2B is somewhat lower at 30 atm than the enthalpy contained in the VAST combustor example (18.8 MW instead of 20.7 MW) because a significant fraction of heat is lost to the exhaust gas. The amount of heat lost to the exhaust gas is higher in the case of a higher pressure ratio GT. This is due to the exhaust temperature being higher at higher pressure to avoid condensation and potential corrosion problems.

However, the total thermal efficiency is significantly higher when using the GT configuration as shown in FIG. 2 configuration 2B (81% instead of 41% for a VAST cycle combustor). The compression of the incoming air (or oxidant) is provided directly by the GT used to produce the VASTgas. Some "waste heat" from the exhaust may be diverted into the incoming water stream by the economizer.

Figure 30:
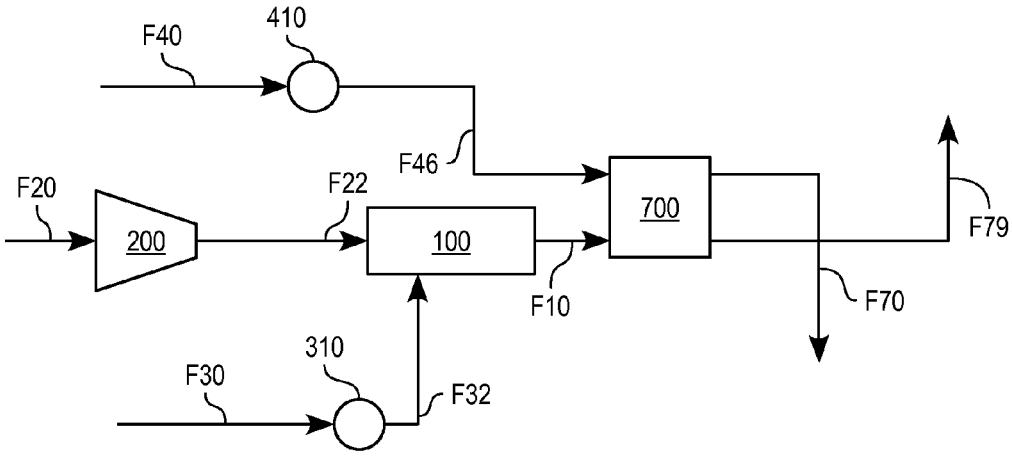
Fig. 30 PRIOR ART
FIG. 30 schematically illustrates a prior art boiler with heat recovery steam generator for heavy hydrocarbon extraction.

Referring to FIG. 30, the relevant art may pressurize fuel fluid F30 such as natural gas, with a pressurizer, pump or compressor 310 to deliver pressurized fuel fluid F32 to combustor 100. Oxidant fluid F20, such as air may be pressurized with a blower or compressor 200 to deliver pressurized oxidant fluid F22 to combustor 100. Fuel and oxidant are combusted in combustor 100 to form products of combustion F10 that flow through boiler 700. Water F40 is pressurized via pump 410 to form pressurized water F46 that is delivered to combustor 700 to form steam F70 delivered to the resource. Cooled flue gas F79 is exhausted to the atmosphere.

The modeled efficiency gain using this configuration at 30 atm is projected to exceed the relevant art such as shown in a boiler of FIG. 30, (77% system thermal efficiency) simulated using the same input parameters. Furthermore, a VAST GT process gas contains significant quantities of $CO_2$ (3.2 v % in this example). This increases the fraction of heavy hydrocarbon that may be mobilized and extracted for a given quantity of heat injection into heavy hydrocarbon material.

The configurations C2A and C2B depicted in FIG. 2 may include an economizer 710 to transfer some heat from the expanded fluid F16 exiting the expander 600 to heat diluent F41 (e.g., water) with a portion F42 injected into the combustor 150 and downstream of the combustor. Water may be injected downstream of the combustor to increase the water content of and to cool the VASTgas as in the previous examples.

The transfer of heat in the economizer reduces the heat loss to the exhaust and increases the overall thermal efficiency of the system. The thermoeconomic models of configurations C2A and C2B provided the heat flows and total thermal efficiency of the embodiment depicted in FIG. 2. The water added and heat recovered by the economizer in these configurations simulates about the maximum (but realistic) amount of heat transfer and cooling of the combustion stream and the exhaust gas without causing water to condense in the exhaust stream.

Example 4

"Diverted VAST GT" Configuration with 99% $O_2$ Combustion

The use of enhanced $O_2$ concentrations in order to increase combustion power density for a given overall system size and in order to reduce NOx emissions and sequester $CO_2$ is known in the art, e.g., U.S. Pat. No. 7,021,063, (Viteri). In further configurations of embodiment shown in FIG. 2, $O_2$ enriched air or oxygen may be used with wet combustion to generate VASTgas. This may be used to extract heavy hydrocarbons. Such configurations provide advantages of higher power densities and higher $CO_2$ concentrations in the resulting VASTgas. This gives higher hydrocarbon extraction efficiencies and enables much smaller, more modular systems in the extraction process.

Referring to FIG. 2, a low pressure configuration C2C of a VAST Diverted GT configuration may use 99% $O_2$ and 1% $H_2O$ as an oxidant instead of air (20.7% $O_2$) (at 2 atm NG combustion). A similar medium pressure diverted VAST GT configuration C2D, such as at 30 atm NG combustion. These configurations C2C and C2D were modeled assuming the same size compressors and same size expanders as those used in configurations C2A and C2B.

Because of the high $O_2$ content of the oxidant, (almost 5 times higher than air), higher amounts of fuel (2.1 kg/s instead of 0.45 kg/s) may be combusted in the combustor with near stoichiometric combustion, e.g., $\lambda$=1.05 without a significant increase in the size or capacity of the combustor. The amount of water injection may be increased to maintain a constant combustion temperature. e.g., a temperature of 1035° C. is provided by using 35.9 kg/s of water for 2 atm $O_2$ combustion in configuration C2C. This compares with 7.6 kg/s for 2 atm air combustion used in configuration C2A.

Similarly, configuration C2D of FIG. 2 used 33.5 kg/s of water for 30 atm $O_2$ combustion. By comparison configuration C2C used 7.2 kg/s for 30 atm air combustion. In this configuration C2D, of the 33.5 kg/s of total water used for 30 atm $O_2$ combustion, 15.5 kg/s is injected directly into the combustor. The remaining 18.1 kg/s is injected into the VASTgas after diversion of the flow from the turbine in order to reduce its temperature and increase its water content.

The combustion chamber may be enlarged to accommodate the increased fuel and water flows. However, since the oxidant flow is held constant between these two examples, the extra combustor capacity required is quite modest. The input temperatures for water, air and fuel flows are the same as that used in the previous examples (15° C., 15° C., and 25° C. respectively) and the combustion temperature was again set to 1035° C.

In further configurations C2C and C2D of the embodiment of FIG. 2, combustion gases are directed to the turbine in an amount sufficient to operate the compressor (as was the case for air combustion). Any additional gases are diverted to form VASTgas process fluid (after additional water is added in order to increase the water content and reduce the temperature of the gases).

The increased fuel flow (4.58 times, i.e. +358%) modeled as being burned in the combustor delivers about 5.25 times (i.e. +425% higher) the process fluid heat for 99% $O_2$ combustion as compared to air combustion for the same configuration, compressor and turbine size. The energy from the additional fuel is all delivered to the energetic fluid. This increases the overall efficiency of the process. No additional energy is required for compression because the same amount of gas flow into the compressor (air or 99% $O_2$ as the case may be) is being compressed in both cases.

Normalized modeled values for the near-stoichiometric combustion of the same quantity of fuel (0.45 kg/s) are also shown in configurations C2C and C2D, which is the same amount of fuel combusted in the model used to generate the data for configurations C2A and C2B. However, the compressor for this model may be reduced to 21% of the size as that used for the previous model (less oxidant necessary for near stoichiometric combustion). The use of enhanced $O_2$ combustion allows more choice and flexibility in the choice of gas turbine configuration for various applications.

Referring to FIG. 2, The use of enhanced $O_2$ combustion increases the specific power and the enthalpy of the VASTgas produced by the GT by more than 5 times and significantly increases the overall system thermal efficiency for the production of VASTgas. In addition, there is a substantial increase in the percentage of both $H_2O$ and $CO_2$ in the VASTgas. For example, in configuration C2D the concentration of $CO_2$ is 5.1 v % for 99% $O_2$ combustion of NG.

By comparison, configuration C2A resulted in 3.2% $CO_2$ for air combustion of NG. Here further fuel may be converted to $CO_2$ and $H_2O$. This with added diluent may replace a portion of the oxygen and nitrogen that would otherwise be present in air combustion. The concentration of $CO_2$ may be further enhanced by using higher carbon content fuels such as coal or coke. Given the high solubility of $CO_2$ in heavy hydrocarbons, it is expected that this increase in $CO_2$ concentration will substantially increase the rate of extraction and/or the overall percentage of heavy hydrocarbon that may ultimately be extracted from a given formation or amount of mined material.

Configurations increasing the power density for a given system (e.g., 5.25 times for 30 atm $O_2$ combustion as compared to air combustion) are projected to increase the rate of extraction by a similar amount for a given system size or capital investment. This is projected to increase the profitability and reduce the time to profit for a given GT system by a similar amount (i.e. 5 times or more) assuming the oxygen costs are relatively modest or are offset by a reduction in the cost of the fuel used.

Configurations increasing the delivered power density systems may be used to reduce system size. This may improve system portability and/or modularity. This is projected to further improve system efficiency and reduce capital costs relative to conventional simple or Brayton cycle systems.

Some configurations may be implemented as localized or modular extraction facilities associated with well pads having multiple well pairs. Small prefabricated combustors or gas turbines may be transported to heavy hydrocarbon extraction sites and configured on site with a large reduction in the amount of local skilled labor required.

The modeling results for configurations C2C and C2D of FIG. 2 as shown in Tables 2 used 99% $O_2$ for the oxidant fluid used for combustion. Some configurations may use oxygen enriched air with lower $O_2$ concentrations. e.g., to reduce costs and to use more portable oxygen purification systems. (e.g., pressure swing to provide 85-95% $O_2$). Pressure swing separation methods may be used to produce $O_2$ at a cost of \$20-50/tonne in volumes of >100 tonnes/day (2005 prices, Kobayashi et al., GCEP Advanced Coal Workshop, 2005).

For comparison, the mass of $O_2$ being used for the models of configurations C2C and C2D as shown in Table 2 is approximately 700 tonnes per day (i.e. ~8 kg/s X 86400 s/day). For the near stoichiometric combustion that may be delivered with wet combustion (i.e., $\lambda$=1.05 as modeled above), this works out to a cost of \$1.90-\$4.75 for the cost of oxygen to combust each MMBTU of NG fuel and a cost of \$1.25-\$3.15 to combust each MMBTU of coke fuel.

Some configurations may increase size and flows to lower prices. Other configurations may offset the oxygen cost by using cheaper fuels such as high sulfur "sour gas", heavy hydrocarbon, bitumen, coke, and/or coal. In configurations using NG fuel, the extra cost of the $O_2$ may be less than the extra profit realized through the resultant increase in heavy hydrocarbon extraction efficiency and rate.

The use of $N_2$-containing oxidant (e.g., air, or enhanced $O_2$ at concentrations of 22-94%), offers an advantage when the VASTgas resulting from this oxidant is injected into heavy hydrocarbon material. This is because it may reduce parasitic heat losses to the pipes and delivery system as compared to pure steam and it may produce an insulating layer above a hydrocarbon formation being heated, in a similar manner to SAGP technology.

The high $O_2$ concentrations described above provide other advantages. e.g., higher power density, higher $CO_2$ concentrations and a dramatic reduction in the capital cost required for a given hydrocarbon extraction rate. Such systems may be operated at either extreme of $O_2$ concentration or anywhere in between through minor modifications to the system.

It should be possible to optimize the overall extraction process over the period during which hydrocarbons are being extracted from a given formation or amount of mined material. An example of such an optimization would be a lower $O_2$ concentration (still possibly enhanced over that of air) during the initial phases of extraction in order to build up an insulating cap of $N_2$ over the formation in question. However, after the cap is in place it should be possible to increase the $O_2$ concentration (and decrease the $N_2$ concentration) in order to realize the above-mentioned advantages of high $O_2$ concentrations in the system.

The use of air combustion, with its accompanying high concentration of $N_2$ results in considerable build-up of $N_2$ within the reservoir. In some SAGD extraction conditions, this may result in a reduction in extraction rate of heavy hydrocarbons. The use of enhanced oxygen as the fuel oxidant would significantly reduce the amount of nitrogen in the resulting VASTgas and avoid this build-up of $N_2$ within the reservoir.

Figure 4:
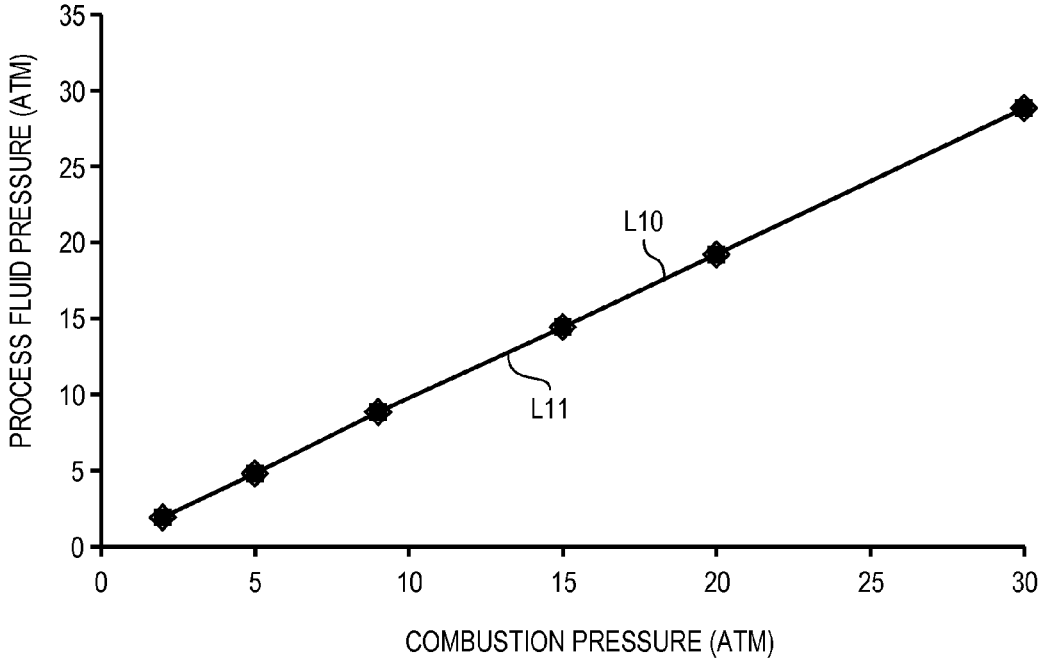
FIG. 4 illustrates the functional dependence of process VASTgas pressure for low and high pressures of a VAST Diverted Gas Turbine.
Figure 5:
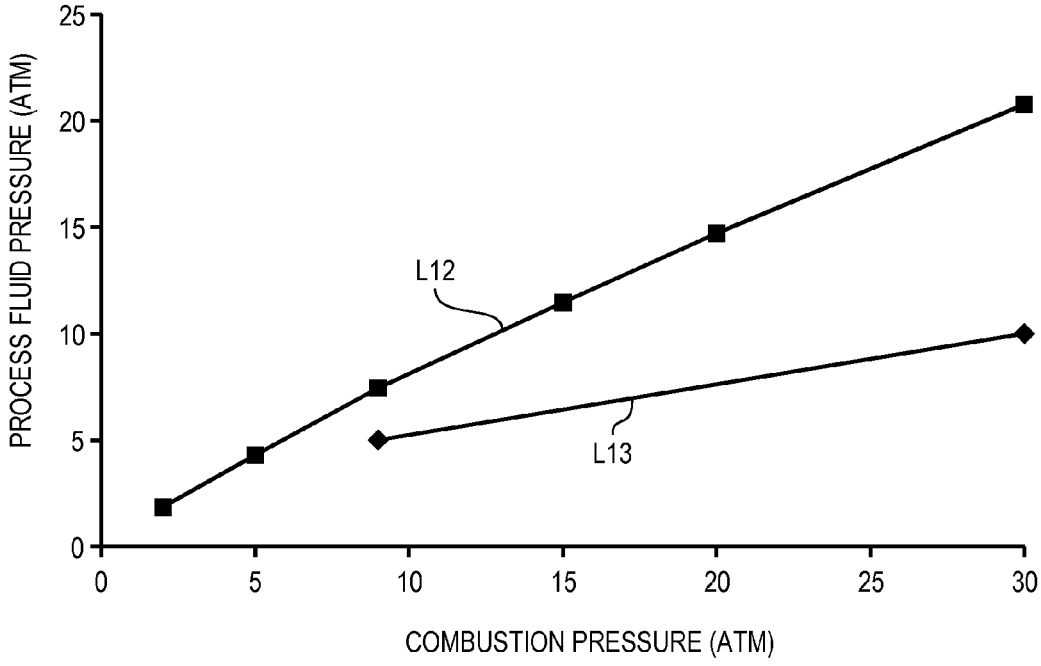
FIG. 5 illustrates the functional dependence of process VASTgas pressure for air and 99% $O_2$ natural gas combustion in VAST Direct Gas Turbine normalized to fuel flow.

The thermoeconomic modeled data for configurations C2A through C2D (of FIG. 2) are graphed in FIG. 4 showing the process fluid pressure (in atmospheres) versus combustion pressure for enhanced (99%) $O_2$ combustion (square symbols) to produce VASTgas. Similarly FIG. 4 shows the process fluid pressure for air (20.7% $O_2$) combustion across a range of pressure from 2-30 atmospheres. The delivered VASTgas pressure is close to the combustion pressure since nearly all of the small pressure drop (0.2-1.2 atm) across the combustor itself and the high pressure exhaust VASTgas is diverted directly to form process fluid after addition of water in a direct contact heat exchanger.

In configurations C2A through C2D, none of the VASTgas being used as process fluid is expanded in the turbine (in contrast to the "VAST direct GT" configuration—see example 6). Thus the pressure of the delivered VASTgas process fluid is close to the oxidant fluid pressure exiting the compressor. This is the case whether or not enhanced $O_2$ is used in combustion.

Figure 6:
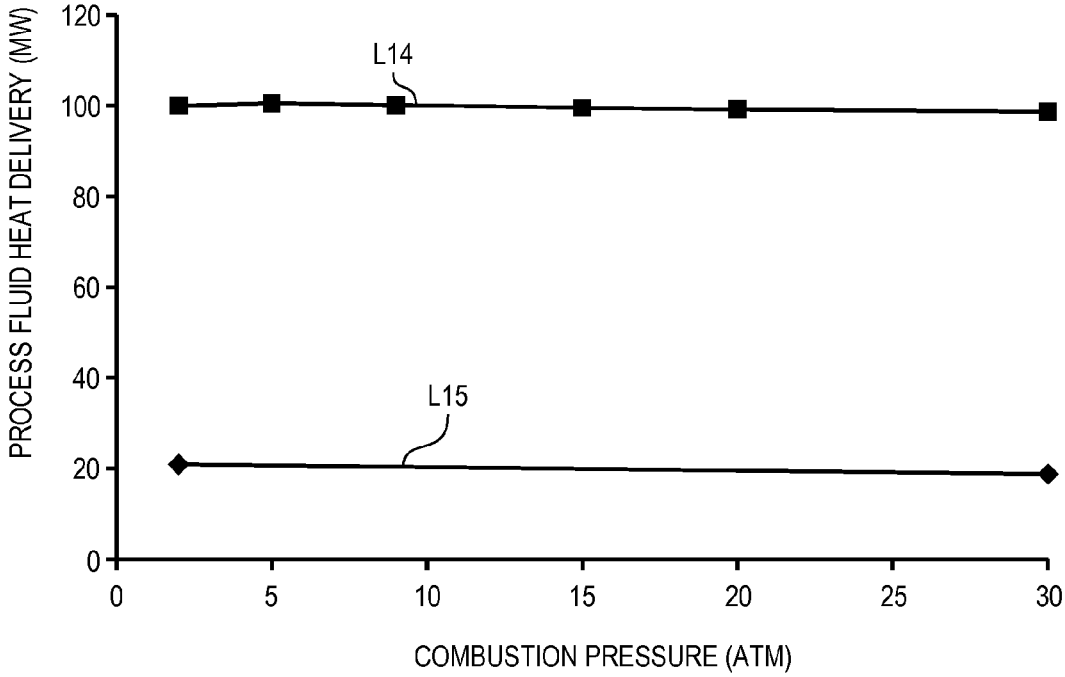
FIG. 6 illustrates the process VASTgas heat delivery for flow constrained constant size VAST Diverted Gas Turbine for natural gas combustion with Air or 99% $O_2$.

The VASTgas process fluid heat delivery (MW) is shown in FIG. 6 for VAST diverted GT configurations for combustion using air in line L15 (diamonds) compared with line L14 for 99% $O_2$ (squares) as oxidant fluid, for configurations C2A through C2D of the diverted GT embodiment of FIG. 2. This is shown for the modeled combustion pressure range of 2-30 atm. Configurations using enhanced $O_2$ combustion in a VAST combustor of FIG. 2 provide a large increase (4.8 times) in the amount of fuel that can be combusted in the same sized combustors compared with using air as the oxidant fluid for combustion.

The amount of delivered VASTgas heat that can be formed is about proportional to the amount of fuel that is being combusted across the whole range of pressures. e.g., approximately 100 MW of process heat may be delivered by VASTgas for heavy hydrocarbon extraction for the case of 99% $O_2$ combustion of NG as compared to approximately 20 MW for air combustion with the same combustor size. Given that this increase (>5 times) may be achieved with approximately the same size VAST GT expander, this implies a corresponding improvement in power density and the rate of return on capital for the energy conversion and process heat delivery portion.

Figure 7:
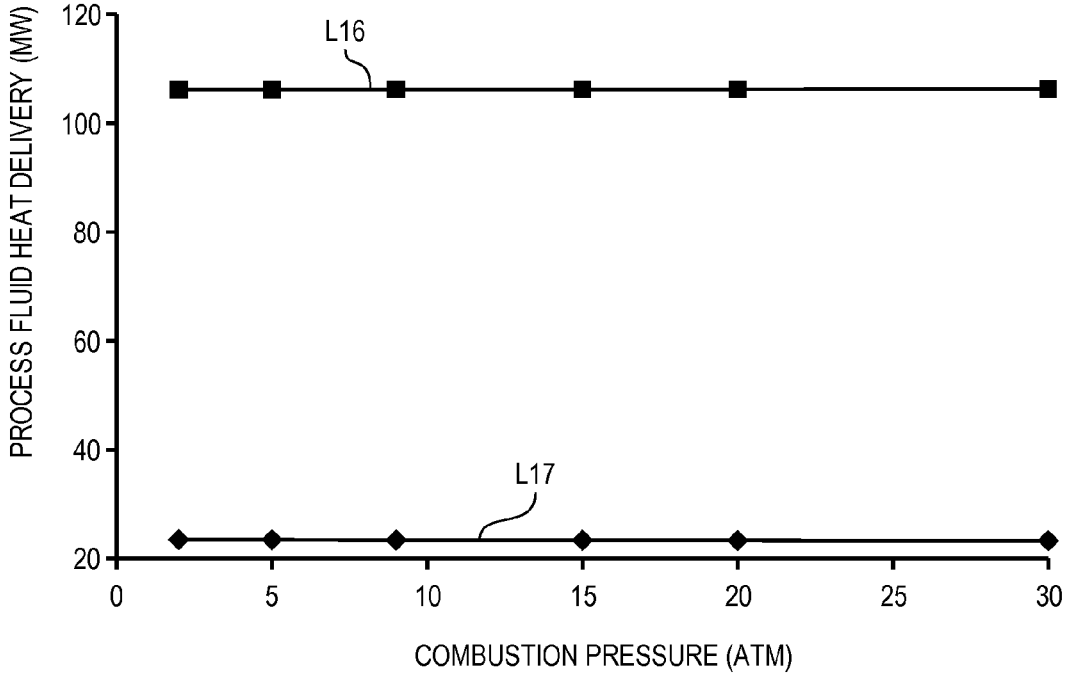
FIG. 7 illustrates the process VASTgas heat delivery for flow constrained constant size VAST Direct Gas Turbine for natural gas combustion with Air or 99% $O_2$ FIG. 8 schematically illustrates a VAST Direct Gas Turbine with dual combustors and expanders delivering process VASTgas and electricity.

FIG. 7 compares the process fluid heat delivery (MW) to the well head for VAST Direct GT using Air combustion line L17 (diamonds) compared to 99% $O_2$ combustion line L16 (squares) for the same sized expander at 1035° C. Oxygen combustion enables about a five fold increase in heat delivery to the well head for the same size expander in a Direct VAST GT.

Example 5

VAST Cycle Gas Turbine VASTgases Generated at High Efficiency Using Air Combustion ("Direct VAST GT")

Figure 3:
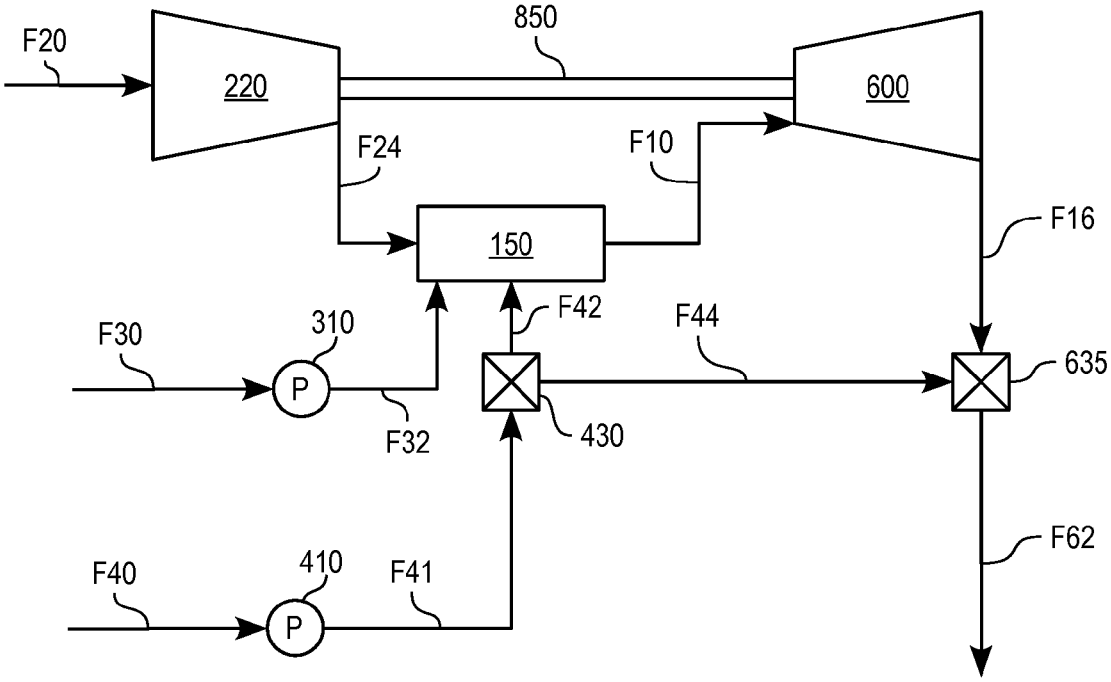
FIG. 3 schematically illustrates a VAST Direct Gas Turbine delivering pressurized process VASTgas.

Referring to FIG. 3, in a direct VAST gas turbine (GT) embodiment, a portion F62 of the expanded fluid from the gas turbine may be used a process fluid F62. This embodiment of FIG. 3 may use components described in that of FIG. 2 which are herein incorporated by reference. In the configuration of FIG. 3, the pressurized diluent fluid F41 may be directly controlled by splitter or valve 430 to deliver a portion F42 to the combustor and F44 to mix in mixer 635 with a portion F16 of the fluid expanded by the expander 600.

In some Direct VAST GT configurations, all of the expanded fluid from the gas turbine may be used directly as process fluid without diversion of any combustion gases into an exhaust stream. This appears to provide the highest system thermal efficiency modeled and the highest VASTgas flows for hydrocarbon extraction. A modest pressure configuration C3A may use a combustor outlet pressure of about 9.2 atm. A medium pressure configuration C3B may use a combustor outlet pressure of about 30 atm. An overpressure is provided to inject process gases. The results of process fluid composition and system efficiency are shown in Table 2.

Higher pressures may be used to increase the $CO_2$ dissolution rate in heavy hydrocarbons and to provide greater penetration, with consequent increases in extraction efficiency. Extraction efficiency has been shown to increase with pressure with pure steam depending on reservoir permeability, well depth and other variables. However, higher pressures also increase steam losses and typically increases the total amount of steam required (Steam to Oil Ratio). e.g., see "Injection pressures for geomechanical enhancement of recovery processes in the Athabaska Oil Sands", (Collins). Pressures of ~25-30 atm have been shown to be an effective trade-off between these two extremes for some reservoirs.

The configurations C3A and C3B of FIG. 3 provide a process fluid to improve extraction. These configurations may use retrofits of GTs to VAST direct cycles. The number of turbine stages and the air to fuel ratio may be decreased compared to a Brayton cycle (with a corresponding increase in the specific power provided by the combustor). This provides an increase in temperature and exhaust enthalpy of the VASTgas exiting the turbine. (e.g., these configurations may use "near stoichiometric combustion" for a VAST cycle). The retrofit efforts required for such a configuration are relatively modest. i.e. water injectors into the combustor, removal of some of the turbine stages, and the addition of a direct contact heat exchanger. (i.e. a water spray into the exhaust).

The modeled results of direct VAST GT configurations C3A and C3B are shown in Table 2. These indicate more than 98% overall above ground system thermal efficiency to the well head. They show the highest overall process enthalpy flow (23.4 MW and 23.3 MW respectively for the 9.2 and the 30 atm compression ratio models) of any of the air combustion VASTgas configuration options.

This efficiency is also superior to the relevant art embodiment of boilers shown in FIG. 30. The VAST gas efficiency and high heat flow is accompanied by a reduction in the process fluid injection pressure as compared to VAST diversion configurations (Diverted VAST GT) of FIG. 2, as described in configurations C2A through C2D. The 30 atm Diverted VAST GT configuration C2B of embodiment FIG. 2, for example provides compressed oxidant fluid F24 into the combustor 150 at 30 atm, and provides VASTgas F15 to the expander at approximately 29 atm with a system thermal efficiency of 81% to the well head. This compares with delivering VASTgas at 10 atm with a thermal efficiency of 98% for the configuration C3B of embodiment of FIG. 3.

The input fuel flow and combustion temperature for both exemplary configurations C3A and C3B models is the same as that used for most of the previous examples, i.e. 0.45 kg/s (1.0 lb/s) of NG at 25° C. The input fluid flow temperatures are 15° C. for water F40, 15° C. for air F20, and 25° C. for fuel F30 as used in the previous configuration models C1A, C1B, C2A and C2B. The combustor outlet temperature (TIT) was similarly set at 1035° C. in these models (using Thermoflex v. 15). The relative air or oxidant to fuel ratio of these configurations was modeled as lambda $\lambda$=1.05 (i.e. a small increase over stoichiometric combustion).

Example 6

VAST Cycle GT VASTgases Generated at High Efficiency for Enhanced $O_2$ Combustion of NG ("Direct VAST GT")

The use of oxidant fluid F20 with enhanced $O_2$ concentrations may provide the high overall system thermal efficiency of the direct flow configuration described above with an overall increase in both the overall heat content and a higher injection pressure for the delivered VASTgas process fluid for any combustion pressure.

Referring to FIG. 3, another embodiment partially expands the VASTgas F10 from the combustor 150 through expander 600. This system is configured as VAST gas turbine with suitable sizing of expander to compressor design fluid flow ratio appropriate to the relative oxidant ratio Lambda and the TIT. It may also be obtained by retrofitting a conventional gas turbine.

In the embodiment of FIG. 3, all the expanded fluid from the VAST cycle modified GT may be used directly as process fluid. In configuration C3A, the oxidant fluid F20 may comprise oxygen, or oxygen enriched air to provide enhanced $O_2$ combustion. One exemplary medium pressure configuration C3A was modeled with compressed fluid F24 delivered at 9.2 atm from pressurizer or compressor 220 to combustor 150 (or with a 9.2 compression ratio).

Referring to FIG. 3, a similar exemplary configuration C3D was modeled with a compression ratio of 30. Modeled gas compositions and heat flow simulation results are shown in Table 3. The same model parameters were chosen as in the previous configurations C3A and C3B except that the oxidant fluid F20 was 99% $O_2$ with 1% water and the fuel flow F30 is Natural Gas with the oxidant to fuel flows adjusted to provide near stoichiometric combustion (lambda $\lambda$=1.05).

By using oxygen enriched air (with a flow rate of 8.1 kg/s similar to configurations C3A, C3B), the fuel flow F30 may be increased from 0.45 kg/s (1 lb/s) to 2.1 kg/s (4.6 lb/s) without a major change in the size of the combustion chamber of combustor 150. Given the high flow rate of $O_2$, the fuel flow F30 may be increased (e.g., from 0.45 to 2.1 kg/s) in configurations C3C and C3D. Correspondingly, the diluent fluid F40 (e.g., water) may be increased to about 34.4 kg/s to maintain the combustion temperature at about 1,035° C. In modeling this configuration, the input temperatures for water F40, and air flows F20 are set to 15° C., as before, while the fuel flow F30 temperature was set to 25° C. as before.

Table 2, shows the thermoeconomic model results for configurations C3C and C3D, for combustor inlet pressures of 9.2 atm and 30 atm with enhanced $O_2$ combustion. This shows more than 98% overall system thermal efficiency to the well head, with the highest overall process flow enthalpy of any of the VASTgas configurations modeled. e.g., 106 MW for both the 9.2 atm and the 30 atm compressor delivery pressures.

This high VASTgas system thermal efficiency and heat flow is accompanied by a reduction in the process fluid injection pressure as compared to VAST diversion configurations (VAST diverted GT) as described in embodiments shown in FIG. 2 and FIG. 3. The 30 atm enhanced $O_2$ combustion model of the Direct VAST configuration C3C and C3D of embodiments of FIG. 3 provides VASTgas at approximately 20.8 atm. This compares with 10 atm for the DIRECT VAST configuration C3B with air combustion and the 9.2 atm enhanced $O_2$ combustion configuration C3C which provides VASTgas at 7.4 atm. This compares with VASTgas delivery at 5.0 atm for air combustion in configuration C3C.

FIG. 4 shows the functional dependence of delivered VASTgas pressure for enhanced $O_2$ combustion (squares) and air combustion (diamonds) in a Diverted VAST GT as a function of combustion pressure modeled for the pressure range of 2 atm to 30 atm. These are modeled for 0.45 kg/s (1 lb/s) F30 fuel flow and 1035° C. TIT with compressor sized proportional to oxidant fluid flow F20. The percentage pressure decrease is greater at higher pressure because the amount of energy required to compress the oxidant increases exponentially with pressure. However, this penalty is counterbalanced by the increase in solubility of $CO_2$ in heavy hydrocarbons as a function of increasing pressure and the improved penetration capability for VASTgas in heavy hydrocarbons at higher pressure.

Depending on the depth or distance from the GT to the material being extracted and the losses in delivering heat to the heavy hydrocarbons due to geochemical or process flow conditions, adjusting the range of delivered pressures as those conditions change during the extraction process, may be desirable to improve overall extraction efficiency or other parameters such as the total quantity of heavy hydrocarbons extracted from a given a well or formation. For example, a high pressure may be used during the initial stages of extraction in order to "charge" the heavy hydrocarbons with VASTgas. In later stages, a more moderate pressure may be used to sustain extraction of the heavy hydrocarbons.

Example 7

VAST Cycle GT Retrofitted with $2^{nd}$ Turbine

Figure 8:
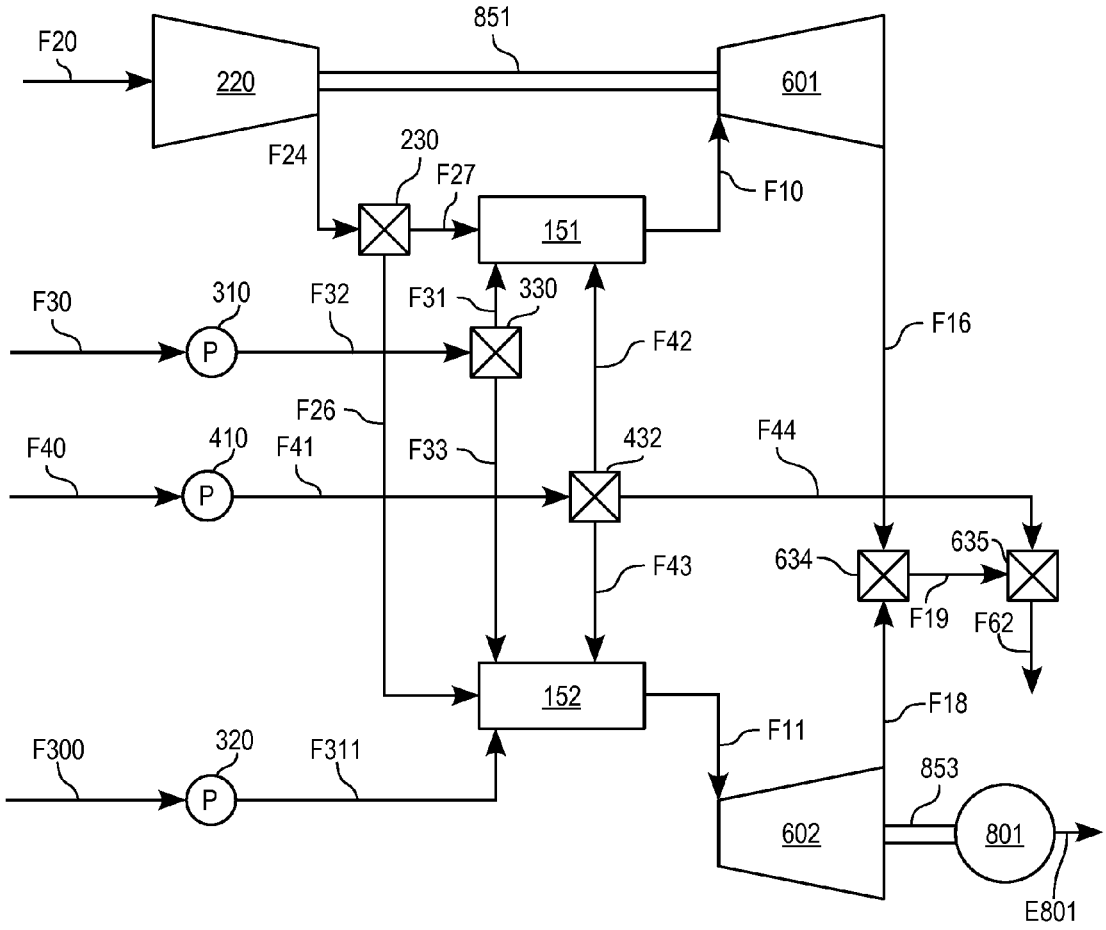

In another embodiment, a parallel DIRECT VAST GT configuration C4 may be used, as schematically shown in FIG. 8. This may use components as described in the Direct VAST GT configuration described in FIG. 3 and incorporated herein. In this configuration of FIG. 8, a portion of compressed oxidant fluid F24 is directed through splitter or valve 230 to form a first oxidant fluid portion F27 to a first combustor or thermogenerator 151 and a second oxidant fluid portion F26 to a second thermogenerator 152. The pressurized fuel fluid F32 may be directed through valve or splitter 330 into a first fuel portion F31 to first combustor 151 and a second fluid portion F33 delivered to the second combustor 152.

In the configuration of FIG. 8, the pressurized diluent F41 may be directed through splitter or valve F432 to deliver a first portion F42 to first thermogenerator 151, and a second portion F43 to second thermogenerator 152 to mix with products of combustion of fuel F33 and oxidant F26 to form VASTgas F11. VASTgas F10 formed in thermogenerator 151 may be directed through expander 601 to form expanded fluid F16. VASTgas F11 from second thermogenerator 152 may be expanded through expander 602 to form expanded fluid F18. Expanded fluids F16 and F18 may be combined in mixer 634 to form combined flow F19 which may be mixed in mixer 635 with a third portion of diluent F44 from valve or splitter 432 to form the combined VASTgas or process fluid F62. This process fluid F62 may be delivered to extract heavy hydrocarbon from a hydrocarbon resource or from mined hydrocarbon resource.

In this configuration, the first expander 601 may drive compressor 220 with drive shaft 851. The second combustor 152 may be configured to provide VASTgas F11 to a second expander 602 to from expanded flow F18 and to generate additional shaft power 853 which may drive a generator 801 to deliver electrical power E801.

The electrical power E801 may be used to operate heavy hydrocarbon extraction pumps or other useful equipment. The fuel flow F30 delivered to both combustors may be adjusted to maintain the relative air lambda within a prescribed range. e.g. To provide lambda with a range from 1.0 to 2.0, or from 1.02 to 1.5, or from 1.03 to 1.2, or from 1.04 to 1.1, or about 1.05. The latter is close to stoichiometric combustion which provides for near maximum overall power of any air combustion configuration. (e.g., $\lambda \sim 1.05$) This configuration may also be used to further increase the power using enhanced O2 combustion.

In this configuration C4, the second expander 602 may not require any additional energy to compress the oxidant fluid or air F20. All the compressed air desired for both the first combustor 151 and second combustor 152 may be provided by the first expander 601 driving the first compressor 220. This may only need to compress air. This allows for very high specific energies and tuning of each of combustors 151 and 152 to meet specific or changing process demands (e.g., electricity demand), especially for the second turbine and high VASTgas flows.

The process flow (VASTgas) F18 from the second expander 602 may be combined with the $1^{st}$ turbine's VASTgas output F16 in mixer 634 to form combined expanded fluid F19. A portion F44 of pressurized diluent fluid F41 may be mixed in mixer 635 with one and/or both of expanded flows F16 and F18 and/or combined flow F19 to form recovery process fluid or VASTgas F62. Diluent F44 may be used to control the temperature of VASTgas F62 to within a prescribed heavy hydrocarbon recovery temperature range.

The second process flow F18 or recovery process fluid F62 may be used in a second heavy hydrocarbon extraction operation or other process application. A $3^{rd}$ (or more) combustor/expander like combustor 152/expander 602 may be added to this retrofit configuration to create additional VASTgas and/or electrical power. The surplus from compressed oxidant fluid or air F24 from compressor 220 may be made sufficient for at least 3 combustors/turbine of approximately the same specific power as the original Brayton cycle combustor configured in a typical Brayton turbine. This additional process fluid and heat may be used to augment a single process flow, or to drive separate heavy hydrocarbon extractions (e.g., separate wells), or other process applications, such as the extraction of heavy hydrocarbons from mined material.

The total process fluid and heat flow of this configuration C4 is typically more than double that of the previous configurations because the $2^{nd}$ expander does not have to drive a compressor. The second combustor 152 and expander 602 may be chosen to provide more electrical power than the first expander. This may be supplemented by another power shaft and/or generator from the $1^{st}$ GT to provide additional power. However, the capital cost of this configuration C4 is estimated as less than double that of the previous configurations C2A through C3D of FIG. 2 through FIG. 3 since only 1 compressor 220 and 1 generator 801 is required. Thus in configuration C4 of embodiment of FIG. 8, the ratio of process heat (and the extraction rate of heavy hydrocarbons) to capital cost is expected to be greater than in configurations with two GTs.

Configuration C4 is expected to provide more flexibility in the operation of such a configuration because the fuel, water and air flows into both combustors may be adjusted separately. Such configurations may be used to flexibly configure amount of process heat and electrical power produced.

In the VAST GT configurations shown in FIG. 2 configuration 2A through FIG. 3 configuration 3D, thermal diluent F40 may comprise liquid water and/or steam. This provides a greater capability than air to dilute or cool fuel combustion in combustors 151 and 152, and allow for higher fuel flows F31 and/or F33 than air-cooled (Brayton) combustion with the same compressor 220. Combustion in this parallel Direct VAST configuration C4 FIG. 8 thus provides substantially higher specific heat for each gas turbine, and more process heat per unit of capital expenditure than corresponding air cooled Brayton turbine configurations, or VAST or other configurations with lower aqueous diluent or water flow.

Figure 9:
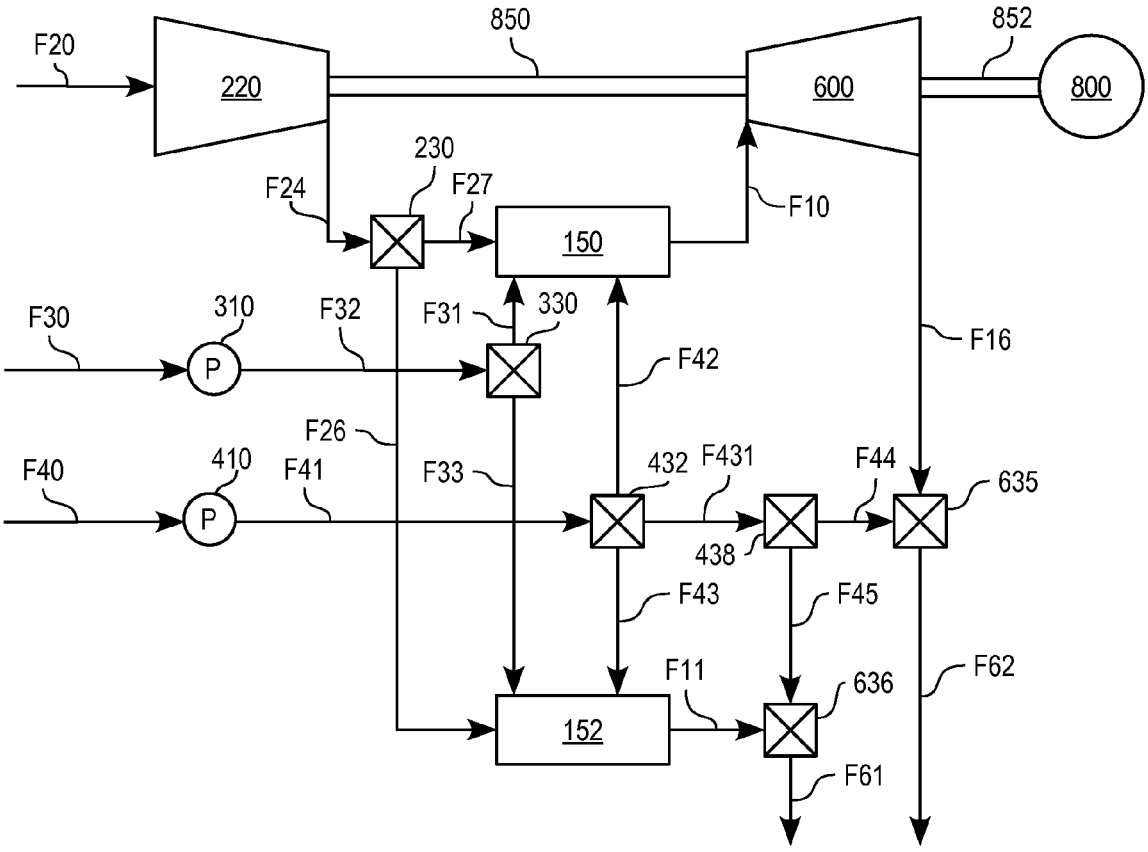
FIG. 9 schematically illustrates a VAST Direct Gas Turbine with a parallel thermogenerator delivering high pressure process VASTgas, electricity, and low pressure process VASTgas.

Referring to the embodiment of FIG. 9, a configuration C5 may use a configuration with a Direct VAST GT with a parallel thermogenerator. This configuration is similar to configuration C4 of FIG. 8 and the relevant parts of that reference and incorporated herein. In configuration C4, the second expander is replaced by a VAST combustor or Thermogenerator 152. The first combustor 150 feeds VASTgas F10 to expander 600. This may be configured to drive compressor 220 by shaft 850. It may also drive a generator 800 via shaft 852.

The compressed oxidant F26 for the Thermogenerator F152 is provided by the same compressor 220 as is used to provide compressor oxidant F27 (e.g., air or enhanced oxygen) for the GT combustor 150. The diverted compressor flow F33 to thermogenerator 152 is combusted with fuel F33 and diluent F43 to form diverted VASTgas F11. Diluent valve or splitter 432 may direct flow F431 to a second valve or splitter 438 to deliver diluent portion F45 to mix with VASTgas F11 in mixer 636 to form a high pressure diluted VASTgas F61. Another portion F44 of diluent F431 may be mixed with expanded fluid F16 in mixer 635 to form low pressure diluted expanded fluid F62.

One or both of the high pressure diluted VASTgas F61 and/or the low pressure diluted expanded fluid F62 may be delivered to a hydrocarbon resource to facilitate hydrocarbon recovery. This configuration is more advantageous for cases in which there are concerns about the corrosive or explosive properties of the fuel mixture being used in the second combustor or Thermogenerator.

Example 8

The Use of VASTgas for the Extraction of Heavy Hydrocarbons from Mined Material In the Alberta oil sands, the majority of bitumen extraction is currently accomplished through surface mining followed by various chemical and physical extraction methods. The most common of these methods utilizes hot water, caustic soda (NaOH) and macroscopic physical agitation (stirring) to separate the bitumen from the sand and clay to which it is attached. The process typically utilizes NG to heat water in a boiler and then the hot water is delivered to the bitumen separation tank for mixing with the bitumen.

After processing, much of the hot water is contaminated with incompletely extracted bitumen, soluble hydrocarbons sometimes called "naphthoic acids", dissolved silicates and suspended sand/clay particulates. This water is typically directed to tailings ponds after post-production waste treatment with crushed gypsum ($CaSO_4$) to reduce the amount of the suspended particulates.

Figure 12:
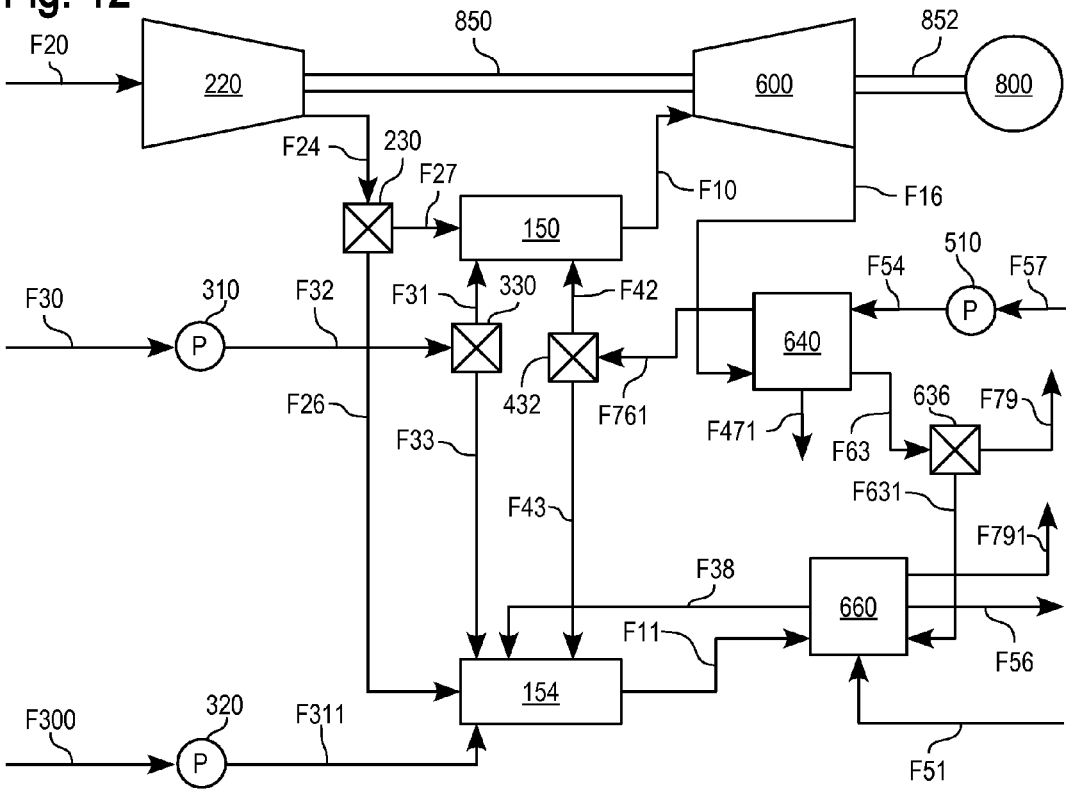
FIG. 12 schematically illustrates a VAST Direct Gas Turbine delivering low and high pressure process VASTgas and electricity to process and extract heavy hydrocarbon containing materials.

Another application of the use of VASTgas to improve the thermal efficiency, extraction efficiency and the environmental impact for the extraction of heavy hydrocarbons is in area of the extraction of bitumen from surface mined oil sand. Examples of the configurations that may be used to accomplish this using this invention are shown in FIG. 10 and FIG. 12.

Figure 10:
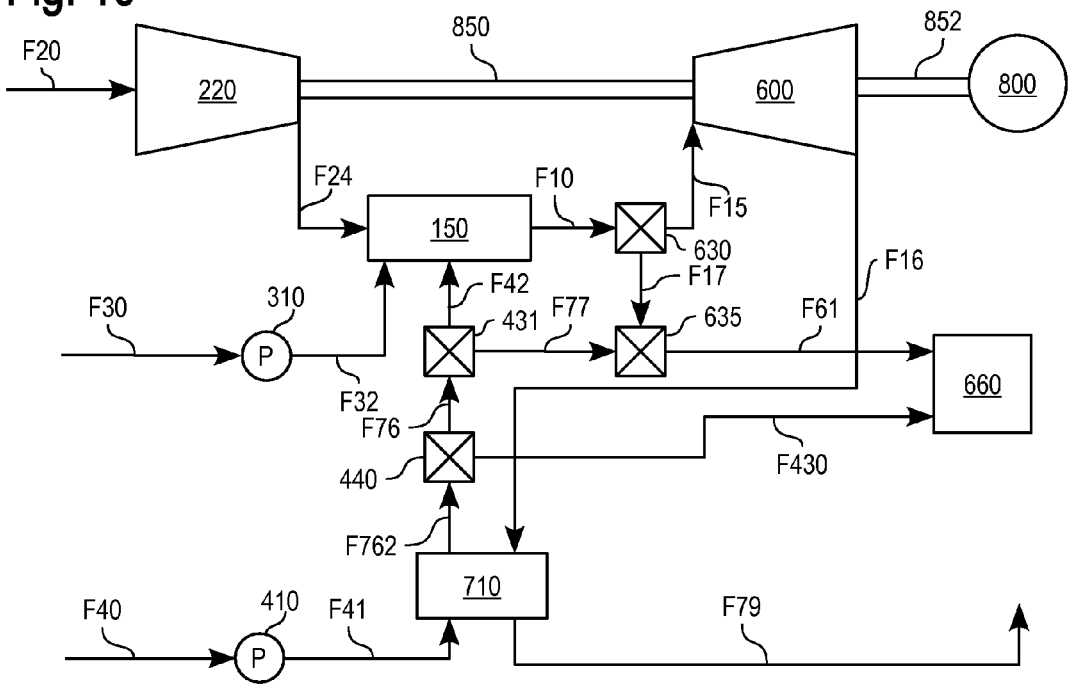
FIG. 10 schematically illustrates a VAST Diverted Gas Turbine delivering low pressure process VASTgas and heated water to process heavy hydrocarbon containing materials.

In the first configuration FIG. 10, VASTgas may be created using the VAST diverted GT configuration as a combination of embodiments of FIG. 2 configurations C2A to C2D above and FIG. 9 above. Common parts described in FIG. 2 and FIG. 9 are incorporated herein. A portion F17 of VASTgas F10 from splitter 630 may be mixed in mixer 635 with portion F77 of diluent F76 from splitter 431. This forms diluted VASTgas F61 that may be delivered to hydrocarbon extraction vessel 660. A portion F430 of heated diluent F762 may be directed through splitter or valve 440 to hydrocarbon extraction vessel 660.

For the configuration shown in FIG. 10, exhaust gas heat is recycled into the incoming water with an economizer. VASTgas is directed to a bitumen separation vessel where it is injected in the vicinity of the bottom of the vessel or partway up the side of the vessel, under pressure. This allows the air (mostly $N_2$) and $CO_2$ gases contained within the VASTgas to generate bubbles at the bottom of the separation vessel which move upward and create convection currents.

The high heat content of the VASTgas, most of which is contained in the water vapor portion of the VASTgas, creates further convective forces by condensing and heating the water at the bottom of the separation vessel, leading to a temperature inversion (i.e. hotter where the gas is being injected rather than at the top where the froth is being created and skimmed off). The combination of heating from the bottom and the upward force of the air and $CO_2$ bubbles is an effective method to provide efficient agitation at lower energy cost than mechanical stirring. The bubbles also efficiently produce a froth on the top of the vessel which may be skimmed off for further separation in a disk centrifuge or other separation method. The percentage of bitumen remaining with the sand grains should be significantly reduced using this method.

The $CO_2$ bubbles provide another significant advantage over conventional aqueous-only bitumen separation techniques. $CO_2$ is a more effective solvent for bitumen than water because of its chemical affinity (less hydrophilic). $CO_2$ bubbles on the bitumen-coated sand grains may be used to reduce the adhesive forces between the bitumen coating and the sand grains. They may also be used to provide local agitation to separate the bitumen from the grain. This is projected to reduce the energy requirements for bitumen extraction. The local agitative forces delivered by gas bubbles are more direct than those created as only a partial by-product of the macroscopic mechanical stirring. Some configurations may conduct the extraction process at lower temperatures through the use of $CO_2$ and air bubbles. This is expected to further lower the energy cost.

The relative efficiency for heat transfer in such configurations may be similar to that modeled for the cases shown in embodiment FIG. 2, configurations C2A and C2B. e.g., greater than 90% for a 2 atm GT with diverted flow and air combustion and greater than 81% for the same configuration C2B at 30 atm. Since hot water is useful in the bitumen extraction process, some configurations may deliver hot water from the output of the economizer 710 of FIG. 10. This may increase the total system thermal efficiency for this process relative to that shown in FIG. 2 configurations C2A and C2B. Using enhanced $O_2$ for combustion of configurations C2C and C2D may further increase the thermal efficiency and/or the power density of such processes.

Figure 11:
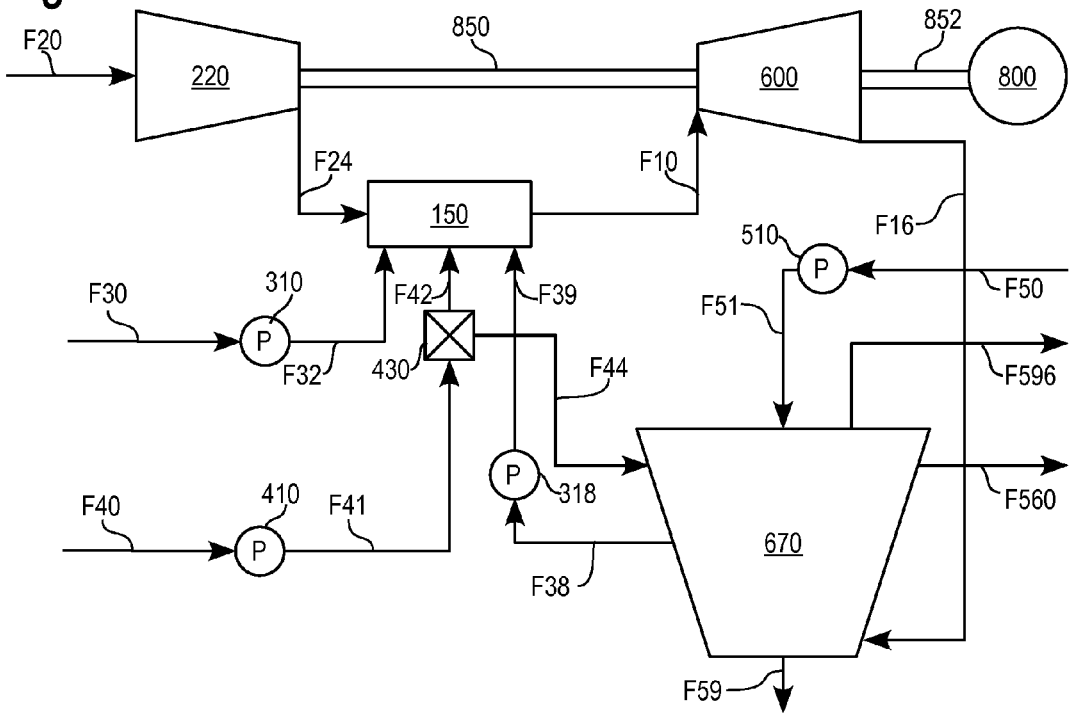
FIG. 11 schematically illustrates a VAST Direct Gas Turbine delivering process VASTgas and electricity to process mined heavy hydrocarbon containing materials.

Another configuration C1A for the enhanced extraction of heavy hydrocarbons is shown in FIG. 11. A Direct VAST GT configuration similar to FIG. 3 may be used in this example to deliver VASTgas with very high thermal efficiency (~98%). The common parts and descriptions for FIG. 3 are incorporated herein.

Oxidant fluid F20 may be compressed by pressurizer or compressor 220 to deliver compressed oxidant F24 to thermogenerator or combustor 150. Fuel fluid F30 may be pressurized by pressurizer 310 to deliver pressurized fuel F32 to combustor 150 and combust it with oxidant fluid F24 to form products of combustion. Mixing with portion F42 of pressurized diluent F41 may be mixed in combustor 150 to form VASTgas F10 to expander 600 forming expanded fluid F16. This expanded fluid F16 may be delivered into heavy hydrocarbon extraction vessel 670. Another portion F44 of diluent F41 may be delivered from valve or splitter 430 to extraction vessel 670.

Heavy hydrocarbon flow F50 from hydrocarbon resource may be pressurized by pump 510 to deliver pressurized hydrocarbon F51 to extraction vessel 670. A portion of the diluent F38 separated from hydrocarbon in extraction vessel 670 may be pressurized by pressurizer or pump 318 to deliver pressurized diluent F39 to combustor 150. Pressurized diluent F39 may comprise aqueous diluent and/or carbon dioxide. Solids extracted in extraction vessel 670 may be discharged as solids flow F59.

All of the $CO_2$ formed in combustion may be delivered to the bitumen separation vessel 670 as VASTgas. For this configuration, water may be delivered without heating since nearly all of the heat produced by the combustion is delivered directly to the separator vessel. Waste sand, clay and gravel may be extracted from the bottom of the separation vessel.

For the example shown in FIG. 11, the same convective method and $CO_2$ extraction is used to deliver local and macroscopic agitation to the vessel and bitumen, to produce a bitumen froth and to enhance the overall bitumen extraction rate. Electricity to drive the pumps and other process equipment may also be provided by the GT used to generate the VASTgas. Alternative fuels (e.g., coke) may be used for combustion in a VAST wet combustion turbine.

Another key feature of this configuration is the use of waste water from the separator vessel as cooling water for the wet combustion process, e.g., U.S. application Ser. No. 10/763,057 (Hagen et al.). VAST cycles are tolerant of contaminated water for several reasons including the long residence time for fuel molecules, the presence of relatively high concentrations of highly oxidative free radicals known as "hydroxyl radicals" in the combustion chamber and the relatively high enthalpy of the combustion gases due to the presence of high concentrations of water. This feature of the configuration greatly reduces the amount of wastewater being sent to settling ponds.

Another method of enhancing the treatment of wastewater is the use of a second VAST GT solely for the purpose of treating the wastewater and generating electricity and/or heat. Wastewater containing bitumen and suspended solids used in combustion are exposed to temperatures typically in excess of 1000° C. Hydrocarbons are readily destroyed at such temperatures. They further contribute to the fuel requirements of the process. Suspended solids may be filtered up front. Some configurations may dry particulates during the combustion process and then separate them.

The use of VASTgas with its $CO_2$ content to inject into a heavy hydrocarbon extraction vessel containing results in the dissolution of significant quantities of the $CO_2$ in the water (typically up to the solubility limit of water). Much or most of the $CO_2$ being injected into the water in the heavy hydrocarbon extraction vessel may be trapped in the water through this method. The temperature typically used in the extraction of bitumen from oil sand (50° C.), is low enough to provide dissolution of a significant fraction of the $CO_2$ in the water.

In configurations delivering such water down into a formation (possibly to improve heavy hydrocarbon extraction rates) or configurations using such water in the VAST combustion cycle for injection into such a reservoir, this increases the concentration of $CO_2$ in VASTgas. It may also contribute to an increase in the heavy hydrocarbon extraction rate of such a process. Such $CO_2$-containing water may be pumped from a site conducting mined heavy hydrocarbon extraction to a site conducting in situ SAGD extraction.

In some configurations, brackish water and/or produced water may be used that contains significant quantities of salt, particulates, residual waste hydrocarbons, and/or dissolved hydrocarbons. Such hydrocarbons may be combusted in a VAST cycle and reduce the amount of energy required to produce the process heat required to conduct in situ heavy hydrocarbon extraction.

Referring to FIG. 11, another configuration C11B for the efficient extraction of heavy hydrocarbons in mined materials may react limestone with the sulfur oxides formed. This configuration is similar to the previous configuration C11A, except that the fuel being used for the process contains an acid-producing constituent (in this case sulfur) and the incoming bitumen stream contains a roughly equivalent molar quantity of limestone in water sufficient to approximately neutralize the acid produced by the acid producing constituent(s).

There are abundant and inexpensive supplies of sulfur-containing fuels available in Alberta and in most other heavy hydrocarbon producing regions. For example, there are millions of tonnes of surplus elemental sulfur in Alberta that cannot be profitably transported to market at the current time. Such fuel is very inexpensive. Some configurations may use sulfur as fuel. This may significantly reduce the cost of and need to use expensive clean-burning NG fuel. Bitumen typically contains approximately 5% sulfur by weight and when burned may create sulphuric or sulfurous acids.

The combustion of sulfur-containing fuels in air or oxygen may be used to create mixtures comprising $SO_2$ and $SO_3$ gases with limestone delivered with heavy oil. e.g., configuration C11B for embodiment FIG. 11. If the VASTgas injection into the separation vessel 670 is accomplished at high temperature without the presence of liquid water (e.g., above 100° C.), acid corrosion of the turbine blades may be avoided or substantially reduced. The use of a VASThermogenerator without expansion turbine blades further reduces concern about the possible corrosive behavior of such gases.

Upon injection of such $SO_2/SO_3$-containing VASTgas into the separation vessel containing water and limestone in solution, an exothermic reaction to form sulfuric acid $H_2SO_4$ and then $CaSO_4$ (gypsum in crystalline form) and $CO_2$, occur, see equations E1-E5 below. Forming $CO_2$ by this reaction will create more bubbles in the separation vessel contributing further to convective macroscopic and microscopic agitation and the extraction of bitumen from the sand grains. These exothermic sulfur or $H_2S$ reactions, $SO_2$ and $SO_3$ reactions, and the solvation and/or reaction of $H_2SO_4$ to form $CaSO_4$ may be used to contribute to the heat requirements of bitumen separation. The $CaSO_4$ produced by the reaction may be used to reduce the concentration of suspended solids.

The use of limestone (i.e., $CaCO_3$) is an example of a compound that when reacted with an acid may produce $CO_2$. However, any carbonate salt (e.g., $Na(CO_3)_2$, $K(CO_3)_2$, $NaHCO_3$) when reacted with a sufficiently strong acid will also produce $CO_2$. Also, sulfur is only one of the commonly occurring natural impurities in hydrocarbon formations that will form an acid when combusted in oxygen and dissolved with water.

Phosphorus is another such element. The strong mineral acid, phosphoric acid (or phosphorous acid) may be formed by the combustion of phosphorous-containing materials when the resultant reaction products are dissolved in water. Other examples of such acid-forming elements are chlorine, fluorine, bromine and iodine. A common product of the high temperature combustion of air and fuel are various nitrogen oxides (NOx), which are also known to produce acid upon reaction with water. However, the concentration of such NOx products is typically much lower when high water/fuel ratios are used in VAST cycles; this is a possible additional source of such acids.

Referring to FIG. 10, FIG. 11 and FIG. 12, for configurations C2, C11A, C11B, and configuration 12, clean water may be condensed from the vapor exhaust from the separation vessel 660 or 670 with cooling water. Such a configuration is shown in detail in FIG. 12. This may combine the Direct VAST GT hydrocarbon processing configuration of FIG. 11 may be combined with the parallel diverted configuration of FIG. 9. The descriptions of FIG. 9 and FIG. 11 are incorporated herein.

Compressed oxidant fluid F24 may be apportioned by splitter 230 to portion F27 to combustor 150, and portion F26 to thermogenerator 154. Pressurized fuel F32 may be apportioned by valve 330 to fuel flow F31 to combustor 150 and portion F33 to thermogenerator 154. Similarly, fuel fluid F300 may be pressurized by pressurizer 320 to deliver pressurized fuel F311 to thermogenerator 154. Fuel fluid F300 may comprise heavy hydrocarbon, bitumen, coke and/or coal. These benefit from using inexpensive and/or dirty fuel. Diluent fluid F761 may be apportioned by valve 432 to diluent flow F42 to combustor 150 and diluent fluid portion F43 to thermogenerator 154.

Combusting fuel with oxidant and mixing with diluent forms VASTgas F10 from combustor 150 and VASTgas F11 from combustor 154. Expander 600 expands VASTgas F10 to deliver expanded fluid F16 to condenser 640. Cooling water F57 may be pressurized by pressurizer 510 to deliver pressurized cooling flow F54 through condensor 640 to recover heat from expanded fluid F16 into heated water F761 to splitter or valve 432. Valve 432 directs a portion F42 of flow heated diluent F761 to combustor 150, and a second portion F43 of heated diluent to thermogenerator 154.

Cooling expanded fluid F16 condenses diluent F471 from condensor and discharges cooled fluid F63. A portion of F63 may be directed by valve or splitter 636 to deliver a portion F631 to hydrocarbon extraction vessel 660. The rest of cooled fluid F63 may be discharged to the atmosphere as flow F79.

Produced hydrocarbon fluid F51 may be delivered to hydrocarbon extraction vessel 660. VASTgas F11 from thermogenerator 154 may be delivered to extraction vessel 660, preferably near the base of vessel 660 to improve the mixing within extraction vessel 640. Separated heavy hydrocarbon may be discharged as product flow F56. A portion of heated diluent with some hydrocarbon F38 may be delivered from extraction vessel 660 to thermogenerator 154. e.g., this may comprise heated waste water with residual bitumen.

Configurations may recover, separate and/or condense the concentrated $CO_2$ bubbling out of the froth at the top of the separation vessel 660. This may be further concentrated after condensing water from the vapor exhaust. This concentrated or separated $CO_2$ may then be recycled to further enhance heavy hydrocarbon recovery. It may be delivered as a diluent into one or both of combustor 150 and thermogenerator 154. The $CO_2$ may be mixed in with VASTgas delivered to extraction tank 660 and/or directly recycled to the bottom of the extraction tank 660. Excess $CO_2$ may then be sequestered.

Given the large amounts of electrical power that may be produced by a VAST GT, it should be possible to divert some of this power to a refrigeration cycle to first condense clean water from the exhaust and then to condense $CO_2$. This highly concentrated $CO_2$ may either be condensed as dry ice or pressurized as liquid $CO_2$ for subsequent sale or sequestration. Such processes may be utilized to reduce any perceived concerns about the creation of additional $CO_2$ from the bitumen separation process and to significantly reduce the amount of $CO_2$ being emitted from existing separation methods. This method of $CO_2$ reduction is another alternative to the aforementioned method of trapping $CO_2$ in the water used in heavy hydrocarbon extraction.

In another configuration, compressed VASTgas may be injected into a bitumen separation vessel at a sufficient rate to locally boil the fluid comprising the hydrocarbon resource. The temperature and pressure of the VASTgas generated in a gas turbine or a VAST thermogenerator may be controlled to regulate the boiling rate. e.g., by controlling the injection rate of VASTgas relative to the rate at which the separation fluid in the separation vessel may carry away the injected heat at any temperature. This may be controlled to maintain the temperature below or above the boiling point of the hydrocarbon slurry. The vigor of boiling may be controlled by the rate and distribution of delivery of the VASTgas relative to the inflow of colder material (e.g., cold water slurry of heavy hydrocarbon and sand).

As long as the net flow of heat into the separation fluid by VASTgas was balanced by heat removal (e.g., bitumen froth extraction, the delivery of cooling water and/or the delivery of cooler oil sand slurry), the average temperature of the separation fluid may be maintained at a temperature considerably below the boiling point. For this example, boiling fluids would condense within the separation fluid as the exchange of heat within the fluid caused the bubbles to collapse. This would create violent local agitation to further enhance the extraction process. If the concentration of $CO_2$ in the bubbles was also maintained at a relatively high level (i.e. by using a high concentration of $CO_2$ in the VASTgas), this would encourage $CO_2$ solvent extraction of the bitumen from the sand grains.

This localized boiling process initiated by high temperature VASTgas injection into the separation vessel may be further enhanced by the injection of $SO_2/SO_3$ containing VASTgas (or other acid forming gas) and the use of limestone (or other carbonate salt) in the separation fluid. As in the configuration discussed in configuration C11B of embodiment FIG. 11, such a sulfuric acid/limestone reaction may be used to further enhance the concentration of $CO_2$ as well as local heating by these strongly exothermic reactions. In some configurations, the rate of sulfuric acid and limestone delivery may be controlled to control the degree of local boiling. e.g., based on the concentration of sulfur in the fuel used to generate the VASTgas.

In other configurations extraction may be enhanced using VASTgas with high pressure extraction with $CO_2$. When pressurized above 5 atm at approximately room temperature, $CO_2$ becomes a liquid. In some configurations, the bitumen extraction process may be conducted at relatively low temperature with pressures above the condensation pressure of $CO_2$. Fluid delivery temperature and pressure may be controlled to provide liquid phase $CO_2$ in the resource to enhance extraction of the hydrophobic bitumen from the surrounding sand/clay. This may facilitate liquid $CO_2$ and/or bitumen comprising dissolved $CO_2$ to float upward relative to denser water taking the bitumen with it.

Higher pressures may be used to facilitate the penetration of $CO_2$ into the bitumen (high solubility at higher pressure) and to facilitate $CO_2$ sequestration once extraction is complete. $CO_2$ is somewhat soluble in water as carbonic acid, e.g., 0.01 g/l (Handbook of Chemistry and Physics, 57th Edition, Chemical Rubber Company Press, 1976-1977). $CO_2$ may be delivered above the saturation point at high pressure to form a separate layer apart from water in the same manner as oil or bitumen. This may be used to separate bitumen from the sand and tend to segregate to that $CO_2$ layer.

Example 9

Figure 18:
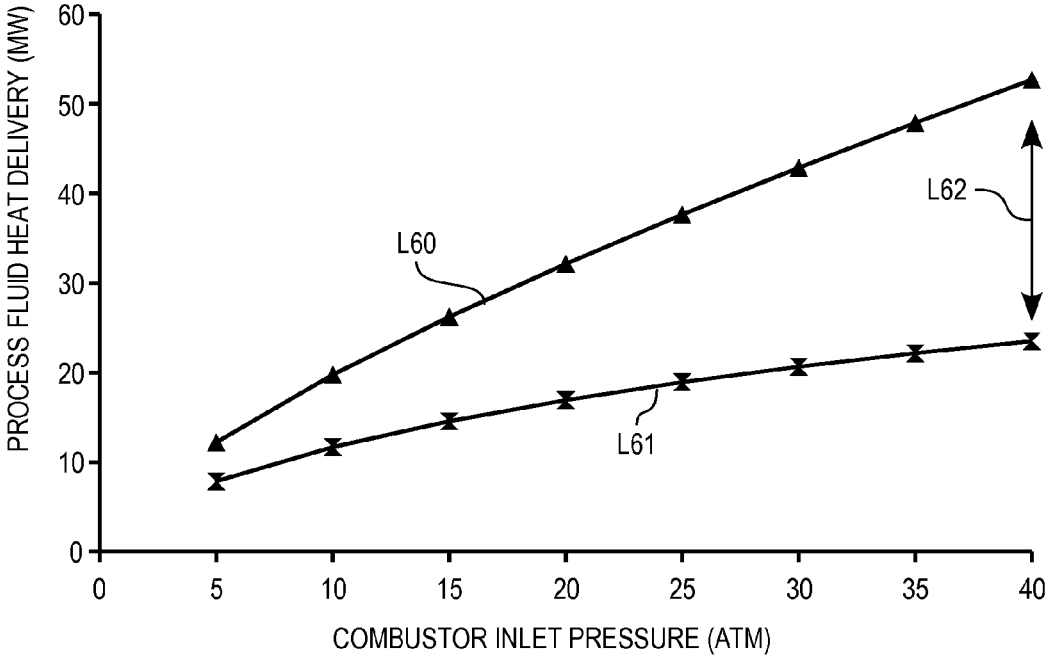
FIG. 18 illustrates the process fluid heat delivery for Brayton cycle vs. Direct VAST gas turbines, varying fuel with air at constant turbine inlet temperature and size.

Comparison of VAST Wet Cycle GT Combustion with Brayton (Air or Oxygen Cooled) GT Combustion for Air and Enhanced $O_2$ Combustion of NG FIG. 18 compares the amount of process heat produced between a Direct VAST GT configuration L60 (up triangle) and a similarly configured Brayton cycle GT configuration L61 (double triangle) assuming the same size expander. This was approximated by assuming the same total mass flow of fuel, oxidant and diluent (water or air respectively) for air combustion of natural gas. The thermoeconomic model assumed a 1453° C. Turbine Inlet Temperature (TIT) with combustor inlet pressures from 5 to 40 atm. The amount of fuel being combusted was adjusted to maintain a constant temperature with water used in the VAST GT configuration to maintain the TIT at constant mass flow. Extra air was used to maintain constant temperature for the Brayton GT.

Near stoichiometric combustion ($\lambda$=1.05) was maintained for all of the VAST GT pressures while $\lambda$ varied in a range of ~3.0 for the Brayton combustion. The amount of extra nitrogen being compressed for the Brayton example is reflected in the lower total process heat delivery (MW) to the well head. In addition, the requirement to compress all of the surplus nitrogen (about 3 times more) that is required to cool combustion in the case of the Brayton example, lowers the maximum amount of fuel that may be combusted in comparison to a VAST GT in a system of approximately the same size.

At 40 atm, the difference L62 (between L60 and L61) shows the Direct VAST GT has about 124% higher process heat delivery (MW) to the well head compared to a direct Brayton GT with the same expander. The Direct VAST GT L60 further provides 6.6 v % to 7.2 v % $CO_2$ in the process fluid delivered compared to 4.1 v % to 5.8 v % for the Direct Brayton GT L61.

Figure 19:
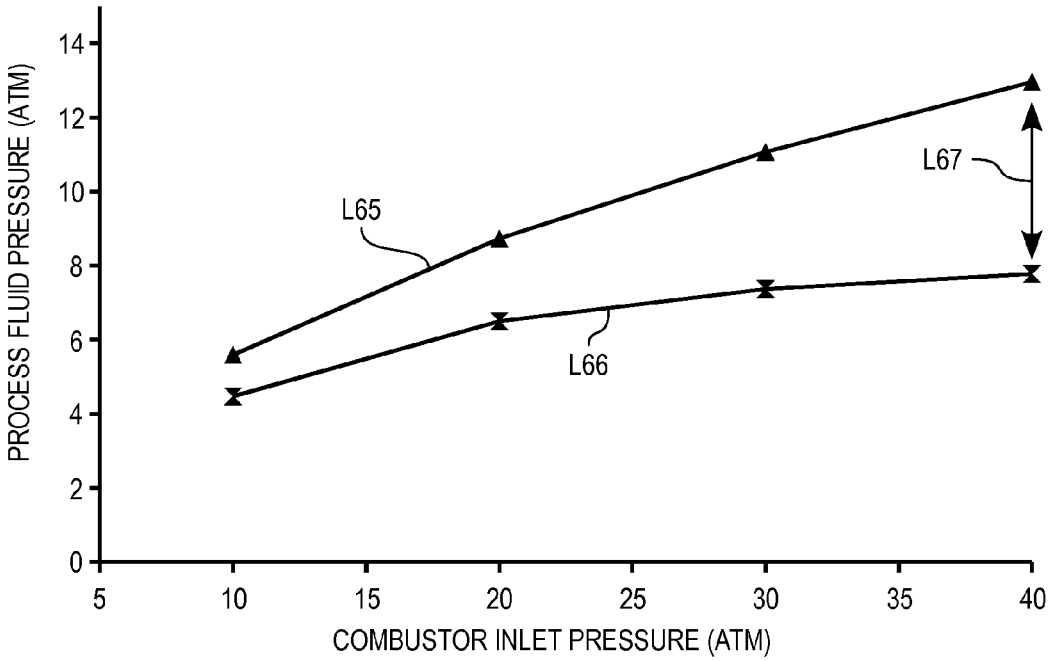
FIG. 19 illustrates the process fluid pressure for Brayton cycle vs. Direct VAST gas turbines, varying fuel with air at constant turbine inlet temperature and size.

FIG. 19 shows the resultant pressure for the delivered process fluid for the same model parameters, pressures and $CO_2$ concentrations as those shown in FIG. 18. In these direct GT configurations the energy to operate the compressor is provided by the fuel combusted and converted by the hot gas expander, the extra energy required to operate the compressor for the extra nitrogen lowers the delivered pressure for the Brayton GT configuration. This is especially so at higher pressures because of the higher relative energy requirement for compression at higher pressure. This results in a 67% higher delivery pressure line L67 for the Direct VAST GT line L65 above the direct Brayton GT line L66.

Figure 20:
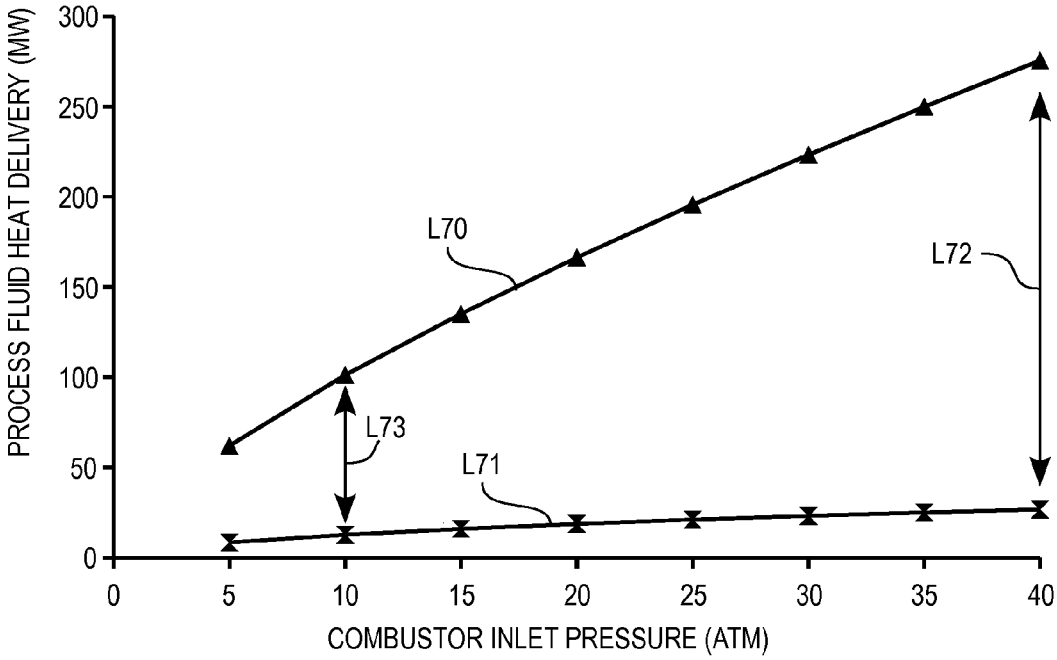
FIG. 20 illustrates the process fluid heat delivery for Brayton cycle vs. Direct VAST gas turbines, varying fuel with oxygen at constant turbine inlet temperature and size.

FIG. 20 shows a graph of the process heat delivered to the well head by a Direct VAST GT line L70 (up triangles) configured to combust NG with 99% $O_2$ (1% $H_2O$) versus a similarly configured Direct Brayton cycle GT Line L71 (double triangles). The simulations used similar parameters to those for FIG. 18. The fuel being burned and the water used to cool combustion was varied to maintain a Turbine Inlet Temperature of 1453° C. for the VAST GT. The fuel burned and cooled by surplus 99% oxygen was varied for the Brayton GT to maintain the same TIT.

Due to the high capacity of the cooling water used to cool the combustion and the extra fuel being burned, the amount of process heat produced by this configuration was increased about 930% line L72 for a VAST GT burning NG L70 in the presence of 99% oxygen as compared to that of the Brayton GT base case L71 at 40 atm. This compares with an increase line L72 of about 701% at 10 atm. The Direct VAST GT L70 VASTgas had 9.4 v % to 12.5 v % $CO_2$ compared with 4.4 v % to 6.0 v % $CO_2$ for the Direct Brayton GT process fluid L71.

Figure 21:
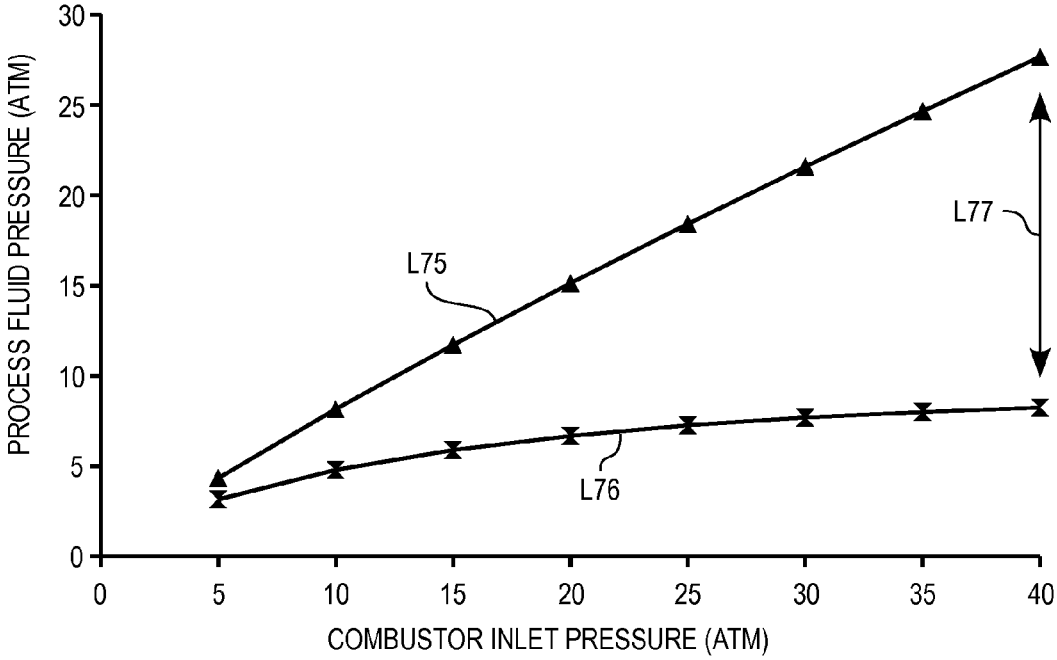
FIG. 21 illustrates the process fluid pressure for Brayton cycle vs. Direct VAST gas turbines, varying fuel with oxygen at constant temperature and size.

FIG. 21 shows the delivered pressure for the models those shown in FIG. 20. Because more fuel is burned in the case of the VAST GT and because of more efficient water cooling, the delivered process fluid pressure is much closer to the combustion pressure with the Direct VAST GT L75 (triangles) compared to the Direct Brayton GT line L76. e.g. 226% higher L77 for the Direct VAST GT L75 than the Direct Brayton GT L76 at 40 combustor inlet pressure using 99% oxygen as oxidant fluid.

Discussion of the Inventive Method

In the VAST cycle combustion examples modeled using Thermoflex, almost all of the heat produced by the combustion of the natural gas is present in the high water content VASTgas. Only a small percentage of the heat of combustion is lost to the system through conduction and gas leaks (typically less than 3% for a modern combustion system). This is in contrast to a boiler (or evaporator) system using dry combustion of natural gas to produce steam only. In such a system, a significant fraction of the heat (and all of the $CO_2$) is exhausted along with the exhaust gases (equivalent to VASTgas in a VAST cycle), which is typically lost to the atmosphere. As much as 20-25% of the heat is lost through this mechanism. Even if the temperature of the combustion is raised to material failure limits, substantial energy losses are incurred (as much as 10-20%) for water/fuel pressurization, fans or blowers to deliver the air and fuel to the combustion chamber and particularly because of residual heat in the exhaust gases.

In addition, all of the $CO_2$ that is a product of combustion and contained within the exhaust gases, is lost to the ambient air. Given the environmental concerns for the emission of greenhouse gases, injection of this $CO_2$ into the ground as a component of VASTgas may be perceived as a key advantage for this technology. If a portion of the injected $CO_2$ were to be re-emitted from the extracted bitumen as it was exposed to ambient pressure, it may be recaptured and recycled for further bitumen extraction using conventional $CO_2$ sequestration technology (e.g., refrigeration). This should provide a substantial environmental and marketing "plus" for this technology. This further increases the extraction efficiency of recovering heavy hydrocarbon. (i.e. increased revenue for each extraction well).

Given the known solubility of $CO_2$ in water and the water that would condense inside a heavy hydrocarbon formation during VASTgas injection, a portion of the $CO_2$ may be injected into the formation to sequester it by dissolving in the residual water and/or the water that condenses during the extraction process. This is particularly so at the end of life of a given well when the steam in the reservoir is allowed to cool and condense as water. Residual $CO_2$ left in the reservoir will tend to dissolve or be sequestered in the cooling water. The solubility of this $CO_2$ is further enhanced by the low temperatures and high pressures typical of such deep heavy hydrocarbon formations.

Another advantage of the use of high water to fuel ratios is that the air to fuel ratio may be very close to the stoichiometric ratio. Most high power density dry combustion systems including those used in typical large boiler systems so prevalent in the extraction of heavy hydrocarbons (whether turbine or otherwise) operate with significant surplus air; typically 2.0-5.0 times the stoichiometric ratio, i.e. $\lambda$=2.0-5.0, depending upon the desired combustion temperature. In those systems, the excess air functions as a coolant to prevent the combustion temperature from exceeding equipment failure or other limits. In high water ratio VAST cycle combustion, especially when liquid water is used, the water provides more effective cooling due to the relatively high heat capacity of water and also because of its high heat of vaporization.

Steam, while less effective for cooling than liquid water, still provides considerably more cooling capacity than air. The advantages of water or steam injection for the control of the combustion process are described in more detail, in U.S. application Ser. No. 10/763,057 (Hagen et al.). The use of high water ratio VAST cycle combustion VASTgas as a source gas for heavy hydrocarbon extraction provides the advantages of combustion temperature control, the presence of significant quantities of $CO_2$ in the VASTgas to enhance heavy hydrocarbon extraction efficiency and compositional control/flexibility in the amount of steam and $CO_2$ present in the VASTgas. For the example shown above (example 1), a higher combustion system outlet temperature may have been achieved if less water had been injected into the exhaust gas.

Another key advantage of the use of water to cool the combustion process is that the amount of surplus air that would otherwise be required to cool the combustion, may be reduced or minimized. E.g. The excess oxidant ratio may be controlled to less 50% of than that required for the Brayton cycle in some configurations. In other configurations, the excess oxidant ratio may be reduced to near stoichiometric combustion. e.g., lambda less than 1.5, or 1.2, or 1.1, or 1.05 in one or more configurations. This reduces the amount of energy required to compress the air (at the elevated pressures needed to inject process fluid into a heavy hydrocarbon formation) and reduces the amount of $N_2$/Ar in the final process fluid (VASTgas) flow. Any substitution of air with water will result in some improvement in both the amount of energy required to compress the air and a reduction in the amount of $N_2$/Ar in the final process fluid.

Using air to fuel ratios for combustion with water injection close to the "Cheng point", as described in U.S. Pat. No. 5,233,016 (Cheng), has been shown to offer some efficiency advantages for the generation of electrical power. In the case of the use any of the above-mentioned configurations to produce electrical power in addition to producing heated process fluid, such higher ratios may offer an advantage for electrical generation. However, it is likely that there would be an accompanying increase in the amount of energy lost to compress the air used in the combustion process, which would tend to reduce the attractiveness of this configuration.

Near stoichiometric combustion may be used in the delivery of VASTgas for heavy hydrocarbon extraction. In such configurations, most or all of the water used in the combustion process is delivered for extraction purposes. The use of the HHV (Higher Heating Value) for the fuel is therefore more appropriate than the LHV (Lower Heating Value) when calculating the amount of heat delivered to a formation from a given amount of fuel in a VAST wet cycle combustion delivering VASTgas to heavy hydrocarbons.

The presence of nitrogen/argon in the VASTgas (e.g., 38.5%, see table 1) should provide at least some of the benefits of the SAGP process (e.g., insulating the heated cavity, reducing heat losses to the over-burden or surrounding formations, and reducing the condensation of steam in the delivery path, as described in Jiang, Q., Butler, R. M., Yee, C. T., "Development of the Steam and Gas Push (SAGP) Process", GravDrain, Paper No. 1998.59, pp. 1-18, 1998 and U.S. Pat. No. 5,607,016 (Butler et al.). The reduction in condensation that is provided by lowering the steam fraction of the injected high temperature process fluid in the delivery system is particularly advantageous for deep well extraction or extensive laterally extended SAGD well extraction. In addition, the presence of 4.6% $CO_2$ in the VASTgas should promote dissolution of the gas in heavy hydrocarbons with a corresponding reduction in the viscosity of the resultant mobilized hydrocarbon solution, as described in U.S. Pat. No. 5,056,596 (McKay et al.). The high heat content of the VASTgas should allow relatively efficient transfer of heat to the hydrocarbon formation into which this VAST cycle VASTgas is being injected.

The Thermoflex modeling of the VAST wet cycle combustion described above in example 1, for a process fluid combustor outlet temperature of 482° C. and subsequent addition of more water to bring the VASTgas temperature down to 100° C., provides a large amount (>50%) of water in the form of steam in the VASTgas. Diluent water delivery may be controlled to control combustor outlet temperatures, and/or VASTgas delivery temperature. Combustion or VASTgas may be delivered at higher temperatures by reducing the water flow. This typically results in a lower concentration of water present in the combustion system and less water in the VASTgas unless more water is added after combustion but prior to injection into the hydrocarbon formation. A higher combustion temperature (e.g., 1035° C. as shown in FIG. 1, yields the same $CO_2$ content and heat content as long as the final temperature of the process gas delivered is kept constant at any given pressure (i.e. by adding the water after combustion instead of into the combustion chamber).

Increasing the pressure of VAST cycle combustion VASTgases prior to their delivery to the injection well is desirable to improve the efficiency of heat transfer between the VASTgases as they exit the combustion system and enter the hydrocarbon formation. This also improves the solubility of carbon dioxide in the heavy hydrocarbons, as described in Industrial Eng. Chem. Res., Vol. 30, no. 3, 1991, p. 552-556, (Deo et al.). This may be accomplished in several ways. One of these methods is gas turbine air compression (see examples 3 and 4 above). It is generally more efficient to compress air separately from liquid fuel and water prior to their injection into the combustion chamber. Liquids generally require less energy to compress than gases.

In order to pump VAST cycle VASTgases into a buried hydrocarbon formation, it is necessary to pressurize the gas. The solubility of $CO_2$ is enhanced at higher pressure (Deo et al.) and the overall extraction efficiency is known to increase with pressure up to a certain limit which depends on reservoir geological, compositional and other conditions. The use of pressurized air, water and fuel to perform a higher than atmospheric pressure VAST cycle combustion uses energy for fluid compression. A dry combustion boiler may produce high pressure steam with less additional compression work but with heat exchanger losses.

Figure 13:
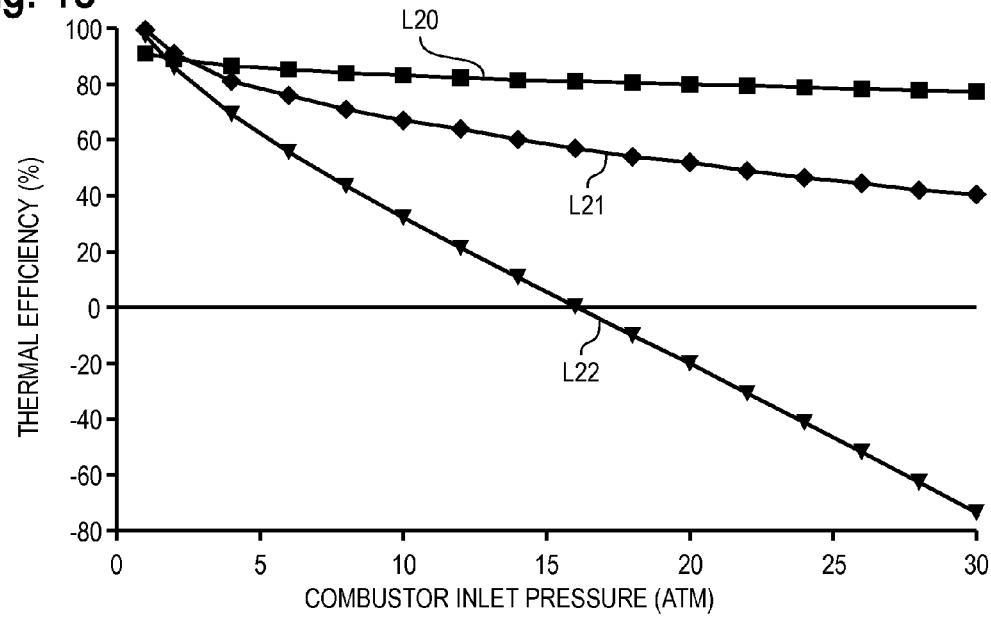
FIG. 13 illustrates the above ground system thermal efficiency of a VAST thermogenerator versus a boiler.

FIG. 13 line L21 (diamonds) shows thermoeconomic models of the relative overall efficiency for a VAST cycle burner versus combustor inlet pressure (atm) burning 0.45 kg/s (1.0 lb/s) natural gas using compressed air from an air turbine compressor, pressurized fuel and water from fuel and water pumps. The total thermal efficiency displayed includes fuel for electricity production for the compressors at 40% fuel to electricity efficiency. The atmospheric pressure point is taken from the example described in Table 1.

Line L20 (squares) shows the relative overall efficiency for dry combustion boilers (or evaporators) producing 100% steam at 100° C. (or higher at higher pressures to prevent condensation) assuming a dry combustion temperature of 1035° C. The air flow of the dry combustion comparison is modeled at 17.3 kg/s while the natural gas fuel flow is kept constant at 0.45 kg/s (1.0 lb/s) (equivalent to the wet combustion model). This fuel and air flow is equivalent to lambda $\lambda$=2.2. The exhaust (or flue) gas from the dry combustion is considered to be vented into the air and its heat content lost to the system. A higher lambda (more air cooling) and lower combustion efficiency would have been necessary to provide an equivalent combustion temperature to that of the wet combustion case.

For comparison, FIG. 13 line L22 (down triangles) shows the use of flue gas from dry combustion at 1035° C. with 1.9% CO2, with increasing combustor inlet pressure.

There is a more significant decline with pressure in overall thermal efficiency for the case of wet combustion as compared to dry combustion due to the energy losses. Wet combustion L21 and dry combustion L22 assume air compression with 40% fuel to electrical conversion efficiency. The cross-over point for relative system efficiency to the well head between the wet combustion model which includes a considerable amount of lost efficiency to compress the air used in combustion and a boiler Line L20 with dry combustion is at approximately 2.5 atm (~250 kPa). This "cross-over point" depends upon the assumptions used to calculate the amount of electrical power required for compression and the combustion temperature.

This 2.5 atm "cross-over point" may be considered a "worst-case" assumption for these configurations. The delivery of VAST cycle VASTgas for heavy hydrocarbon extraction at any pressure below 2.5 atm produces VASTgas with greater overall thermal efficiency. e.g., with mined heavy hydrocarbon resource. At pressures above 2.5 atm, a VAST cycle burner has lower overall thermal efficiency (for this assumed temperature of combustion) but still produces VASTgas containing substantial amounts of $CO_2$ (typically >4 v %). In addition, the VAST cycle VASTgas also contains non-combustible gas (e.g., $N_2$) which should contribute to insulation of the cavity from the overburden as is found for SAGP technology.

Figure 14:
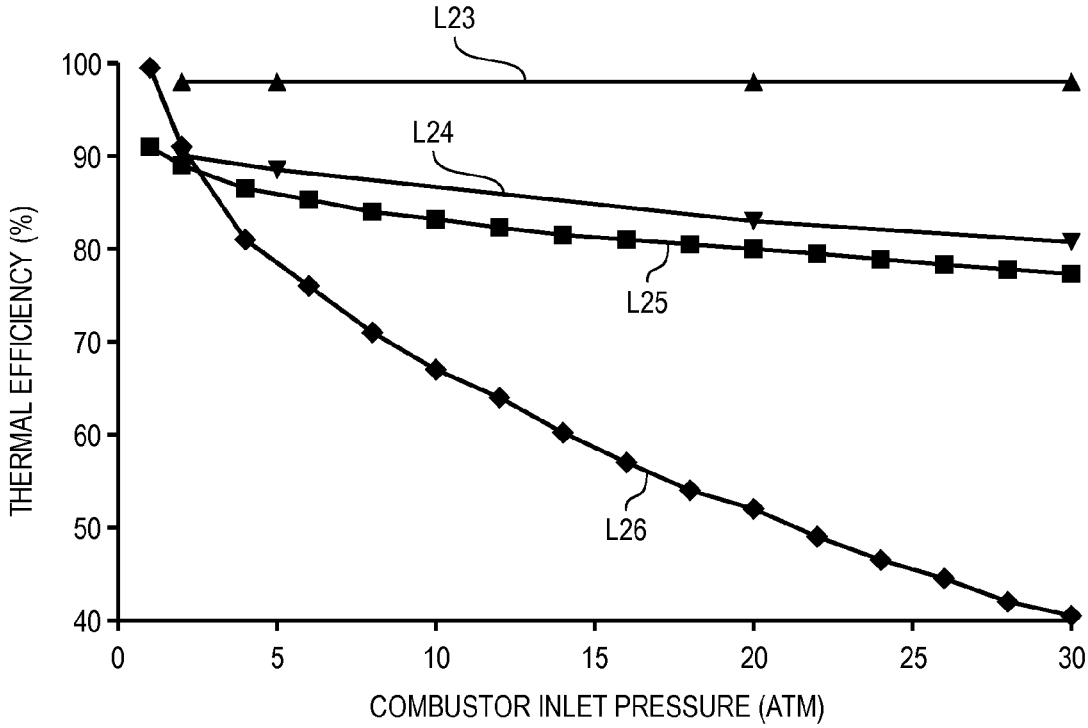
FIG. 14 illustrates the above ground system thermal efficiency of process VASTgas from a VAST Diverted Gas Turbine, a VAST Direct Gas Turbine, a boiler and a VAST Thermogenerator.

FIG. 14 compares the simulated system efficiency to the well head versus combustor inlet pressure (atm) for the boiler line L25 (squares) and VAST combustor VASTgas line L26 (diamonds) as shown in FIG. 13. Line L24 (down triangle) shows modeled data for VASTgas from a Diverted VAST GT. (See the configurations C2A and C2B of FIG. 2. Line L23 (up triangles) shows VASTgas from a Direct VAST GT. (See configurations C2C and C2D referring to FIG. 2. Note that the VASTgas from the Direct VAST GT has been expanded in a turbine and is therefore at a lower pressure (2-3 times lower). These configurations are for nominal combustion of 0.45 kg/s (1 lb/s) natural gas at 1035° C. with 4.6 v % $CO_2$ in VAST configurations compared to 0% in the boiler steam.

Figure 15:
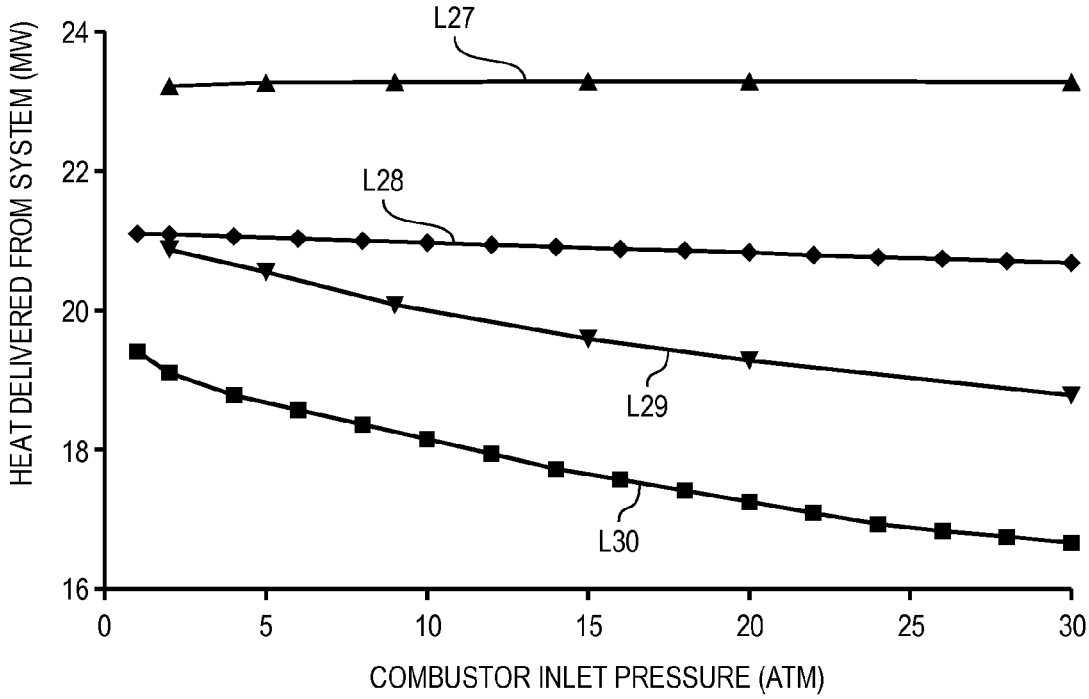
FIG. 15 illustrates the total heat delivered to the well head from a VAST Diverted Gas Turbine, a VAST Thermogenerator, a VAST Direct Gas Turbine and a boiler.

FIG. 15 compares the total heat (MW) delivered to the wellhead from differing configurations of combustion systems. This models VAST wet combustion line L28 (diamonds), dry combustion (boiler) line L30 (squares), a Diverted VAST cycle L29 (down triangles) and a Direct VAST cycle turbine exhaust (VAST GT) Line L27 (up triangles). The thermoeconomic model data shown in FIG. 15 used the same model parameters used to generate the data for FIG. 3 and FIG. 4. e.g., 0.45 kg/s (1.0 lb/s) of natural gas fuel flow for both, 1035° C. for the wet combustion temperature and 1035° C. for the dry combustion temperature. In line L27, the process fluid pressure is reduced 46-67% for air and 8-31% for O2 as shown in FIG. 4.

The heat delivered from the combustion system does not equate directly to the heat delivered to a heavy hydrocarbon formation. Losses in the delivery system, to the overburden and to the shaft upstream of the desired delivery location, must also be considered when considering the optimal conditions for extraction of hydrocarbons from a hydrocarbon containing formation. However, the starting point for these calculations is the amount of heat delivered from the combustion system.

With the same fuel flow, the overall heat delivered by VAST wet combustion configurations is greater than the amount of heat delivered by dry combustion for all of the pressures shown in FIG. 3 and FIG. 4. In the case of dry combustion, some heat (and steam and $CO_2$) is always lost in the exhaust. All of these combustion products that would otherwise be lost, are delivered to the formation through the use of wet combustion VASTgas. The heat delivered to a heavy hydrocarbon formation will depend on the depth of the formation and the porosity characteristics of the formation. However losses to the delivery system and in the well are expected to be lower in the case of the VASTgas because of lower levels of condensation due to the lower concentration of steam present in the VASTgas (i.e. 50-70% instead of 100% as in the case of a boiler).

Figure 16:
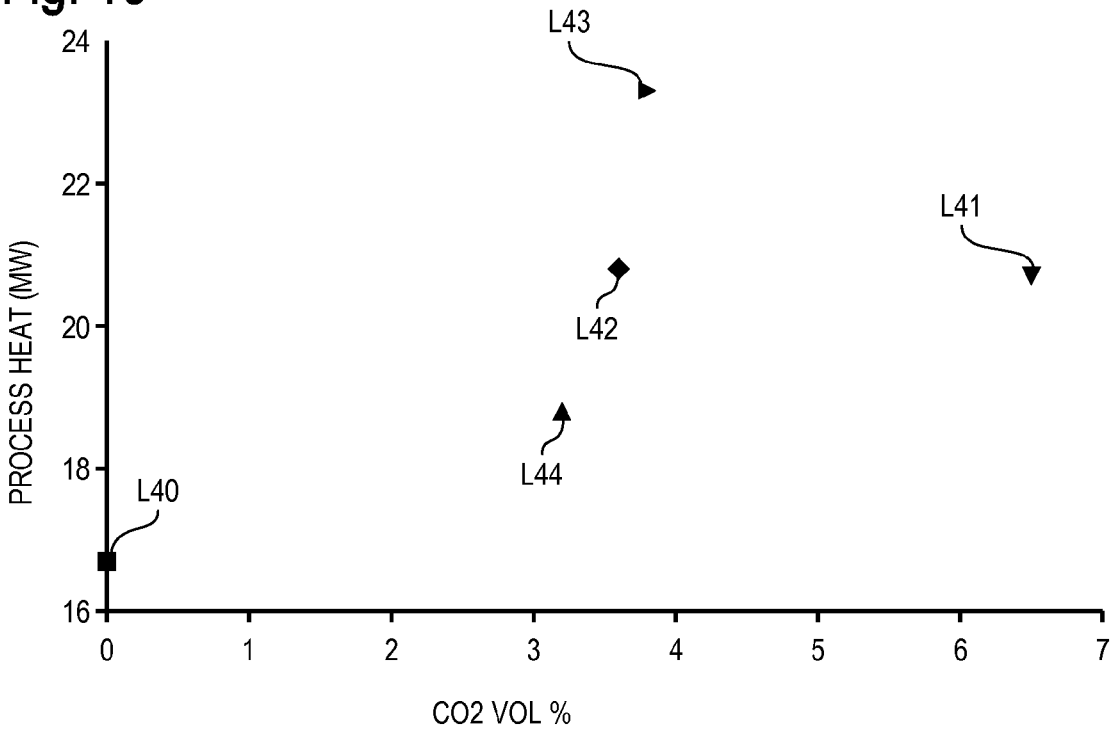
FIG. 16 illustrates process heat deliver to the well head at constant fuel flow versus $CO_2$ delivery for VAST configurations compared with a SAGD boiler.

FIG. 16 provides a summary of the amount of process heat (MW) to the well head and $CO_2$ vol % from combustion, delivered from the various combustion systems. L40 (square) shows a SAGD boiler, L42 a VAST combustor on natural gas, L44 (up triangle) a Diverted VAST GT on natural gas, L43 (right triangle) a Direct VAST GT on natural gas, L41 (down triangle) a VAST thermogenerator on coke. These use the compositions shown in Table 2.

The Y-axis of FIG. 16 shows the amount of process heat (MW) delivered to the well head from the configuration or system when 0.45 kg/s (1 lb/s) of natural gas (or coke) fuel is being combusted at a temperature of 1035° C. and 30 atm combustor inlet pressure. A higher process heat flow delivers more heat to the well head and is expected to give a higher rate of heavy hydrocarbon recovery.

A higher $CO_2$ content in the process flow is expected to both increase the rate of heavy hydrocarbon recovery and increase the potential maximum amount of recovery because of the substantial solubility of $CO_2$ in hydrocarbons. The use of VASTgases from NG combustion instead of pure steam raises the $CO_2$ level from zero to about 3-4 v % (depending on the amount of water added to the VASTgas and its temperature). See L42, L43 and L44. The burning of coke (L41) raises the $CO_2$ content to the 6-7 v % range. The burning of bitumen may be used to raise the $CO_2$ content to the 4-6 v % range because of the high carbon content of bitumen as compared to natural gas. VAST wet combustion has been shown to be stable over a wide range of fuels types and combustion conditions, e.g., U.S. application Ser. No. 10/763,057 (Hagen et al.). This configuration enables the use of raw bitumen as fuel.

Figure 17:
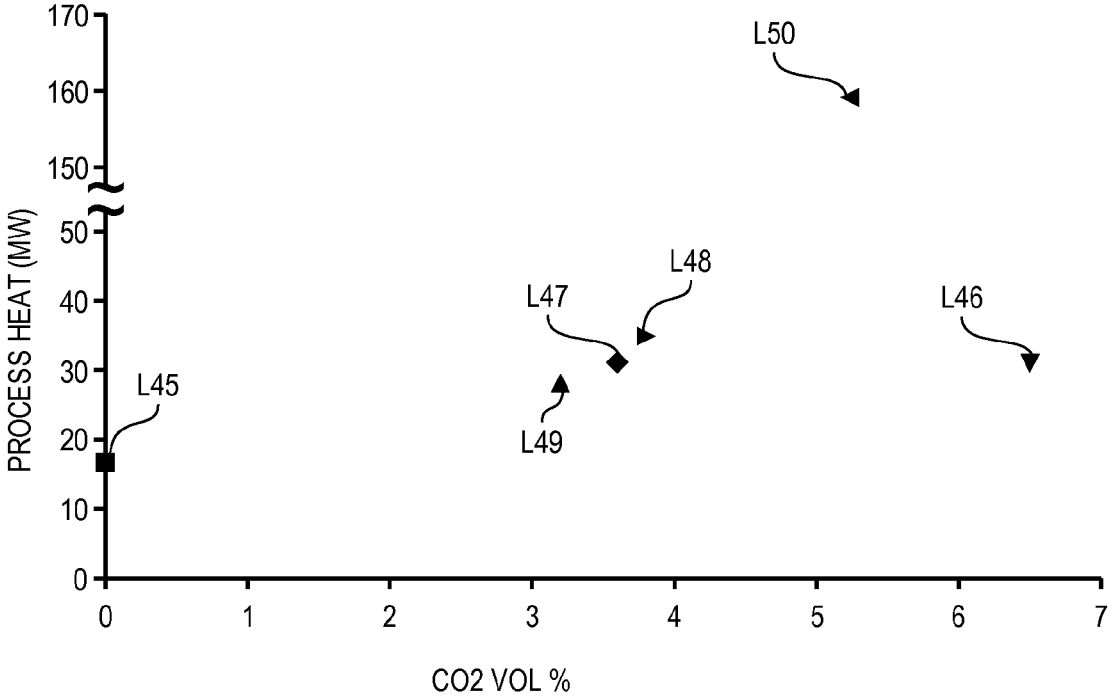
FIG. 17 illustrates $CO_2$ versus process heat delivery for VAST configurations compared with a SAGD boiler at constant combustor mass flow.

FIG. 17 provides a similar summary of the amount of process heat (MW) to the well head and $CO_2$ vol % from combustion with the fuel flow adjusted to provide constant mass flow at 1035° C. and 30 atm combustor inlet pressure, delivered from the various combustion systems. VAST configurations are modeled for lambda=1.05. L45 (square) shows a SAGD boiler, L47 (diamond) a VAST thermogenerator on natural gas, L49 (up triangle) a Diverted VAST GT on natural gas, L48 (right triangle) a Direct VAST GT on natural gas, L46 (down triangle) a VAST thermogenerator on coke. Contrasting these is configuration L50 (left triangle) showing Direct VAST GT on natural gas with 99% $O_2$. This gives about a five fold increase in heat delivery as well as higher $CO_2$ concentration. These use the compositions shown in Table 2.

Another of the current environmental and cost issues that is associated with SAGD (or SAGP) hydrocarbon extraction, that is ameliorated or improved by the use of wet combustion and the aforementioned methods, is the use of large steam pipes occupying large areas and losing considerable amounts of heat to the air. These pipes require expensive insulation (especially in the winter), are costly and force the destruction of a great deal of the natural landscape in order to route them from the typically used large boilers to the wells used for injection.

Wet combustion with $CO_2$ injection reduces the requirement for large central high pressure boilers and steam pipes to individual wells because lower pressure may be used with the enhanced extraction rate of the $CO_2$-containing VASTgas. Burning bitumen extracted in place has an additional advantage, especially if the water for combustion may be pumped out of surface waters or out of the ground (or from waste water used in mined or other bitumen extraction). The use of an in situ fuel source further reduces the need for piping and disturbance of the landscape. Smaller, local or even portable wet combustors or VAST GTs at lower pressure may be used with each well pair. Some configurations may use a VAST GT per closely spaced group of wells. This results in lower heat transmission losses and a reduced requirement for expensive steam pressure piping.

The concentration and partial pressure of $CO_2$ in VASTgas may be increased to increase the dissolution rate of $CO_2$ in heavy hydrocarbons, thereby decreasing its viscosity and increasing its mobility. This may be used to reduce the heat required to mobilize the heavy hydrocarbons by a given amount or alternatively. It may be used to increase the overall extraction efficiency from a given formation.

There are several methods and sources from which to introduce additional $CO_2$ into a gas stream. One of these methods is the utilization of high carbon content fuel (e.g., coke, coal or bitumen) for the combustion process (see Table 1). Coke is one of the byproducts of bitumen upgrading to synthetic crude oil which is available in large quantities in Canada's oil sand regions. Another of these methods is the reaction of acid (particularly sulfuric acid, $H_2SO_4$) with limestone, $CaCO_3$ (or other carbonate salt), according to the following (generalized) reaction:

$$CaCO_3(s)+H_2SO_4(g \text{ or } aq)\text{==>}H_2O(g \text{ or } l)+CaSO_4(s)+CO_2(g) \quad \text{Eq. 1}$$

The states shown in Eq. 1 are generalized. In some configurations the limestone for the reaction with $H_2SO_4$ or $SO_3$ may be delivered as a powdered lime/water slurry injected into a VAST cycle wet combustion chamber. The water of the lime slurry may serve as the water to maintain the combustion temperature of the wet combustion and water for the reaction of $SO_3$ if the reaction were conducted in the gaseous state. The $CO_2$ product of that reaction in an aqueous solution would have an equilibrium concentration of dissolved carbonate ions.

In a combustion reaction without liquid water to dissolve in, all of the $CO_2$ produced from the limestone would be in the gaseous state for injection into the heavy hydrocarbon formation. Additional water may be added to a wet combustion reaction without lowering the combustion temperature if some of the water is reacting with sulfur combustion reaction products and producing additional heat of reaction.

The other product of the reaction of $SO_2$ or $SO_3$ with limestone would comprise calcium sulfite or sulfate salts (Eq. 1), or such additional reaction products as calcium oxide (lime) or calcium hydroxide. Such calcium salts, when formed by reaction in a combustion chamber or downstream of a combustion chamber may be separated from the combustion gases by high performance cyclones. Such separation may be accomplished by electrostatic precipitators. In some configurations, a major portion of the calcium salts may be precipitated, leaving a portion of the calcium salts to be delivered to the heavy hydrocarbon materials with the rest of the combustion gases.

In a pressurized configuration such as a gas turbine, or a wet combustor using pressurized oxidant to pressurize the combustion reaction, a pressurized extractor may be used to withdraw calcium salts created by the acid/limestone reaction (Eq. 1). Such pressurized extractors include for example, screw extractors and lock hoppers. The residual pressurized combustion gases may then be delivered to heavy hydrocarbon material located in an underground geological formation or in a pressurized or unpressurized heavy hydrocarbon (e.g., bitumen) separation vessel.

The production of sulfuric acid may be accomplished through the combustion of elemental sulfur, of which there is such an abundance in Western Canada, according to the following (generalized) reactions:

$$S(s)+O_2(g)\text{==>}SO_2(g) \text{ (heat of combustion=4.6 MJ/kg of S)} \quad \text{Eq. 2}$$

$$SO_2(g)+\tfrac{1}{2}O_2(g)\text{==>}SO_3(g) \text{ (heat of combustion~1.5 MJ/kg of S)} \quad \text{Eq. 3}$$

$$SO_3(g)+H_2O(g)\text{==>}H_2SO_4(g) \text{ (heat of reaction ~1.1 MJ/kg of S)} \quad \text{Eq. 4}$$

$$H_2SO_4(g)+2H_2O(l)\text{==>}SO_4^{2-}(aq)+2H_3O^+(aq) \text{ (heat of hydration=27.5 MJ/kg)} \quad \text{Eq. 5}$$

Mixing coke (~20 MJ/kg) or another high BTU content fuel (e.g., bitumen, or natural gas) with sulfur(S) is a method to increase the combustion temperature of the relatively low heat content sulfur. However, the subsequent reactions of $SO_2$ and $SO_3$ with water to form sulfurous acid or sulphuric acid respectively, in solution, are also highly exothermic. Finally, the reaction of sulfuric acid with limestone to form $CO_2$ and CaSO4 (or the reaction of sulfurous acid with limestone to form $CO_2$ and CaSO3) is also exothermic (Eq. 1). All of these reactions may occur to some degree and increase the heat content of the overall wet combustion reaction more than coke or NG alone.

The production of excess $CO_2$ by this reaction would also contribute significantly to the enhancement of heavy hydrocarbon production as described previously. A byproduct of the overall reaction, $CaSO_{4(s)}$ (in its crystalline form known as gypsum, $CaSO_4.2H_2O_{(s)}$) may also be used for other purposes, such as cement production or in the consolidation of wastewater tailings for conventional surface mined bitumen production. The combustion of solid sulfur to form $SO_2$ and then $SO_3$, its subsequent reaction with water and then limestone in aqueous solution or a water slurry to form $CO_2$ and $CaSO_4.2H_2O_{(s)}$ produces considerable amounts of heat (total reaction energy for Eq. 2-5 and Eq. 1, =56.25 MJ/kg of S).

An alternative to the use of elemental sulfur to produce additional $CO_2$ in the reaction with limestone, is the combustion of high sulfur fuels such as bitumen (typically ~4.8% sulfur content) or "sour gas" which may contain high quantities of $H_2S$ (as much as 50% or more). The total free reaction energy liberated by the combustion of $H_2S$ to $SO_2$ and $SO_3$ and its subsequent reaction with limestone is greater than 56.25 MJ/kg of S.

Configurations may inject a lime/water slurry to react the acidic gases produced by the combustion of such high sulfur fuels to produce additional $CO_2$ in a wet combustion cycle. This may be accomplished within a combustor without downstream turbine blades, which reduces the potential for corrosion. Some configurations may perform such combustion at a temperature above the condensation temperature of acids. This may reduce the corrosion rates of a combustor or gas turbine.

The oxidation of elemental sulfur or $H_2S$ forms higher portions of $SO_2$ in low temperature combustion reactions or with insufficient oxygen to facilitate the oxidation of $SO_2$. The subsequent oxidation of $SO_2$ to form $SO_3$ has been performed successfully for many years in the commercial production of sulfuric acid. The reaction may be conducted using a vanadium catalyst. The reaction temperature may be typically above 800° C., such as in the range of 900° C. to 1150° C., or in the temperature range between 1000° C. and 1050° C. The reaction may be conducted in the presence of surplus oxygen. It is also further facilitated by the relatively long residence times which are prevalent in wet combustion systems.

In some configurations, high levels of $SO_3$ may be produced by reacting fuels containing S (Eq. 3 above). This beneficially increases the amount of reaction heat and the reactivity of the subsequent acid/carbonate salt reaction. In some configurations, the sulfur may be partially oxidized to provide $SO_2$ reaction with water and a carbonate salt to produce sulfite salts (instead of sulphate salts). Such configurations may be used where low levels of corrosion are desired and for low temperature VASTgas production. e.g., Sulfurous acid may be formed as it is a weaker acid than sulfuric acid and is therefore less corrosive for metal components.

The above-mentioned method describes a multi-step exothermic chemical process to utilize the combustion or reaction energy of generally available low cost elemental sulfur or sulfur compounds and their reaction products with carbonate salts (especially limestone) to produce heat, $CO_2$ and sulphate or sulfite salts. The $CO_2$ and heat produced by these reactions are then used to increase the thermoeconomic extraction efficiency of heavy hydrocarbons when the combustion products are delivered or injected into heavy hydrocarbon materials.

Figure 22:
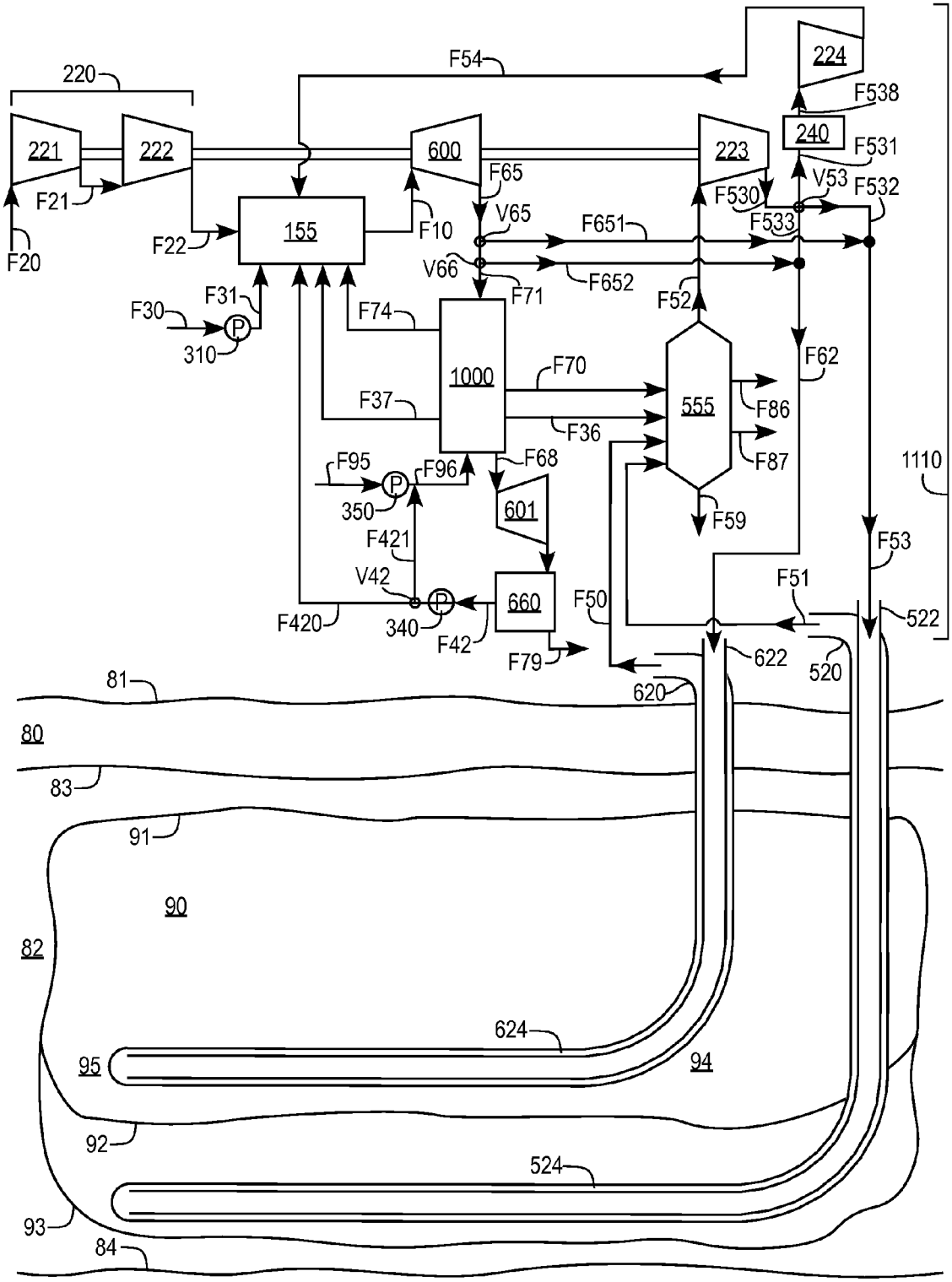
FIG. 22 schematically illustrates a Direct VAST Combined Heat & Power Recovery System with $CO_2$ recycle.

This general concept may be extended to subsurface mining and extraction processes for heavy hydrocarbons as shown schematically in FIG. 22. This in situ process may be given the acronym "S.O.I.L.C.A.P." for "Sulfur Oxide Injection into Limestone for Carbon dioxide Assisted Push". Hot VASTgas with SO2 and/or SO2 may be delivered into injection well 620 and/or production well 520 into heavy hydrocarbon resource 82 near limestone 84. $CO_2$ and heat from reaction of sulfur oxides with limestone heats and mobilizes the hydrocarbon to the production well 520.

In FIG. 22, VASTgas may be delivered through the injection well. (e.g., with W/F>1:1). This fluid injection may be generalized to include gases containing lower amounts of $CO_2$ and water than is common for wet combustion. This is especially so if there are substantial amounts of liquid water already present near the bottom of the injection well 524 and if the acid/limestone reaction is capable of providing a substantial portion of the $CO_2$ required for the mobilization of heavy hydrocarbons.

The SOILCAP method may be utilized to increase the EROEI of heavy hydrocarbons and especially for those whose EROEI is currently too low for commercial extraction according to the method outlined below. In comparison to the SAGD process, most of the reaction heat provided by the acid/limestone reaction in the SOILCAP process may be considered as a reduction in the amount of combustion energy required. This is because the heat generated by the acid/limestone reaction may be considered to substitute for the energy normally required to heat water to form steam in a SAGD (or SAGP) process. This acid/limestone reaction energy is in addition to the EROEI benefit associated with the solvation of $CO_2$.

Many oil sand deposits, especially those in Western Canada, are located in areas of limestone bedrock. Such bedrock is also commonly associated or in the vicinity of significant quantities of liquid or absorbed water. A well may be drilled into the upper layers of this limestone bedrock in areas underlying or in the vicinity of bitumen containing oil sand. In some configurations, this may be a horizontal well approximately parallel to the limestone/sand boundary layer.

Such a well may be used to permit access to the sub-surface limestone for injected gases or liquids. Combustion gases (e.g., VASTgas) produced in a combustor may be injected into such a well drilled into the upper layers of such limestone bedrock. These may have a high water to fuel ratio and containing significant quantities of sulfur oxides and steam. (e.g., greater than 1:1 by mass, and may be greater than 4:1 by mass to allow a lowering of the $\lambda$ value).

The condensation of steam associated with the combustion gases or the reaction of sulfur oxides with water already present in the vicinity of the upper layers of the limestone, would facilitate the reaction of such sulfur oxides with the limestone to produce heat, $CO_2$ and sulfate salts inside the well (acid/limestone reaction). Given the relatively high heat of reaction for the reaction of the acid/limestone reaction, such an in situ reaction would provide the potential for high heat transfer to the areas close to the injection well and the production of significant quantities of $CO_2$ pressurized by the release of gas from limestone.

When such high heat content and pressurized $CO_2$ is released in the vicinity of bitumen (or other heavy hydrocarbon) containing oil sand, the bitumen may be mobilized by significant reductions in its viscosity which would accompany their heating and salvation by $CO_2$ (similar to the process described in the sections above for VASTgas injection into such buried heavy hydrocarbon formations).

An extraction well or wells drilled in the vicinity of the injection well may be used to access and extract this mobilized bitumen using conventional pump technology, in a similar manner to the extraction well drilled for the extraction of mobilized bitumen in the SAGD or SAGP processes. Such an extraction well or wells may be located at a lateral or vertical distance from the injection well so as to facilitate efficient removal of the bitumen extracted by the heated $CO_2$ from the acid/limestone reaction described above.

Given the relatively high heat of reaction for the acid/limestone reaction and potential for high pressures exerted by the $CO_2$ being released by this reaction, some configurations may control the $CO_2$ delivery pressure to form a "live" bitumen to facilitate its production from the production well by the "lift" caused by the $CO_2$. This may reduce the pumping energy required to produce the bitumen.

The use of the above-mentioned multi-step sulfur reaction method to increase the heat energy and $CO_2$ available for bitumen extraction may allow a combination of the use of VASTgas generated using the various methods described above with said acid/limestone reaction. As the amount of limestone available for reaction in the vicinity of proximate bitumen and the amount of unextracted bitumen changes during the course of an extraction process, the percentage and flow rates of injected sulfur-containing gases and/or VASTgas temperature and pressures may be altered to maximize extraction rates or extraction efficiency.

For example, the initial phase of extraction for the bitumen may be characterized by a high rate of sulfur oxide injection and acid/limestone reaction. However, after this initial phase and after the depletion of proximate bitumen, a decrease in the amount and/or percentage of sulfur oxide delivered may be affected while at the same time increasing the pressure and/or temperature and/or concentration of $CO_2$ in the process fluid delivered to the extraction site through the injection well.

The number and location of injection and extraction wells may be varied to optimize the overall efficiency and rate of bitumen extraction as well as to compensate for local variations in oil sand porosity and limestone permeability as well as the amount of sulfur oxides and injected $CO_2$ delivered. With low concentrations of bitumen in the oil sand, lesser amounts of $CO_2$ may be used (both injected and generated in situ by the acid/limestone reaction). In some configurations, high levels of $CO_2$ may be utilized to increase the rate of extraction from a low concentration bitumen formation or residual bitumen after a portion of bitumen has been extracted.

Further referring to FIG. 22., an alternative two (or more) step SOILCAP method may be used. Here the limestone used in the acid/limestone reaction may be delivered to the oil sand or to a cavity or well 620 drilled into the oil sand or hydrocarbon resource 82, prior to the injection of sulfur oxide containing gases. This method may be beneficial where bitumen is not immediately proximate to limestone bedrock. This multi-step SOILCAP method may improve extraction efficiency by providing for independent control of the amount of limestone and sulfur oxide gases.

In this configuration, the amount of limestone delivered during a "charging phase" (initial injection of limestone or like carbonate material) through the injection well (or nearby limestone injection well) may be adjusted independently of the amount of sulfur oxides delivered through the same (or nearby) injection well at a later time. It should also be possible to alternate injection of limestone with injection of sulfur oxides. In one configuration, powdered limestone slurry may be injected through one horizontal injection well into oil sand.

In some configurations, delivery of limestone may be coupled by injecting sulfur oxide containing gases into an adjacent horizontal well drilled into the oil sand. This may be mixed with steam and $CO_2$ from a wet combustion process. The pressure and temperature of the sulfur oxide containing gases in the second well may be controlled sufficient to break through to the first horizontal well containing the powdered limestone slurry. This may be used to facilitate the acid/limestone reaction. That reaction may be maintained by subsequent further injection of limestone slurry and sulfur oxide gases into the two respective wells.

Another method for two step injection of limestone slurry and sulfur oxide containing gases may be the drilling of a two (or more) shaft well with deliberate cross-over or overlap between each well. This may be used to provide a greater volume for the subsequent injection and reaction of a limestone slurry and sulfur oxide gases. This arrangement is somewhat similar to that mentioned above (example 8) for the facilitation of the acid/limestone reaction in bitumen separation vessels containing mined oil sand. In the case of the sub-surface process with overlapping or cross-over wells drilled to facilitate the reaction, limestone may be injected into lower lying well(s) and sulfur oxide gases injected into an upper well(s).

In another well arrangement to facilitate the acid/limestone reaction may involve a long horizontal well or overlapping wells (to increase the volume available for limestone slurry injection and reaction). This horizontal well may be penetrated by either vertical or horizontal wells drilled to the allow injection of sulfur oxide containing gases to contact and react with the limestone slurry.

The injection of limestone slurry and sulfur oxide containing gases at a rate sufficient to create heat and $CO_2$ and mobilize proximate bitumen may be accomplished in a continuous process by the injection of powdered limestone slurry in one well, while sulfur oxide containing gases may be injected into other injection wells. In one configuration, the limestone slurry may be injected into the lower well with the sulfur oxide gases injected into the upper injection well.

One possible limitation of such a continuous process may be the accumulation of calcium sulfate or sulfite salts as a product of the acid/limestone reaction in and around the reaction sites. One method of circumventing this limitation may be drilling of additional wells overlapping or crossing-over the injection wells for sulfur oxide gases for further limestone injection or alternatively, the injection of water and $CO_2$-containing gases into the original limestone slurry injection wells under pressure to dissolve the sulfate (or sulfite) salts and move them into the surrounding heavy hydrocarbon containing oil sand.

A potential restriction on the amount of limestone that may be reacted with acid or sulfur oxide containing gases in either of the SOILCAP methods described above is the accumulation of sulfate or sulfite salts on the surface of the limestone particles as the reaction proceeds. Such reaction limitations are often encountered during pressurization processes for coal exhaust. However, the higher solubility of calcium sulfate (or sulfite) salts as compared to carbonate salts may allow such sulfate passivation to be reduced when the reaction occurs in aqueous solution.

The solubility of $CaSO_4$ in water at 25° C. is 0.24 g/l (small but significant) while that of $CaCO_3$ is very low at 0.01 g/l at 25° C. (Handbook of Chemistry and Physics, Chemical Rubber Company, $75^{th}$ Edition, 1977-1978). Therefore, as these sulfate salts are created by the acid/limestone reaction in aqueous solution, they will tend to dissolve and allow for a new limestone surface ready for reaction with more acid.

The above-mentioned method may also be accomplished in the gas phase through the injection of high temperature sulfur oxide gases with small limestone particles suspended in the gas phase. Such a mixture may be injected directly and continuously into an injection well drilled into the target oil sand. The sulfur oxide reaction with limestone would then occur continuously during the passage of the reaction gases through to the target bitumen (or other heavy hydrocarbon) location. The reaction would therefore produce more $CO_2$ and heat during the time of passage, further facilitating the mobilization of heavy hydrocarbons at the target site.

The use of wet combustion VASTgases for hydrocarbon extraction does not preclude the possibility of the use of additional VASTgas for electricity and clean water production. Such additional VASTgas may be produced within the same system. The thermoeconomic modeling considered above assumes the use of electricity produced at 40% thermal efficiency. A high pressure gas turbine system with excess capacity may be used to divert excess high pressure VASTgas to heavy hydrocarbon extraction instead of driving a power turbine.

The modification of a Brayton cycle to a VAST wet cycle, e.g., as in U.S. application Ser. No. 10/763,057 (Hagen et al.), produces considerable additional capacity because of the additional cooling capacity of water as compared to air and as the resultant possibility of using additional fuel to increase the overall heat produced by a given combustion system. This additional capacity may be used to provide additional VASTgas which may be used for heavy hydrocarbon extraction in addition to the production of electricity and/or clean water. Clean water may be condensed as a by-product of the wet combustion of hydrocarbons. Such combustion may easily produce 3 times as much clean water as dry combustion of a similar amount of fuel.

The above-mentioned inventive method for an increase in the extraction rate or efficiency for mined bitumen material may be generalized to other heavy hydrocarbons such as shale oil. The hydrocarbon material in shale oil is known as kerogen. Most previous attempts to extract kerogen from shale oil have been energy consuming, i.e. they use more energy than is extractable from the kerogen (i.e. EROEI <1.0). However, the inventive methods discussed for bitumen extraction from mined material or for bitumen extraction using injection of VASTgas into buried formations of oil sand containing bitumen, may be extended to shale oil and other heavy hydrocarbons. The $CO_2$ produced from combustion will also dissolve in kerogen and reduce its viscosity in a similar manner to the bitumen in oil sand, since $CO_2$ is an excellent solvent for hydrocarbons in general.

In addition, the processing of mined oil shale with combustion gases in a separation vessel may use a similar method to that described above for mined oil sand. It is expected that such a method would also significantly reduce the energy requirements for the processing of the shale oil because of the high thermal efficiency and high specific power of the VAST wet combustion methods described above. Finally, the injection of sulfur, phosphorus or nitrogen oxides into a separation vessel containing water, shale oil and limestone would also deliver additional heat to drive the extraction process, thereby reducing the heating requirements which would otherwise have to be delivered by higher quality fuels.

The use of RF (including microwave) excitation for in situ delivery of energy to hydrocarbon formations is known in the art. However, the use of such techniques to heat the VASTgases of high water to fuel ratio combustion offers additional advantages. The water content of the VAST cycle VASTgases described in Table 1 is >50% and the $CO_2$ content of the VASTgases is >4%. Microwave excitation of such VASTgases may be tuned to the specific absorption wavelengths of $CO_2$ and/or water and the composition of the VASTgases adjusted to deliver maximal effect at a given location. Microwave excitation may be directionally specific. In addition, even though microwave excitation of steam containing gases is relatively inefficient, the microwave generator may be placed in the VASTgas stream to cool the microwave generator and to transfer the heat generated in the microwave generator to the VASTgas or flue gas.

This "energy loss" is then used to contribute to the deliver of heat to the heavy hydrocarbon formation. Providing for such excitation to occur down a well inside a heavy hydrocarbon formation with an insulating layer of gas between the formation and the overburden (e.g., $N_2$/Ar) may allow for reductions in the temperature of the delivered gas with additional energy delivered at or near the formation in question to raise the temperature of formation to a chosen target temperature.

This method has the potential to extend the depth from which heavy hydrocarbons may be extracted. Deep wells may result in significant losses of heat from pure steam (less so from VASTgas compared at a given temperature and pressure because of the reduced relative concentration of steam) to the walls of the injection well or to the overburden. Using a reduced temperature VASTgas (or pure steam) with additional thermal content added by a microwave emitter (or even a resistive heater) localized near the bottom of the well may reduce these energy losses to the walls of the pipes delivering the gases to the heavy hydrocarbons in question contributing to an overall improvement in the EROEI. This should permit more economical extraction of heavy hydrocarbons from deeper formations over relevant art.

The use of steam as a major constituent of the VASTgas delivered to the heavy hydrocarbon formation, allows the use of microwave radiation tuned to the frequency of water which has broad microwave absorption bands, as described in Radio Science, volume 33, number 4, pp. 919-928, July-August 1998, (Rosenkranz). Such microwave emitters are readily available and relatively inexpensive because of the use of this technology in microwave ovens and similar devices.

Adjusting the frequency and direction of microwave emission for heating of VASTgas may provide additional flexibility and control of the extraction process. Compositional control of the VASTgas (i.e., changing the water/fuel ratio and the corresponding amount of water in the VASTgas) may also be combined with microwave frequency/direction changes during the extraction process for heavy hydrocarbons. Specifically, changing the frequency of the microwave excitation away from the absorption bands of water or $CO_2$ may be used to increase the penetration depth of the radiation into a formation saturated with water or $CO_2$.

The use of frequencies tuned to the peak of the absorption bands may be used for the initial phase of heavy hydrocarbon extraction from a formation when the concentration of extractable material is high. As the heavy hydrocarbons are heated and extracted, the excitation frequencies may be tuned away from the water or $CO_2$ absorption bands and directed to hydrocarbon frequencies to extend further into the formation and/or to improve the total quantity of heavy hydrocarbon extracted.

In another configuration, resistive heating may be used to increase the heat content of the process fluid. e.g, by heating the process fluid with a resistor in the vicinity of a targeted heavy hydrocarbon formation. This may enhance recovery rates especially for deep formations. Although this method does not offer the directionality or deep penetration potential of microwave excitation, it may be easier to implement. Although both of these methods may be used for excitation of process fluids produced by other methods, the presence of high amounts of water vapor in the VASTgas and the compositional control of the process fluid may offer superior efficiency for the application of this technology to in situ heavy hydrocarbon heating.

The overall effect of all of the above mentioned processes is to reduce the economic and environmental cost for the recovery of heavy hydrocarbons. Specifically, the amount of heat and fuel required to extract any given heavy hydrocarbon is reduced. Also, the total amount of heavy hydrocarbons that may be extracted from any given formation is also increased. Finally, marginal or difficult to extract heavy hydrocarbons, such as shale oil, will have their EROEI increased. It is quite likely that such processes may allow many types of heavy hydrocarbon extraction to become economically (and environmentally) viable with EROEIs substantially greater than 1.0.

Efficient Steam and $CO_2$ Recycle

Combined Heat and Power Recovery System: With reference to FIG. 22, in one embodiment, a combined heat and power (CHP) recovery system 1100 may be configured to deliver energetic fluid F62 to help recovery of heavy hydrocarbons, and to recover and recycle a portion F50 of the delivered fluid. In one configuration, an oxidant containing fluid F20 is compressed by a compressor 220 to deliver a compressed oxidant fluid F22 to the combustor 155. e.g., oxidant fluid F20 may comprise air, oxygen enriched air, and/or oxygen. A fuel containing fluid F30 may be pressurized by a pressurizer, compressor or pump 310 and delivered to the combustor 155 and combusted with oxidant fluid F22 to form products of combustion. Diluent fluid comprising diluent F420 may be mixed with products of combustion upstream of the combustor outlet to form an energetic fluid F10.

Expansion and power: Referring to FIG. 22, the energetic fluid F10 from the combustor 155 may be expanded through an expander 600 to provide the power to drive the compressor 220 and form expanded fluid F65. In some configurations, one or more shafts and/or generators are provided as desired to drive further compressors, pumps, control one or more components, and/or deliver electricity or mechanical power. E.g., to power a recycle compressor 223.

Injection-production Wells: With further reference to FIG. 22, in one embodiment, a delivery or injection well 620 and a recovery or production well 520 are provided to penetrate the surface 81 through an overburden 80 into a geological hydrocarbon resource 82. The production well 520 may be placed close to the bottom of the hydrocarbon resource 84. The injection well 620 may be generally parallel to and some distance about vertically above the production well 520 and below the top 83 of the hydrocarbon resource.

Injection Tube: An injection tube 622 may be provided within the injection well 620. A portion of the energetic fluid F18 may be delivered as an injection fluid F62 through the injection tube 622 from its inlet through the "heel" end 94 to near the "toe" end 95 of the injection well 620. An injection annulus 624 formed between the injection well 620 and the injection tube 622 provides a return path for the injection fluid F62, forming a recovered fluid F50 recovered from the injection well 620. The injection well 620 perforated outer wall or well casing to provide passages for a portion of the injection fluid F62 to flow into the surrounding resource 82.

Drive Tube: A drive tube 522 may be provided within the production well 520. A portion of the energetic fluid F18 may be delivered as a drive fluid F53 from the inlet "heel" to near the "toe" end of the production well 520. A production annulus 524 formed between the production well 520 and the drive tube 522 provides a return path for the drive fluid F53 and/or for mobilized hydrocarbon fluid. The production well 520 generally has a perforated or slotted well casing to provide passages for the drive fluid F53 to flow into the surrounding hydrocarbon resource and/or for mobilized hydrocarbon fluid to flow into the production annulus 524. The drive fluid may be used to provide gas lift to help produce a hydrocarbon containing fluid F51 from the production well 520 using the drive fluid. Artificial lift may also be used.

Expanded fluid distribution: Expanded fluid F65 may be distributed between an injection portion F652 to the injection tube 622, a drive portion F651 to drive tube 522, and/or a portion F71 to heat recovery system 1000. This expansion fluid distribution may be controlled by one or more valves schematically shown as V65 and V66. This expansion distribution may be controlled by equivalent valves located at the outlets of the injection well 620 and production well 520. This distribution may be controlled by one or more expanders or compressors regulating flows F50 and/or F51. (Not shown.)

Heat recovery: A portion F71 of the expanded fluid F65 from expander 600 may be directed through a heat recovery system 1000 to exchange heat with diluent fluid F95 that may be pressurized with pump 350 to deliver pressurized fluid F96 to the heat recovery system 1000. The heat recovery system 1000 may comprise one or more of a monotube heat exchanger, an economizer, a boiler and/or a superheater. These may form one or more heated diluent fluids F74 to combustor 155, and diluent fluids F36, and F70 to a separator 555.

In some configurations the heat recovery 1000 system may be used to recover heat from expanded fluid F71 to form hot liquid diluent F36, vaporized diluent F70, and superheated diluent F74. E.g., cold or cool liquid water these may form one or more of hot water F36, steam F70, and/or superheated steam F74. In other configurations, one or more of fluids F36, F70 and F74 may comprise a heated hydrocarbon or carbon dioxide, or a mixture of water, hydrocarbon, and/or carbon dioxide.

Hot $CO_2$/Steam Injection Fluid: In some configurations, one or more portions of vaporized diluent or steam F70 in excess of that required for fluid separation in separator 555 may be delivered to one or both of combustor 155, injection tube 622, and/or drive tube 522. (Not shown.) Similarly, one or more portions of superheated diluent F74 (e.g. superheated steam) maybe delivered to one or more of combustor 155, injection tube 622, and/or drive tube 522. (Not shown.)

$CO_2$/Steam Drive Fluid: A portion of the hot expanded fluid F65 used to form drive fluid F53 which is delivered into drive tube 522. A portion of heated diluent fluid F70 and/or a portion of superheated diluent fluid F74 may be mixed in the portion of F65 to form the drive fluid F53.

Temperature & Emissions control: One or more pressurized superheated diluent F74, and/or liquid diluent F42 are delivered to the combustor 155 and mixed with one or more of pressurized oxidant containing fluid F22, pressurized fuel containing fluid F30, and products of combustion to form energetic fluid F10 with a desired combustor outlet temperature (COT)/Turbine Inlet Temperature (TIT).

One or more diluent fluids F420 and/or F74 may be delivered upstream of the outlet of combustor 155. e.g., to control combustion temperatures within the combustor 155 and reduce production of oxides of nitrogen (NOx) and/or Carbon Monoxide (CO) as desired. The energetic gas F10 may comprise a portion of nitrogen and noble gases such as argon, depending on whether air is used, or the degree of oxygen enrichment. A portion of evaporated diluent F70 may also be delivered to the combustor 155.

Mixing injection and drive flows: The injection expansion flow F652 may be mixed with a portion F530 of recovered gas F52 through recycle compressor 223 to form a portion of injection gas flow F533, and any injection portion of evaporated diluent F70 to form injection fluid F62. Similarly delivery expansion flow F651 may be mixed with drive gas flow F532, and any injection portion of superheated diluent F74 to form drive fluid F53. A portion F192 of energetic fluid F18 may similarly be mixed into injection fluid F62.

Injection tube sizing: The inner diameter of the injection tube 622 may be configured in an injection diameter ratio relative to the inner diameter of the injection well 620 to provide similar cross-sectional flow areas within the injection tube 622 and in the injection annulus 624. The injection diameter ratio may be configured to provide similar flow resistances for the injection fluid F62 flowing through the injection tube as through the injection fluid returning through the injection annulus. E.g., the ratio of diameters of the injection well to the injection tube may be between about 1.1 and 3.0, and may be about 1.5.

Injection fluid delivery: The hot injection fluid F62 is delivered into the injection tube 622. This is delivered to the "toe" end of the injection 620 and back through the annulus 624. Some steam and carbon dioxide exits through the perforations in the tube to heat the surrounding reservoir by convection and conduction. Recovered injection fluid F50 is returned to the separator 555.

Drive tube sizing: The ratio of the diameter of the drive tube to the diameter of the production well may be sized like that of the injection well to provide a production annulus 624 with a flow resistance similar to the flow resistance of the drive tube. E.g., the ratio of diameters of the production well to the drive tube may be between about 1.1 and 3.0, and may be about 1.5.

Drive fluid delivery: The hot drive fluid F53 may be delivered into the drive tube 522. This is delivered to the "toe" end 95 of the drive tube 522 and back through the annulus 524. Some steam and carbon dioxide exits through the perforations in the tube to heat the surrounding reservoir by convection and conduction. Recovered drive fluid F51 may be returned to the separator 555.

Separating recovered fluids: The recovered production fluid F50 and the recovered drive fluid F51 may be processed in the separator 555 to separate out a recovered gas F52, a hydrocarbon fluid F86, a diluent or aqueous fluid F87, and a solids flow F59. Solids may be heated and separated by gravity into these fluids. Fine solid components may be separated from fluids F87 and F86 using a high speed centrifuge (Not shown.).

Pressure ratios: In some embodiments, compression system or compressor 220 comprises a low pressure compressor 221 forming medium pressure fluid F21 followed by a high pressure compressor 222. The low pressure compressor 221 may have a pressure ratio similar to the pressure ratio desired to take deliver fluid F62 into the injection tube F622. The compressor 220 may have a pressure ratio about equal to the expansion ratio of the expander 600 together with the pressure drop across the combustor 155. In this Direct VAST turbine, compressor 222 may have be configured to provide the expansion ratio of the expander 600 with the combustor 155 pressure drop. In this configuration, the low pressure compressor 221 may be used to provide the pressure of the outlet of the expander 600.

Recycle gaseous fluid: The gas flow F52 from the separator 555 may be compressed by a recycle booster blower or compressor 223 to form a compressed gas F530 to a pressure sufficient to deliver it into injector tube 622 with a desired pressure. This compressed gas flow may be distributed between an upstream portion flow F531 to deliver into the combustor 155, injection portion flow F533 to deliver to injection tube 622, and to drive portion F532 to deliver to drive tube 522.

Compressed gas flow F531 may be delivered to the inlet of a high pressure compressor 204. Compressor 224 further pressurizes gas flow F531 to form compressed gas flow F54 sufficient to deliver it into combustor 155 with a prescribed excess injection pressure. E.g., compressor 224 has a pressure ratio about equal to the expansion ratio of expander 600 times a portion of the pressure drop across combustor 155 and the injection over pressure. Compressed gas flow F531 may be cooled by a heat exchanger or intercooler 240 to deliver a cooled compressed gas F538 to compressor 224. Intercooler 240 may comprise direct contact cooling with vaporizable diluent such as water.

Controlling gas distribution: The relative proportions F531, F532 and F533 of f compressed gas F530 may be controlled by a valve V53 or an equivalent combination of valves. The relative distribution of compressed gas to these portions may be controlled by one or more additional compressors (not shown) or a differential compressor between flows F532 and F533 (not shown.) These additional compressor(s) together with compressor 224 may beneficially provide greater efficiency over using a valve V53.

Combusting residual hydrocarbons: Recovered gas F52 may comprise carbon dioxide with some residual hydrocarbons. The portion F54 of recovered gas F52 may be delivered as a thermal diluent in the combustor. Portion F54 may comprise a residual combustible component. The residual hydrocarbons in the recovered gas portion F54 may be reacted in the combustor to a desired degree sufficient to satisfy air emission regulations. Heat from a portion F71 of expanded gas F65 may be recovered through heat recovery system 1000 a portion of which may be discharged as flow F68. This portion F68 may be cooled in condensor 660 to recover a condensate flow F42 and discharge the non-condensed portion F79 of the flow F68.

Controlling non-condensed gases: Under long term steady state operating conditions, the recovered gas F52 typically comprises the carbon dioxide formed by combustion in the combustor plus any non-condensed components of nitrogen and noble gases delivered to the combustor less the portion of $CO_2$ sequestered underground such as dissolved in the hydrocarbon and water, and less those portions of nitrogen, noble gases and carbon dioxide that flow out from the system through resource 82 or are delivered to end uses or discharged to the atmosphere via flows F79 (as well as residual portions via flows F59, F86, and F87). Discharge F79 may be controlled to control the recycled non-condensed gas fraction below a prescribed level within the enhanced heavy oil recovery system.

Discharge F79 may be controlled to maintain a level of non-condensed gas, or of $CO_2$ within the system. Discharge F79 may be regulated with a valve such as valve V66 to regulate F71 into heat recovery system 1000. Flow F68 may be regulated on the outlet of heat recovery system 1000 as alternative to regulating F71. Discharge F79 may be controlled by an expander 601 to recover and control pressure-volume energy in the flow F79, together with a pump 340 to control and pressurize flow F42 to valve V42.

Recycling injection gas: In some configurations, the recycle blower or compressor 223 may be sized sufficiently large to recompress recovered gas F52 to mix it with the expander outlet gas F65 and deliver it into injection tube 622 of well 620 to heat and mobilize a portion of resource 82 such as from the "steam" chamber 90. The pressure ratio of recycle compressor 223 may be configured and controlled sufficient to overcome the pressure drop of delivering the hot gases into the injection tube 622, and to separate the recovered fluid F50 in separator 555. This provides a higher flow rate of injection gas F62 with input heat combustion in the turbine via F65, than delivering that portion of expanded gas F65 alone. This increases the heat flow along the injection well and provides a greater uniformity of temperature along the injection well 620 from the "heel" 94 to the "toe" 95.

Recycling drive gas: In some configurations, a drive portion F532 of the gas F52 may similarly be compressed through recycle compressor 223. Flow F523 may be compressed by a recycle compressor 223 sufficient to mix the portion in with a portion F651 of expanded gas F65 to deliver as drive flow F53 into the drive tube 522. In some configurations a booster drive compressor 225 may be added to separately boost the pressure of the drive fluid F53 (not shown). Recycle compressor 223 and/or booster drive compressor 225 may be driven by a power turbine, by a variable speed drive and/or by an electric motor, to accommodate variations in production and the consequent pressure needed to produce fluid F51.

Compressor configurations: Compressor 220 may compress the intake oxidant fluid to the pressure ratio of the expander times the pressure ratio needed to deliver the injection fluid F62 and drive fluid F53 into the injection well 620 and production well 520 respectively. E.g., intake oxygen, or oxygen enriched air, or air. In some configurations, compressor 220 may comprise multiple compressors, comprising a low pressure compressor 221 forming medium pressure flow F21, and high pressure compressor 222. Expander 600 may comprise two or three expanders on multiple shafts. e.g., a high, medium and/or low pressure expander.

Compressor 222 may be connected to a shaft driven by the high pressure compressor expander. Compressors 221 and 223 may be connected directly to the power expander shaft etc. A generator may be provided to extract power from one or more of the medium or low pressure or power expanders. e.g., to generate electricity to drive compressor 224 and/or other power uses. In other configurations, the expansion ratio of expander 600 may be reduced or one or more down stream stages of expander 600 may be removed to adjust the relative pressure ratios of the expander 600 and compressors 220, 221, 222, 223, 224 and/or 225.

Liquid diluent recovery: The cooled expanded fluid F68 exiting the heat recovery system 1000 may be cooled sufficient to condense liquid diluent that is then separated from gases in a condensor/separator 660 into liquid products of combustion F42 and a cooled gaseous fluid F79. E.g., in configurations using water diluent, condensor/separator 660 will recovery condensed water F42 and residual non-condensed gases F79 comprising carbon dioxide ($CO_2$) and remaining nitrogen, noble gases and residual oxygen. In some configurations carbon dioxide diluent may be condensed and separated to provide liquid carbon dioxide diluent F42, and non-condensible gas F79 comprising the remaining nitrogen, noble gases and residual oxygen.

Clean liquid diluent use: In some configurations, a portion F420 of condensed separated liquid diluent F42 may be directed back to combustor 155 to control one or more of peak combustion temperature and/or combustor outlet temperature/turbine inlet temperature. E.g., F42 may be clean water. This beneficially improves efficiency and increases net power from expander 600.

Condensing diluent: Condensor/separator 660 may be provided and configured to condense products of combustion and/or liquid diluent from cooled expanded fluid F68, a portion of water and/or carbon dioxide formed by combustion and a portion of such further liquid diluent (such as water and/or carbon dioxide) delivered to combustor 155 as desired to control the combustor outlet/turbine inlet temperature to expander 600. A conventional gas turbine with conventional compressor 200, combustor 100 and expander 600 may be used in some configurations to provide drive power for compressors and generators, and from whose exhaust products of combustion may be recovered.

Thermal delivery: Injection fluid F62 and drive fluid F53 are initially formed from similar mixtures of fluids F65, F70 and F74 and delivered to injection tube 622 and drive tube 522 respectively to preheat the hydrocarbon resource. The hot fluids F62 and F53 may comprise superheated diluent or steam markedly higher than the temperature of saturated steam at the delivered pressure. In some configurations the temperature of F62 and/or F53 may be controlled greater than 260° C. (500° F.). In some configurations, the temperature of F62 and/or F53 may be controlled greater than 310° C. (590° F.). One or both of the injection tube 622 and delivery tube 522 may be made from corrosion resistant materials suitable for the hot fluids F62 and F53 comprising carbon dioxide, steam and/or sulfur oxides.

Intermediate thermal delivery: As hydrocarbon resource around injection and production wells is heated, the hydrocarbon viscosity is reduced and the hydrocarbon begins to be mobilized to the production well. The portions of heated diluent F70 and F74 delivered to the injection fluid F62 may be progressively increased while the portions to the drive fluid F53 may be reduced over time. The portions of expanded fluid F65 delivered to the injection fluid F62 and the drive fluid F53 may be adjusted to increase the rate of hydrocarbon production and increase the corresponding thermoeconomic returns.

Turbine Inlet Temperature control: A portion F420 of condensate F42 may be redirected upstream of the inlet to turbine 600. E.g., within compressor heat exchanger or intercooler 240, to reduce compression work and/or to control the Turbine Inlet Temperature (TIT). Intercooler 240 may be a direct contact heat exchanger utilizing liquid diluent. The balance of the condensate may be delivered as part of flow F96 into the heat recovery system. Similarly, a portion of hot water F37 may be directed from the heat recovery system 1000 to the combustor 155 and the flow may be controlled. The balance F36 of hot water may be directed to separator 555.

Gas composition control: As injection fluid F62 and drive fluid F53 are delivered, a portion of steam will condense within the resource. Portions of the carbon dioxide delivered will dissolve in the heavy hydrocarbon resource and in water within the resource 82. Corresponding portions of this aqueous condensate and dissolved carbon dioxide will be produced along with heavy hydrocarbon as fluid F50 is recovered. These portions of water and carbon dioxide may be predominantly separated in the separator 555 into aqueous fluid F87, and into gaseous fluid F52.

Controlling $CO_2$ vs Steam Delivery: In some configurations, as hydrocarbon production progresses, the temperature and proportion of steam in injection fluid F62 and drive fluid F53 may be reduced to a progressive degree and the portion of carbon dioxide may be progressively increased. The portion of carbon dioxide in the cycle may be controlled by controlling the portion of expanded fluid removed from the power cycle as discharged fluid F79 versus the portion F65 delivered to the hydrocarbon resource, and by the amount of water and steam from F42, F70, F74 and F54 delivered upstream of the expander to control temperature versus the portion delivered to separator 555 via the heat recovery system 1000 to aqueous discharge F87 with small portions to F59 and F52.

In some configurations, the proportion of carbon dioxide in the cycle may be increased and the amount of makeup water F95 required may be beneficially reduced by directing all the condensate F42 back into heat recovery system 1000 as feed water F95 or F96. In further configurations, the proportion of carbon dioxide in the cycle may be further increased by redirecting discharge fluid F79 back into the inlet of the low pressure compressor 221. When nitrogen is present in the oxidant fluid, carbon dioxide may be further increased by separating $CO_2$ from fluid F79. The separated $CO_2$ may be directed into the intake of compressors 221 and/or 222.

The portion of steam delivered downhole may similarly be controlled by adjusting the portion of heat recovery steam F70 and superheated steam F74 that is mixed into fluids F62 and F53 delivered into the hydrocarbon resource, versus that delivered into the combustor 155 to increase expander power and/or efficiency. Reducing steam and/or increasing carbon dioxide fraction is expected to beneficially improve the equivalent "Steam to Oil Ratio" and/or to increase the portion of hydrocarbon extracted from the hydrocarbon resource.

In some configurations, the distribution of water from the separator going to the gas fluid F52 versus to the aqueous flow F87 is controlled by the temperature within the separator. The aqueous ratio of gaseous water to liquid water discharged from separator 555 may thus be controlled by controlling the portion of heat recovery fluid F36 and F70 directed to the separator, and the recycle rate of F52. Similarly, the hydrocarbon ratio portion of hydrocarbon distributed as vapor to flow F52 versus to hydrocarbon fluid F87 is controlled by the temperature within separator 555 and thus by controlling the corresponding input and output flows as before.

Thermogenerator Energetic Fluid Delivery with Fluid Recycle

Figure 29:
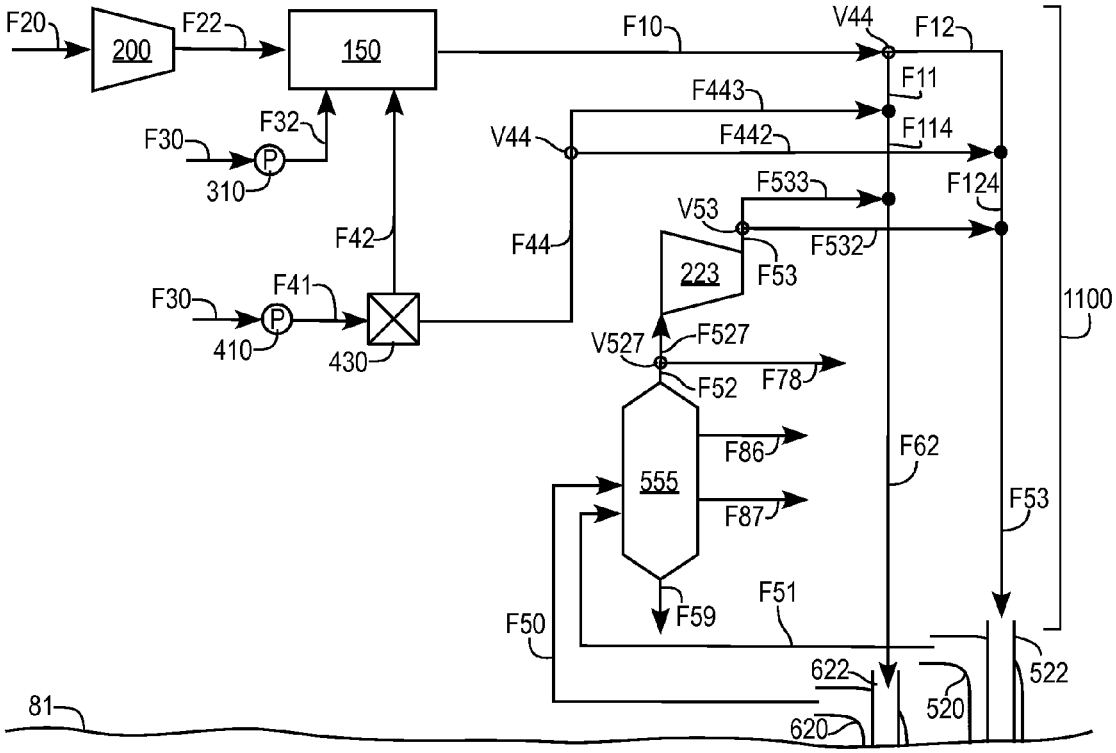
FIG. 29 schematically shows a thermogenerator with a separator system for delivering and recycling process fluid comprising water, $CO_2$ and/or hydrocarbon vapor.

Referring to FIG. 29, in a simplified embodiment diluted energetic fluid may be formed in a thermogenerator and diluted, and then mixed with recycled fluids to deliver an injection fluid to an injection well and a drive fluid to a production well.

An energetic fluid or VASTgas F10 may be formed in combustor 150 similar to the embodiment described in FIG. 1. The VASTgas F10 may be directed into an injection stream F11 and a drive stream F12 by valve or diverter V44. Further diluent F44 may be directed into an injection stream F443 and a drive stream F442 by valve or diverter V44 to form diluted injection stream F114 and diluted drive stream F124. The injection stream F443 may be delivered to an injection tube 622 within an injection well 620 into a geological resource below surface 81. The drive stream F124 may be delivered to an production tube 522 in a production well 520 to recover hydrocarbon resource. Injection wells 620 and production wells 520 may be configured similar to wells in Steam Assisted Gravity Drainage SAGD processes.

Figure 28:
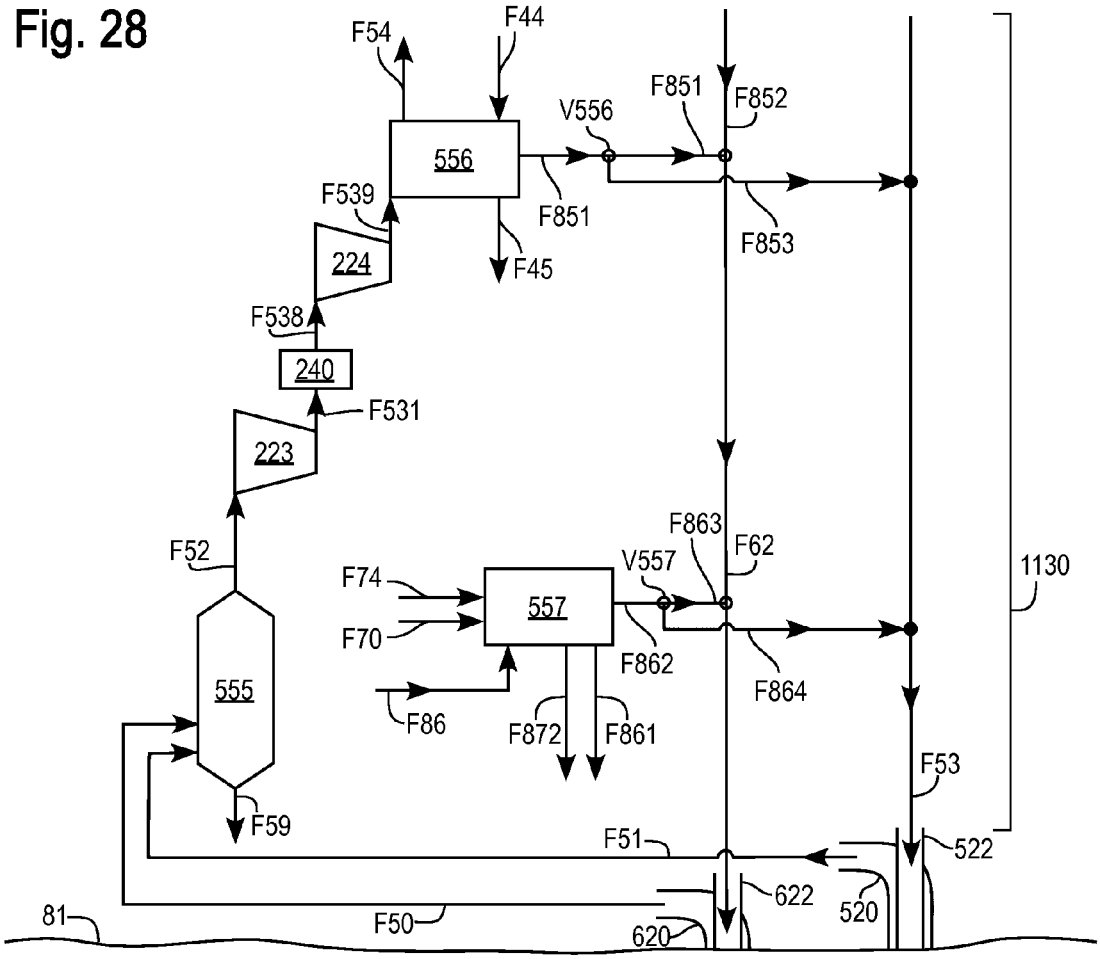
FIG. 28 schematically shows a separator system for separating and recycling gases and lighter hydrocarbons from produced fluids.

Separating Produced & Recovered Fluids: Referring to FIG. 28, one or both of recovered fluid F50 recovered from injection well 620 and produced fluid F51 from production well 520 may be separated in separator 555. These fluids may be separated into a gaseous fluid portion F52, a hydrocarbon portion F86, an aqueous portion F87 and a solids portion F59.

Recycling Gaseous Fluid: A portion F527 of the gaseous fluid F52 may be directed to recycle compressor 223 by valve or diverter V527 while the residual portion F78 may be discharged to the atmosphere. Compressed fluid F53 from recycle compressor 223 be directed into an injection portion F533 and a drive portion F532 by splitter or valve F53. Drive portion F532 may be mixed with diluted drive stream F124 to form and deliver drive fluid F53 to production or drive tube 522. Injection portion F533 may be mixed with diluted injection stream F114 to form injection fluid F62 and deliver it to injection tube 622 within injection well 620.

Thermogenerator and Combustor

Figure 23:
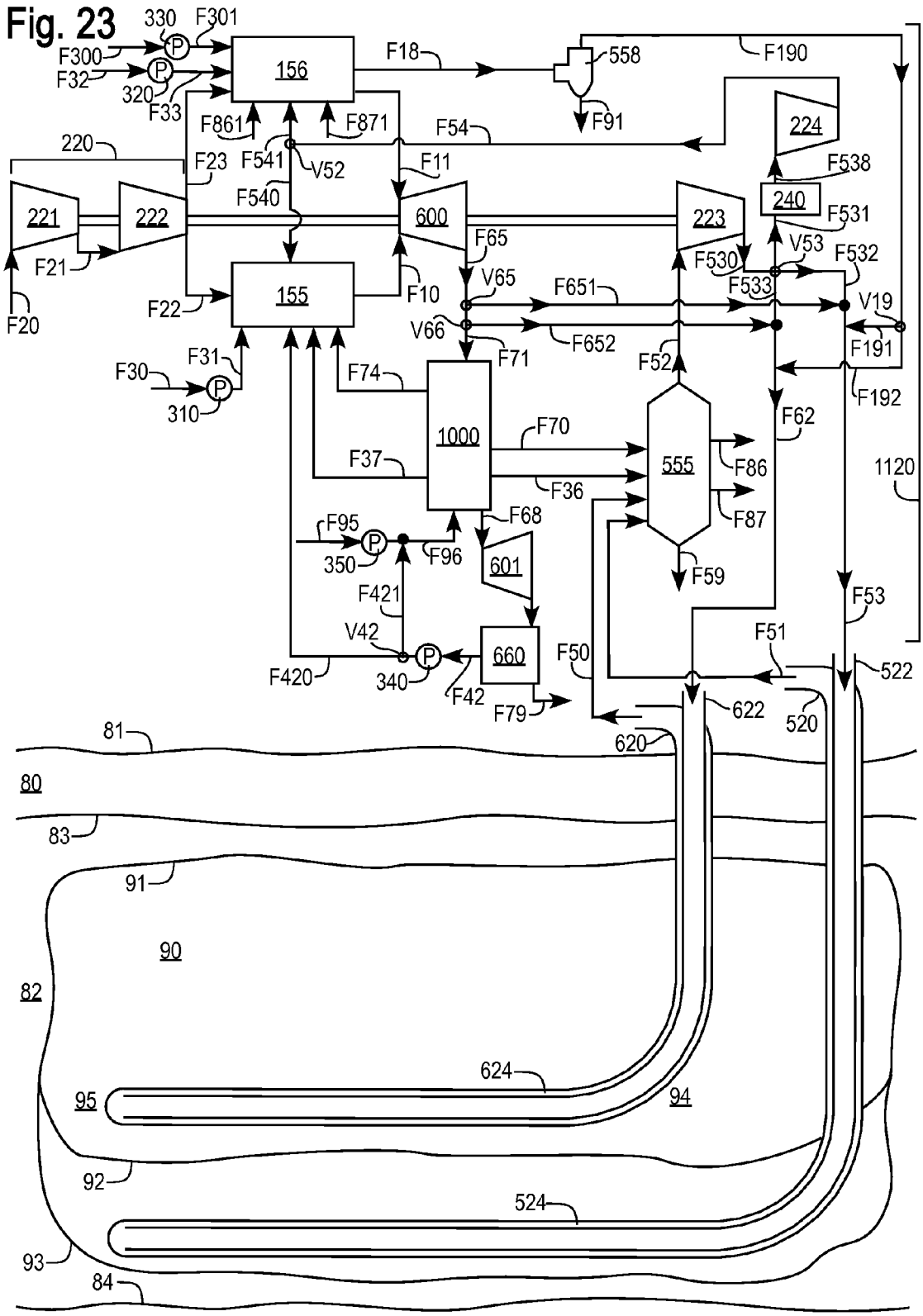
FIG. 23 schematically illustrates a Diverted VAST Combined Heat & Power Recovery system with $CO_2$ recycle.

Thermogenerator added: With reference to FIG. 23, in another Diverted VAST GT embodiment a thermogenerator 156 is provided in addition to the combustor 155. The respective components and flows for the turbine, heat recovery, fluid delivery, injection and production wells and fluid separation shown in FIG. 22 and described above are incorporated herein as part description of the embodiment for FIG. 23.

Thermogenerator flows: As with the combustor, a portion F23 of the compressed oxidant fluid from the compressor 222 is delivered to the thermogenerator 101. Fuel fluid 34 may be pressurized by pressurizer, pump or compressor 341 to form pressurized fuel fluid F36 to the thermogenerator 156. e.g., a clean fuel such as natural gas. Another fuel fluid F300 may similarly be pressurized by pressurizer, pump, or compressor 330 to deliver pressurized fuel F301 to the thermogenerator 156. Fuel fluid F300 may be a cheaper and/or dirtier fuel such as fluidized heavy hydrocarbon, bitumen, coke, and/or coal. The fluidizing fluid may be gaseous or liquid water, carbon dioxide, or hydrocarbon. Some or all of these fuel fluids are combusted in the thermogenerator to form products of combustion F18.

A pressurized thermogenerator portion F861 of separated hydrocarbon flow F86 may be used to provide an in situ fuel to the thermogenerator 156 upstream of the outlet. A pressurized portion F871 of liquid diluent or aqueous fluid F87 separated by separator 555 from the produced fluid F50 may be delivered to the thermogenerator 156. An upstream thermogenerator portion F541 of compressed gaseous fluid F54 compressed by compressor 224 may also be delivered to the thermogenerator 156.

The products of combustion with thermal diluent and any portion of recycled gas form an energetic or process fluid F18. E.g., process fluid F18 typically comprises steam with carbon dioxide formed from combustion in the thermogenerator. It may also comprise a portion of recycled $CO_2$, and/or a portion of recycled gas comprising non-condensed gases. E.g, a portion of nitrogen, noble gases, and/or excess oxygen delivered to the thermogenerator.

Solids separation: The separator 555 may be used to separate most coarse and fine solids from produced fluid F50 and F51 to form solids discharge F59. One or more of fuel fluid F30, fuel fluid F300, diluent or aqueous flow F871, and/or hydrocarbon flow F861 may comprise residual fine solids that form particulates and/or a dust on combustion. A dust separator 558 may be provided downstream of thermogenerator 156 to separate a portion F91 of this dust from process fluid F18 to form cleaned process fluid F190. Dust separator 558 may comprise an array of small gas separation cyclones. e.g., these may be formed from ceramic tubes and cones with less than 15 mm in maximum diameter. A pressurized electrostatic precipitator may be used to separate finer dust. May use a hybrid dust separator combining both cyclones and electrostatic separators.

Distributing Cleaned Process Fluid: Cleaned process fluid F190 may be divided to form an injection process flow F192 and a drive process flow F191. A process flow valve V19 may be used to divide process fluid F190. These flows F191 and/or F192 are delivered to injection tube 622 and drive tube 522.

Flow mixing: These flows F191 and/or F192 are mixed with the respective portions of expanded flow F652 and/or F651, portions of recycled gas F533 and/or F532, and portions of superheated diluent (e/g/superheated steam and/or evaporated diluent (e.g. steam) to form injection fluid F62 and drive fluid F53.

Simplified thermogenerator/combustor configuration: Configurations using both a turbine combustor 155 and a thermogenerator 156 may be simplified to direct all the expanded flow F65 from the expander 600 through the heat recovery system 1000. This increases the heat recovered to fluids F36, F37, F70 and/or F74 while eliminating the valves V65 and V66 and corresponding piping.

Figure 24:
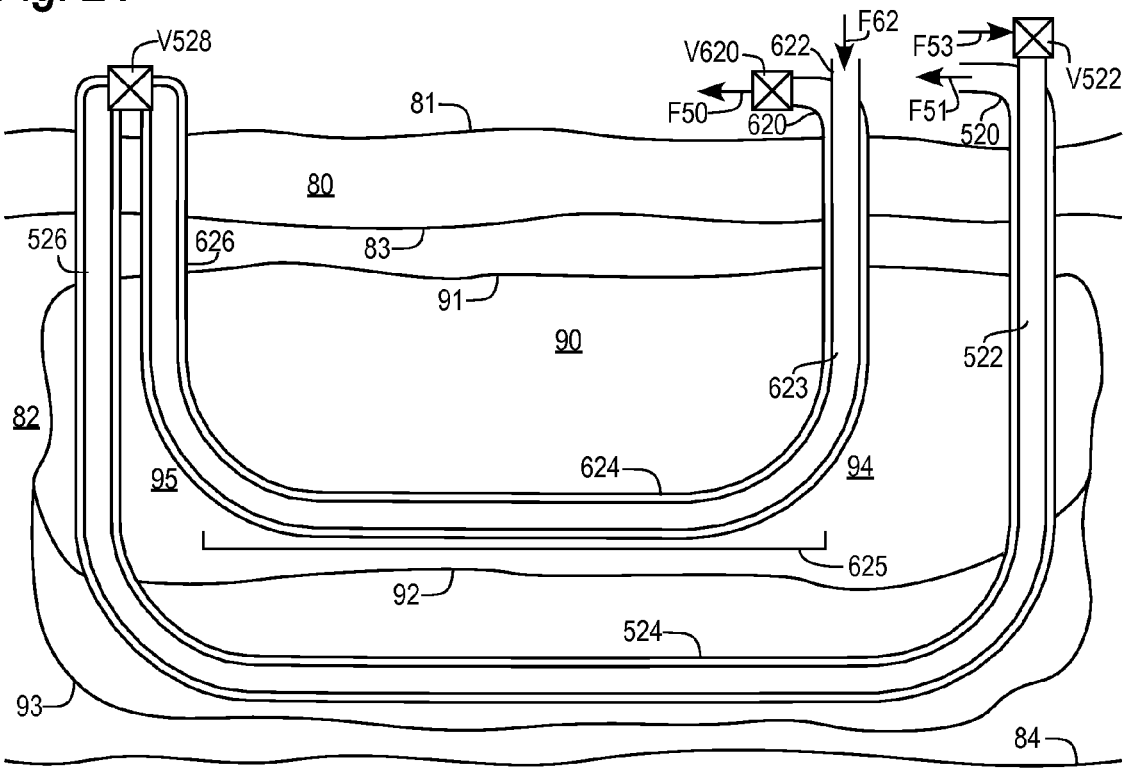
FIG. 24 schematically shows toe end injection and production risers with a surface connection.

U Flow through configuration: Referring to FIG. 24, in some embodiments, a through flow well configuration may be used. In some configurations hot energetic fluid F62 may be delivered through a U shaped injection well 620 comprising a central tube 622 delivered through a near injection leg 623 around the well's "heel" end 94 in communication with an extended heating leg 625 followed by a far injection leg 626 near the "toe" end. A portion of the energetic fluid F62 may similarly be directed back through the annulus 624 formed between a well casing 620 and the injection tube 622.

A similar U shaped configuration may be used to form a production well 520 to deliver heating and/or production fluid F53 through production delivery tube 522 through near down leg 523 near toe 94 through an extended production leg 525 and up through a far up leg with return through a production annulus 524 between the delivery tube 522 and the well casing 520. The delivery tube 620 may be connected to a valve V528 controllable to direct a portion of the energetic fluid F62 through the U shaped production annulus 524 within the production tube 520.

Further referring to FIG. 24, in some configurations, the injection tube 622 may be connected via valve V528 to the far delivery leg 526 of the well 520 while a corresponding extended recovery tube 525 may be connected to the outlet of near delivery leg of well 522 to produce fluid F51.

In another configuration, the energetic fluid F62 may be delivered through the injection well 620 to valve V528 which is connected to production tube 520 without one or both injection tube 622 and/or production tube 522. This can produce the hydrocarbon fluid F51 through the outlet of the production tube 520.

Figure 25:
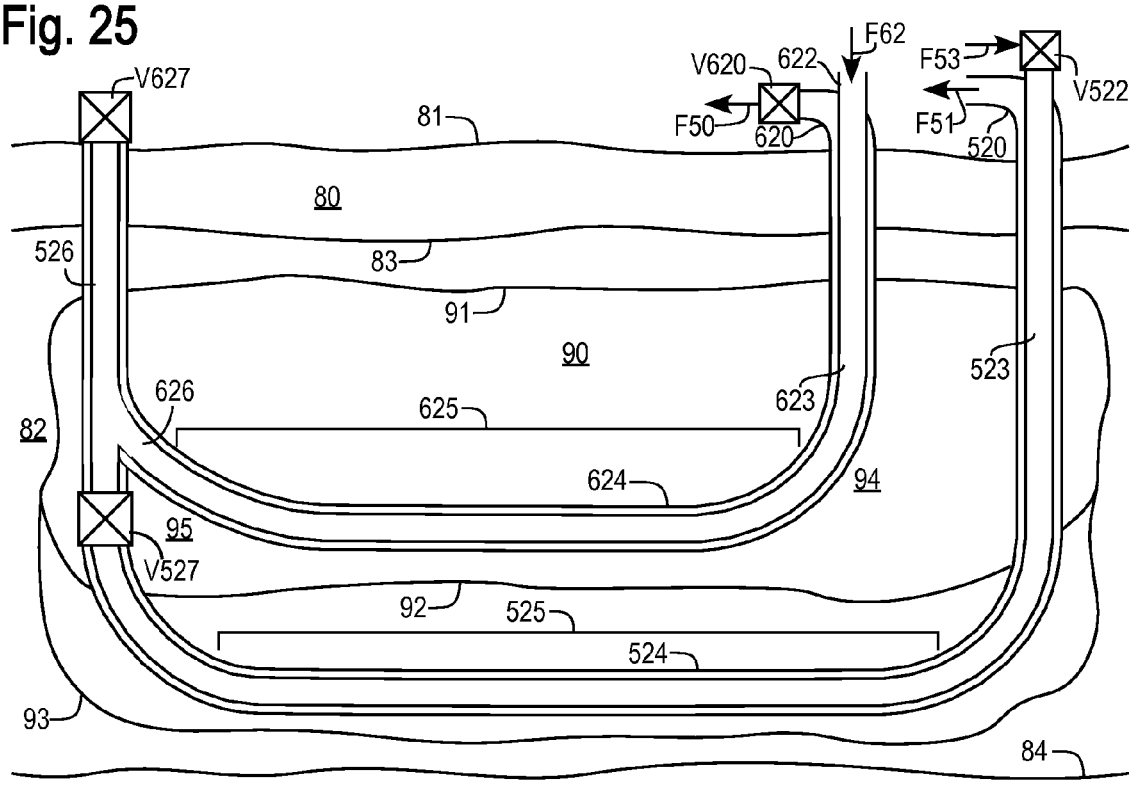
FIG. 25 schematically shows toe end injection and projection risers with a Y junction.

Y Flow through and back configuration: In further embodiments, a Y flow through and back configuration may be used to join two far end J shaped legs of the injection and production wells. Description of FIG. 24 herein may be incorporated by reference in this configuration. Referring to FIG. 25, in one configuration the far injection leg 626 of the injection well 620 may join or intersect with the far production leg 526 such as in a Y configuration below the surface. One or more valves V527 and/or V627 may be used to control the deliver a portion of energetic fluid F62 though the injection well 620 and out through the production well 520 to heat the portion of resource 82 resulting in production of heavy hydrocarbon, and formation of "steam" chamber 90 from recovery of the heavy hydrocarbons. Valve V627 may be used to direct a portion of flow F62 back through injection well annulus 624. Valve 527 may be used to control a portion of flow F62 through production well 520.

In similar configurations, both "toes" of the injection and production wells may be connected to a separate connecting well. In such configurations, the equivalent valves V627 and V527 in the connecting well may be shut off to provide the respective controls over flow with and between the injection and production wells.

The "toe" end of the injection well 626 may be connected to the "toe" end of the production well 526. E.g., by forming a U bend from the "toe" end of the injector to the "toe" end of the production well drilled in reverse and then back out the production J well.

Alternating Zig-Zag well array: In some embodiments, the flow through configuration may be configured as an array of joined injection U tube wells such as schematically shown in perspective view in FIG. 26. A combined heat and power (CHP) recovery system 1100 may be used to deliver energetic fluid F62 to an alternating Zig Zag U tube array which may be configured with about parallel sets of U tubes to direct and return the energetic flow from one or more energy conversion systems back and forth through the resource.

For example, a portion of energetic fluid F62A from a first combined heat and power recovery system 1100A may be delivered through near valve V627N down into near injection leg 627A along an extended well 627B and up via far leg 627C to far valve V627F. The flow may then be delivered back down the far leg 628C to another extended injection well 628B and back up a near injection leg 628A to a return near valve V628N as fluid V50A to a second CHP recovery system 1100B.

Similarly, a second portion of energetic fluid F62B from the second combined heat and power recovery system 1100B may be delivered through a near valve V629N down into near injection leg 629A along an extended well 629B and up via far leg 629C to far valve V629F. The fluid F62B may then be directed down a far leg 630C to another extended injection well 630B and back up a near leg 630C to a valve V630N which may return fluid F50B back to the CHP recovery system 1100C. Such an alternating Zig-Zag well array configuration provides for one CHP recovery system 1100 to every pair of injection wells 627 and 628, etc.

Figure 27:
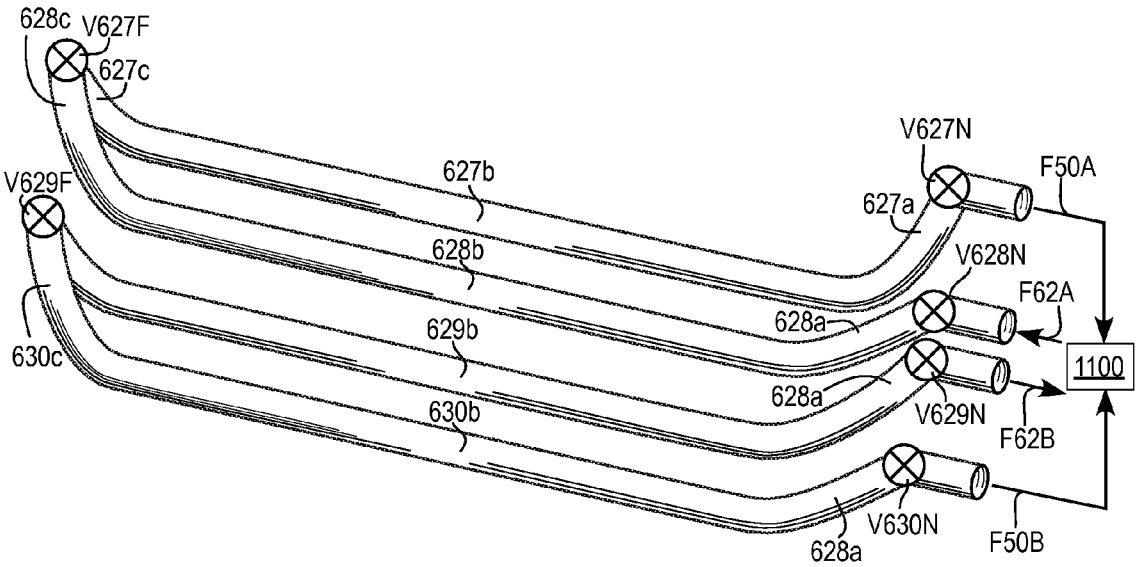
FIG. 27 schematically shows a plan view of paired U shaped injection wells connected in a Zig-Zag array.

Paired Zig-Zag well array: In another configuration schematically shown in perspective in FIG. 27, energetic fluid from a CHP recovery system may be delivered in a paired Zig-Zag array of U shaped injection wells. e.g., one or more CHP recovery systems 1100 may deliver a first energetic fluid F62A to the first valve V628N into near injector leg 628A into extended injection well 628B and then up through far injection well leg 628*c* to Valve 627F. Then the energetic fluid F62A may be returned through far injection leg 627C, extended well 627B and near injection leg 627A to near valve V627N as return fluid F50A back to CHP recovery system 1100.

CHP recovery system 1100 may similarly deliver energetic fluid F62B into a paired injection well set through valve V629N into near injector down leg 629A, extended well 629B and up far injector leg 629C to far valve V629F. The fluid F62B may then be returned down far injector leg 630C, extended well 630B, and back through near injection leg 630A to valve 630N as return fluid F50B back to CHP recovery system 1100. Similar portions of fluid F62 may be delivered to a third injector well set or more injector well sets.

Such paired Zig-Zag well array configurations provide for one CHP recovery system 1100 for sets of four injection wells. Paired well sets reduce the lengths of piping needed to deliver high temperature fluid F62 and reduce the heat loss by providing for longer runs of lower temperature return fluid F50, compared to a configuration with one CHP recovery system 1100 for each injection/production well pair, or the alternating well set configuration.

Further configurations may use such sets of alternating or paired injection wells with multiple CHP recovery systems per well pad with less than one CHP recovery system per injection/production well pair. They further enable efficient recovery of CO2 that can be reheated and/or recycled into a heavy hydrocarbon resource.

Flow between injection/production wells: In some flow between configurations, the energetic fluid F62 may be delivered to flow through the hydrocarbon resource 82 between one or more injection wells 620 and projection wells 520 or vice versa. e.g., a portion of energetic fluid F62 may be delivered into a first injection well 622 with the far valve V528 partially or fully closed. A portion of the flow F62 may then flow through the resource 82 to one or more nearby production wells 524. Such flows between wells provide sensible heat transfer.

Flow between injection wells: In some flow between configurations, the energetic fluid F62 may be delivered to flow through the hydrocarbon resource 82 from one well to another. e.g. Referring to FIG. 26, a portion of energetic fluid F62B may be delivered into a first injection well 629B with the far valve V629F partially or fully closed. A portion of the flow F62B may then flow to nearby wells 628B and/or 630B. A similar flow configuration may be used between injection wells with the paired zig-zag array of FIG. 27.

Figure 26:
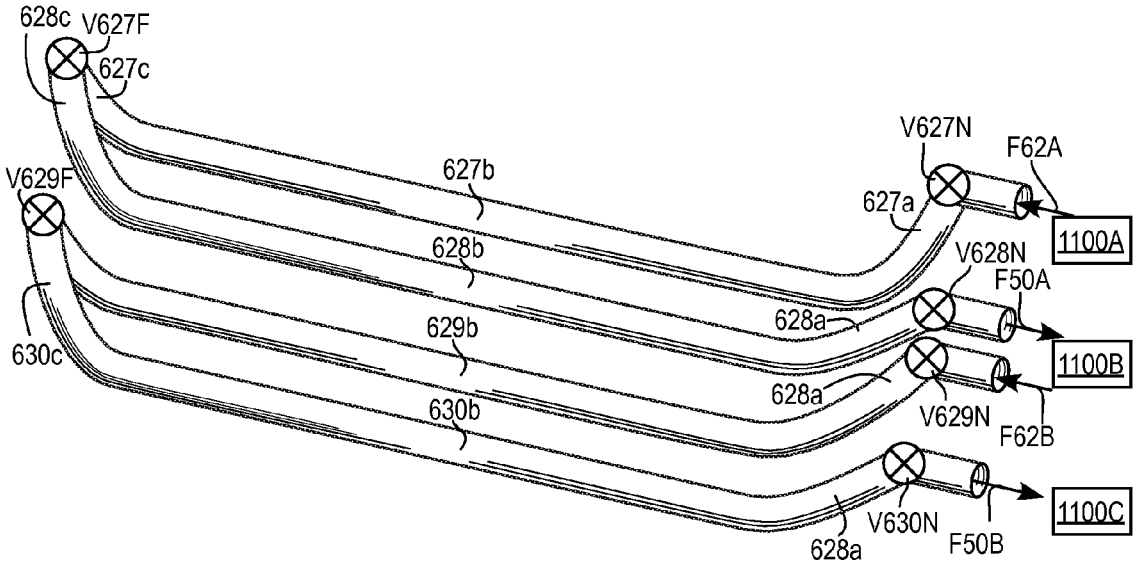
FIG. 26 schematically shows a plan view of alternating U shaped injection wells connected in a Zig-Zag array.

Flow through then between wells: In some configurations, the energetic fluid may first be primarily delivered through one injection well and back through another as shown in FIG. 26 and/or FIG. 27. As heavy hydrocarbons are produced from the hydrocarbon resource and the "steam" chamber is formed, permeability increases between nearby wells. As such permeability increases, an increasing portion of the energetic fluid may be flow between nearby wells as described above as flow between injection wells. The portion of flow through to flow between wells may be controlled by adjusting one or more of valves F528, V527, V627, V627N, V629F, V628N, V629N and/or V630N as shown in FIG. 24, FIG. 25, FIG. 26, and/or FIG. 27.

Separating recovered fluids: The enhanced recovery system may comprise a fluid separation system 1100 to separate recovered fluid F51 and produced fluid F50 into components and to recirculate a portion of these components. The recovered production fluid F50 and the recovered drive fluid F51 may be processed in the separator 555 to separate out a recovered gas F52, a hydrocarbon fluid F86, a diluent or aqueous fluid F87, and a solids flow F59. Solids may be heated and separated by gravity into these fluids. Fine solid components may be further separated from fluids F87 and F86 using a high speed centrifuge (Not shown.)

Separating hydrocarbons: FIG. 28 shows further inventive components of separation system 1100.

Separating gaseous hydrocarbons: Gaseous fluid separated from separator 555 may be separated into lighter less condensable gases and heavier more condensable hydrocarbon gases. E.g., separating CO2 and methane from light C2-C6 hydrocarbons. Residual non-condensed nitrogen, noble gases and oxygen in the flow are similarly separated with the CO2. In some configurations, the gaseous flow is compressed and cooled to condense and separate the non-condensed gases from the light C2-C6 hydrocarbons.

Exemplary gaseous separator: For example, in one configuration gaseous fluid F52 may be compressed by recycle compressor 223, to form compressed gaseous fluid F531 and then be cooled by intercooler 240. Compressed gas F531 may be further compressed by compressor 224 and further separated by separator 556. Separator 556 may include a heat exchanger to flow compressed gas F538 against cooling flow F44 to separate out condensed gas F851 from non-condensed gas F54 with discharge of warmed fluid F45. Other combinations of compressor(s) and condensor(s) maybe used to the same purpose.

Distributing gases: A portion F54 of the recovered hydrocarbon F851 may be distributed by valve V556 and recycled to the injection fluid F62 and the drive fluid F53. These fluids may be distributed by a one or more compressors in flows F582 and F583, or a differential compressor between flows F582 and F583.

Separating solvent hydrocarbons: In some embodiments, hydrocarbon fluid F86 from separator 555, may be delivered to solvent separator 557 to separate a portion of the intermediate or "solvent" hydrocarbons from the heavier hydrocarbons. For example, in one configuration, an evaporator or boiler is may be used to pass one or more portions of hot liquid diluent F36, evaporated diluent fluid F70 and/or superheated fluid F70 against hydrocarbon fluid F86. This evaporates a solvent portion F862 leaving a heavier hydrocarbon portion F861 and exhausting a cooler and/or condensed fluid F872.

Exemplary solvent separator: The solvent separator may use a direct contact evaporator with one of hot water F36, steam F70 and/or superheated steam F74. This provides for residual steam to be beneficially delivered with the hydrocarbon solvent to the injection and/or production wells.

Solvent hydrocarbon composition: The composition of the solvent hydrocarbon fluid F862 and/or residual heavier hydrocarbon flow F861 may be controlled by adjusting the hydrocarbon distillation temperature. E.g., by controlling one or more of the temperature and flow of these heated fluids F36, F70 and/or F74. This adjusts the relative portion of solvent hydrocarbons separated from the heavier feed hydrocarbon fluid F86.

Recycle delivery of solvent hydrocarbons: A valve V557 may be used to direct an injection flow F863 of solvent hydrocarbon fluid to injection tube 622, and a drive flow F864 of solvent hydrocarbon to drive tube 522. One or more blowers or compressors may be used to direct the desired portions of solvent hydrocarbons F862 to respective flows F863 and F874. A differential compressor may similarly be used between those flows F862 and F863 to provide the desired distribution of hydrocarbons within the solvent fluid F862.

Multiple solvent compositions: In some embodiments, two or more separators 557 may be provided. The first "injection" separator 557A may process an injection portion of hydrocarbon flow F86 to form an injection solvent flow. The second "drive" separator 557B processes a drive solvent portion of hydrocarbon flow F86. This embodiment may be operated to form the injection solvent with a desired injection solvent composition, and the drive solvent with a different drive solvent composition. The two separators 557A and 557B may further be sized differently to efficiently provide an injection solvent flow differing both in composition and magnitude from the drive solvent. E.g., the injection solvent and the drive solvent may be processed to prescribed mean boiling point, or to prescribed boiling point distributions.

Configuring injection flows: Two or more of the injection fluids may be mixed near the separators and then delivered to the injection tube. These may be mixed to provide a mixed injection fluid with a desired composition of at least three of carbon dioxide, steam, light hydrocarbon gases, and/or solvent hydrocarbons. These flows may be configured to further control the temperature of the injection fluid. These flows may be configured to further control the distribution of gaseous and/or solvent hydrocarbons in the injection fluid F62.

Configuring drive flow composition: Two or more of the drive fluids may be mixed near the separators and then delivered to the injection tube. The drive fluid flows may be configured to provide a mixed drive fluid with a desired composition of at least three of carbon dioxide, steam, light hydrocarbon gases, and/or solvent hydrocarbons. These flows may be configured to further control the distribution of gaseous and/or solvent hydrocarbons in the drive fluid F53.

Pressure ratios: With further reference to FIG. 22, in some embodiments, compression system or compressor 220 may comprise a low pressure compressor 221 followed by a high pressure compressor 222. The low pressure compressor 221 may have a pressure ratio similar to the pressure ratio desired to take deliver fluid F62 into the injection tube F622. The high pressure compressor 222 may have a pressure ratio about equal to the expansion ratio of the expander 600 together with the pressure drop across the combustor 100.

Recycle gaseous fluid: The gas flow F52 from the separator may be compressed by a recycle blower or compressor 223 to form a compressed gas to a pressure sufficient to deliver it into injector tube 622 with a desired pressure. This compressed gas flow may be distributed between an upstream portion flow F531 to deliver into the combustor 100, injection portion flow F533 to deliver to injection tube 622, and to drive portion F532 to deliver to drive tube 522.

Compressed gas flow F531 may be delivered to the inlet of a high pressure compressor 224. Compressor 224 may further pressurize gas flow F531 to compressed gas flow F54 sufficient to deliver it into combustor 100 with a prescribed excess injection pressure. E.g., compressor 224 may have a pressure ratio about equal to the expansion ratio of expander 600 times a portion of the pressure drop across combustor 100 and the injection over pressure. Compressed gas flow F531 may be cooled by a heat exchanger or intercooler 240 to deliver a cooled compressed gas F538 to compressor 224.

Controlling gas distribution: The relative proportions of compressed gas flowing to F531, F532 and F533 may be controlled by a valve V53. The relative distribution of compressed gas to these portions may be controlled by one or more additional compressors (not shown) or a differential compressor between F532 and F533 (not shown.) These additional compressor(s) together with compressor 224 beneficially provide greater efficiency over using a valve V53.

Combusting residual hydrocarbons: Recovered gas F52 comprises carbon dioxide with some residual hydrocarbons and forms a thermal diluent in the combustor with a residual combustible component. The residual hydrocarbons in the recovered gas F52 may be reacted in the combustor to a desired degree sufficient to satisfy air emission regulations. Heat from a portion of expanded gas F65 is recovered through heat recovery system 1000. This is cooled in condensor 660 to recover condensate F42 and discharge the non-condensed portion F79 of the flow F71.

Controlling non-condensed gases: Under long term steady state operating conditions, the recovered gas F52 comprises the amount of carbon dioxide formed by combustion in the combustor plus any non-condensed components of nitrogen and noble gases delivered to the combustor less the portion of CO2 sequestered underground such as dissolved in the hydrocarbon and water. Discharge F79 may be controlled to keep the recycled non-condensed gas fraction below a prescribed level within the enhanced heavy oil recovery system. Discharge F79 may be controlled to maintain a level of non-condensed gas, and/or of CO2 within the system. Discharge F79 may be regulated with a valve such as valve V66 to regulate F71 into heat recovery system 1000. Regulating flow F68 on the outlet of heat recovery system 1000 is preferable over regulating F71. Discharge F79 may be controlled by an expander 601 to recovery and control pressure-volume energy in the flow F79.

Recycling injection gas: In some configurations, the recycle booster compressor 223 may be sized sufficiently large to recompress recovered gas F52 to mix it with the expander outlet gas F65 and deliver it into injection tube 622 of well 620 to heat and mobilize resource 90. The pressure ratio of recycle compressor 223 may be configured sufficient to overcome the pressure drop of delivering the hot gases into the injection tube 622, and to separate the recovered fluid F50 in separator 555. This provides a higher flow rate of injection gas F62 with input heat combustion in the turbine via F65, than delivering that portion of expanded gas F65 alone. This increases the heat flow along the injection well and provides a greater uniformity of temperature along the injection well 620 from heel 94 to toe 95.

Recycling drive gas: In some configurations, a drive portion F523 of the gas F52 may similarly be compressed through recycle compressor 223. F523 may be compressed by a drive compressor 224 sufficient to mix the portion in with a portion of expanded gas F65 to deliver as F53 into the drive tube 522. In some configurations a drive compressor 205 may be added to separately boost the pressure of the drive fluid F53 (not shown). Compressor 205 may be driven by a power turbine, or by a variable speed drive to accommodate variations in production and the consequent pressure needed to produce fluid F51.

Compressor configurations: Compressor 220 compresses the intake oxidant fluid to the pressure ratio of the expander times the pressure ratio needed to deliver the injection fluid F62 and drive fluid F53 into the injection well 620 and production well 520 respectively. E.g., intake oxygen, or oxygen enriched air, or air. In some configurations, compressor 220 comprises a low pressure compressor 221, and high pressure compressor 222. Expander 600 may comprise two or three high pressure and low pressure expanders on multiple shafts. Compressor 222 may be connected to one shaft driven by the high pressure compressor turbine. Compressors 221 and 223 may be connected to the power turbine etc. A generator may be provided to drive compressor 224 and/or other power requirements. In other configurations, the expansion ratio of expander 600 may be reduced or one or more down stream stages of expander 600 may be removed to adjust the relative pressure ratios of the expander 600 and compressors 220, 221, 222, 223, 224 and/or 205.

Liquid diluent recovery: The cooled expanded fluid F68 exiting the heat recovery system 1000 may be cooled sufficient to condense liquid diluent that may then be separated from gases in a condensor/separator 660 into liquid products of combustion F42 and a cooled gaseous fluid F79. E.g., in configurations using water diluent, condensor/separator 660 will recovery condensed water F42 and residual non-condensed gases F79 comprising carbon dioxide (CO2) and remaining nitrogen, noble gases and residual oxygen. In some configurations carbon dioxide diluent may be condensed and separated to provide liquid carbon dioxide diluent F42, and noncondensible gas F79 comprising the remaining nitrogen, noble gases and residual oxygen.

Clean liquid diluent use: In some configurations, a portion F420 of condensed separated liquid diluent F42 may be directed back to combustor 100 to control one or more of peak combustion temperature and/or combustor outlet temperature/turbine inlet temperature. E.g., clean water. This beneficially improves efficiency and increases net power from expander 600.

Condensing diluent: Condensor/separator 660 may be provided and configured to condense products of combustion and/or liquid diluent from cooled expanded fluid F68, a portion of water formed by combustion and such further liquid diluent (such as water and/or carbon dioxide) delivered to combustor 100 as desired to control the combustor outlet/turbine inlet temperature to expander 600. A conventional gas turbine with conventional compressor 220, combustor 100 and expander 600 may be used in some configurations to provide drive power for compressors and generators, and from whose exhaust products of combustion can be recovered.

Thermal delivery: Injection fluid F62 and drive fluid F53 are initially formed from similar mixtures of fluids F65, F70 and F74 and delivered to injection tube 622 and drive tube 522 respectively to preheat the hydrocarbon resource. The hot fluids F62 and F53 may comprise superheated diluent or steam markedly higher than the temperature of saturated steam at the delivered pressure. In some configurations the temperature may be greater than 260° C. (500° F.), or greater than 310° C. (590° F.), or 330° C. (626° F.). One or both of the injection tube 622 and delivery tube 522 may be made from corrosion resistant materials suitable for the hot fluids F62 and F53 comprising carbon dioxide, steam and temperature.

Intermediate thermal delivery: As hydrocarbon resource around injection and production wells are heated, the hydrocarbon viscosity is reduced and the hydrocarbon begins to be mobilized to the production well. The portions of heated diluent F70 and F74 delivered to the injection fluid F62 are progressively increased while the portions to the drive fluid F53 are reduced. The portions of expanded fluid F65 delivered to the injection fluid F62 and the drive fluid F53 are adjusted to increase the rate of hydrocarbon production and increase the corresponding thermoeconomic returns.

Turbine Inlet Temperature control: A portion F420 of condensate F42 may be redirected upstream of the inlet to turbine 600. E.g., within compressor heat exchanger or intercooler 240, to reduce compression work and/or to control the Turbine Inlet Temperature (TIT). Intercooler 240 may be a direct contact heat exchanger. The balance of the condensate may be delivered as F95 into the heat recovery system. Similarly, the portion of hot water F36 from heat recovery directed to the combustor 100 may be controlled. The balance of F36 may be directed to separator 555.

Gas composition control: As injection fluid F62 and drive fluid F53 are delivered, a portion of steam will condense within the resource. Portions of the carbon dioxide delivered will dissolve in the hydrocarbon resource and in the water within the resource. Corresponding portions of this aqueous condensate and dissolved carbon dioxide will be produced along with hydrocarbon as fluid F50 is recovered. These portions of water and carbon dioxide are predominantly separated in the separator 555 to aqueous fluid F87, and to gaseous fluid F52.

Controlling CO2 vs Steam Delivery: In some configurations, as hydrocarbon production progresses, the temperature and proportion of steam in injection fluid F62 and drive fluid F53 may be reduced to a progressive degree and the portion of carbon dioxide may be progressively increased. The portion of carbon dioxide in the cycle is controlled by controlling the portion of expanded fluid removed from the power cycle as discharged fluid F79 vs the portion F65 delivered to the hydrocarbon resource, and by the amount of water and steam from F42, F70, F74 and F54 delivered upstream of the expander to control temperature vs to separator 555 via the heat recovery system 1000 to aqueous discharge F87 with small portions to F59 and F52.

In some configurations, the proportion of carbon dioxide in the cycle may be increased and the amount of makeup water F95 required may be beneficially reduced by directing all the condensate F42 back into heat recovery system 1000 as feed water F95. In further configurations, the proportion of carbon dioxide in the cycle is further increased by redirecting discharge fluid F79 back into the inlet of the low pressure compressor 221. When nitrogen is present in the oxidant fluid, carbon dioxide may be further increased by separating CO2 from fluid F79 and directing it into the intake of compressor 221.

The portion of steam delivered downhole is similarly controlled by the portion of heat recovery steam F70 and superheated steam F74 that is mixed into fluids F62 and F53 delivered into the hydrocarbon resource, vs delivered into the combustor 100 to increase expander power and/or efficiency. Reducing steam and increasing carbon dioxide fraction is projected to beneficially reduce the amount of steam required and increase the portion of heat from the hydrocarbon resource.

In some configurations, the distribution of water from the separator going to the gas fluid F52 versus to the aqueous flow F87 is controlled by the temperature within the separator, and thus by the portion of heat recovery fluid F36 and F70 directed to the separator, and the recycle rate of F52. Similarly, the portion of hydrocarbon distributed as vapor to F52 hydrocarbon fluid F87 is controlled by the temperature within separator 555 and thus by the corresponding flows.

Generalization of the Inventive Method to Other Process Applications

Configurations may using other combinations of wet combustion VAST thermogenerators, Diverted VAST gas turbines, and/or Direct VAST gas turbines in forming and delivering process fluid or VASTgas for recovering and/or treating heavy hydrocarbon resources.

The use of combustion gases and combustion by-products (particularly CO2) generated by high water to fuel ratio combustion has other applications outside of heavy hydrocarbon extraction. One other application is the use of such VASTgases (either generated from a combustor directly or as the exhaust from a gas turbine/combustor combination as detailed above), for the remediation of brown field chemical spills.

Many such spills are associated with petroleum refining and storage. These chemicals tend to be non-polar chemicals (such as aliphatic or aromatic hydrocarbons, e.g., pentane, benzene and even carbon tetrachloride) that are relatively insoluble in water. CO2 is an excellent solvent for such non-polar molecules. Some configurations may use high enthalpy VASTgas stream to provide more effective and efficient mobilization of such spilled chemicals than steam alone, thereby aiding in the removal (or reburning) process for these materials.

The mechanism for such mobilization is very similar to that described above for the mobilization of heavy hydrocarbons in heavy hydrocarbon formations or mined material. The configurations and methods discussed above (e.g., wet combustion with air or enhanced oxygen, the use of wet combustion in gas turbines or VAST thermogenerators with diverted or direct configurations, and the use of various chemical and fuel choice methods to enhance the CO2 concentration in VASTgas) may be used directly to enhance the clean-up or extraction of hydrocarbon and other chemical spills. The use of this invention is particularly effective where the chemical that requires clean-up or extraction is more soluble in CO2 than in water since the high concentration of CO2 in VASTgas (which may be enhanced using the methods discussed above), will enhance the clean-up or extraction rate or thermal efficiency (or both).

Other applications for such VASTgases containing CO2 include large scale cleaning of materials such as fabrics and plastics. CO2 may also be used to foam polymers because of the high solubility of the gas in non-polar polymers, and especially those plastics that require heating. In this case, the CO2 may dissolve into a polymer and provide gas pressure to generate foam bubbles.

The heat carried in the water in the VASTgas may provide the heat necessary to raise the temperature of the polymer above its glass transition temperature. This may result in an efficient method of delivering heat and controlling the dimensions of the foam bubbles formed in the lowered viscosity polymer material, which is a desirable method of controlling some of the material properties of such polymers.

Well orientations: While generally horizontal configurations are shown for injection well 620 and production well 520, it will be realized that these wells may be implemented in a vertical orientation, or in a diverted orientation intermediate between horizontal and vertical.

Dirty liquid diluent use: In some configurations, a portion F871 of the liquid diluent F87 recovered from the separator 555 is delivered to thermogenerator 101. E.g., a portion of residual hydrocarbons in the recovered water may be burnt in the thermogenerator 101. This provides a method to combust the residual hydrocarbons in the recovered hydrocarbon contaminated water F871. In some configurations a portion F421 of recovered liquid diluent is delivered to the thermogenerator 101. A residual portion F422 of excess clean condensed water may be discharged as desired.

Separating gases: With reference to FIG. 28, gas flow F52 from separator 555 is compressed through recycle compressor 223 and delivered to a carbon dioxide-light hydrocarbon separator 556. Separator 556 may condense a portion of the light hydrocarbons with higher boiling points than very light hydrocarbons. E.g. to separate a portion of C2 to C5 hydrocarbons from the gas flow F52, depending on the composition or portion of light hydrocarbons desired to be returned to enhance recovery of the hydrocarbon resource 90 and/or to recover heat from the resource. Alternatively separator 556 may comprise a membrane separator, or a cyclic pressure absorber.

An upstream portion of the gaseous CO2, an upstream portion of any residual noncondensible gases (e.g., N2 and Ar) and a fuel portion uncondensed lighter lower boiling point hydrocarbons may be further compressed sufficiently to deliver this flow into the combustor 100. These upstream portions of CO2, residual non-condensible gases, and light hydrocarbons delivered to the thermogenerator 101 may be controlled towards obtaining one or more of a desired concentration of CO2 within the turbine, a desired fuel flow to the combustor, and a desired turbine inlet temperature.

In some configurations some or all of these upstream portions may be delivered to the thermogenerator 101. E.g., to increase the carbon dioxide delivered to the resource, to increase the use of light hydrocarbons as fuel, and/or to reduce the steam delivery to the resource.

Dedicated gas compressor: These upstream portions of F52 may be compressed in a separate compressor to minimize explosion risk. Where the portion of hydrocarbons, oxidant and non-combustible gases are sufficient to form a non-combustible mixture, these gases may be delivered to the intake of the compressor 221 to compress with oxidant to deliver to the combustor 100.

Solvent separator: In some configurations, the separator hydrocarbon flow F86 may be processed through a separator 557 to separate intermediate hydrocarbons from heavy hydrocarbons. Separator 557 may comprise a thermal separator such as a distiller utilizing one or more portions of hot liquid diluent F36, evaporated diluent F70 and/or superheated diluent F74. E.g., hot water, steam and/or superheated steam. This may be configured to recover a portion of C3 to C10 hydrocarbons, or solvent hydrocarbons, depending on the desired intermediate recycle desired to deliver back to the hydrocarbon resource 90. Separator 557 may comprise an evacuator to evaporate the intermediate hydrocarbons to remove them from heavier hydrocarbons, or other separator system. E.g., a vacuum pump, liquid ring pump, blower, and/or compressor suitably configured to reduce the pressure on the hydrocarbon flow F86 to separate and recover and pressurize the desired intermediate or solvent hydrocarbons.

Hybrid thermomechanical separator: In some configurations separator 557 may comprise a combination of thermal fluid heating combined with vapor compression. E.g., a direct contact heat exchanger mixing a flow of a portion of hydrocarbon flow F86 with one or more of a portion of hot water F36, steam F70 and superheated steam F74, may be combined with an aqueous liquid ring pump to separate a desired portion the intermediate hydrocarbons. This beneficially combines the available recovered heat with the compression desired to deliver the solvent vapor. In some configurations, a portion of the expanded fluid from the expander 600 may be used to heat the solvent vapor or intermediate hydrocarbons.

Solvent delivery: An injection solvent portion of the separated solvent hydrocarbon flow may be mixed in the hot energetic or process fluid F62 and be delivered to the injection tube 622. In some configurations, drive solvent portion of the solvent hydrocarbon flow may be mixed with the flow F53 delivered to the drive tube 522.

Mixing fluids: As with the embodiment shown in FIG. 22 and FIG. 28, the injection flows in the embodiment shown in FIG. 23 may be mixed near the separators and may be delivered to the injection tube.

Operation to enhance recovery: With reference to FIG. 22, FIG. 28 and FIG. 23, the embodiments shown may be configured and/or controlled to enhance hydrocarbon recovery in novel ways as follows.

Controlling injection flow temperature and flow rate: In some configurations, the injection flows may be configured to control the temperature of the injection fluid. The injection flows may be configured to control the flow rate of the injection fluid. The injection flows may be controlled to control the mean temperature and the temperature drop from toe to heel of the drive fluid.

Controlling drive flow temperature and flow: In some configurations, the drive flows may be configured to control the temperature of the drive fluid. The drive flows may be configured to control the flow rate of the drive fluid. The drive flows may be controlled to control the mean temperature and the temperature drop from toe to heel of the drive fluid.

Uses of light gaseous hydrocarbon: In some configurations, one or more of the portions of light hydrocarbon gas delivered to the combustor 100, the portion delivered to the injector tube, and/or the portion delivered to the drive tube may be controllable. These portions may be controllable to adjust the portion of gaseous hydrocarbon used for pumping work of recirculating gas and producing the hydrocarbon, to deliver heat, to increase hydrocarbon extraction fraction, and to recover heat from the reservoir.

Uses of solvent hydrocarbon: Similarly, in some configurations the flows of solvent hydrocarbon delivered to the combustor for fuel, to the injection tube, to the drive tube may be controllable. These portions may be controllable to adjust the portion and/or amount of solvent hydrocarbon used for pumping work, for heat, to increase hydrocarbon recovery fraction and to recover heat from the reservoir.

Production cycle: In hydrocarbon production, a resource being recovered will have a beginning of production, a peak rate of production and an end of economic production. After the peak production rate, the Hubbert linearization method may be applied to project when end of economic production will occur. Between the beginning and production peak, there is a rising inflection point in the production curve corresponding to a maximum in the rate of increase of production. There will be a falling inflection point between the peak and the end of economic production.

Superheated injection fluid: Between the start of production and the rising inflection point, the injection fluid may be delivered at above the saturation steam temperature at the delivery pressure. This may beneficially increase the rate of heat flow and the consequent hydrocarbon production rate.

Steam flow rate: Steam delivery may be delivered faster in the thru flow well embodiments described herein than with a closed end steam delivery well configuration.

High carbon dioxide delivery: The carbon dioxide portion of the injection fluid may be increased to about the knee in the increase of CO2 concentration with CO2 fraction at that pressure and temperature. As the resource cools, the CO2 fraction may be increased in the injection fluid according to the variation in CO2 saturation concentration. Under some configurations and resource depths, this CO2 portion in the delivered injection fluid may be greater than the portion of CO2 formed by combustion in the combustor and/or thermogenerator.

Additional steam delivery: Steam delivery from heat recovery may be stopped between the rising inflection point and the declining inflection point. This will leave the residual amount of steam delivery due to steam formed by combustion, and water vapor delivered with gaseous fluids separated in the separation system 1100.

Declining steam portion: In some configurations, the steam portion from heat recovery system 1000 may be reduced over time from a maximum desired concentration initially, to none at point in the production curve between the rising and falling inflection points.

Maximum light hydrocarbon fraction: The light hydrocarbon fraction may be increased to a maximum between the falling inflection point and the end of economic delivery.

Rising light hydrocarbon fraction: The light gaseous hydrocarbon portion may then rise from a lower level before the peak production to maximum rate after the falling inflection point.

Falling light hydrocarbon boiling point: The separator 556 may be operated to adjust the distribution of light or gaseous hydrocarbons to provide a dropping boiling point for a portion of production between the peak and the end of production.

Maximum heavy hydrocarbon fraction. The heavy hydrocarbon fraction may be at a maximum before the falling inflection point.

While exemplary embodiments of the invention have been shown and described, it will be clear to those skilled in the art that various changes and modifications may be made without departing from the invention in its broader aspects as set forth in the claims provided hereinafter.

What is claimed is:

1. A method for hot fluid recovery of heavy hydrocarbons from heavy hydrocarbon bearing material comprising:

delivering fuel fluid comprising a fuel, oxidant fluid comprising an oxidant, and diluent fluid comprising a diluent, to a diluted combustion system;

combusting fuel with oxidant;

forming a hot process fluid comprising products of combustion and diluent;

controlling the hot process fluid temperature to within a prescribed range;

delivering the hot process fluid to the heavy hydrocarbon bearing material;

recovering a produced hydrocarbon fluid comprising hydrocarbon, water, and gas;

separating the produced hydrocarbon fluid into a hydrocarbon fluid, an aqueous fluid comprising liquid water, and a gaseous fluid comprising carbon dioxide; and delivering as diluent one of: water comprising dissolved solids, water comprising suspended solids, a portion of the aqueous fluid, and a portion of the gaseous fluid.

2. The method according to claim 1 further comprising separating a portion of carbon dioxide from the gaseous fluid and delivering as diluent a portion of the separated carbon dioxide.

3. The method according to claim 1 combusting fuel and oxidant in the presence of aqueous diluent.

4. The method according to claim 3 partly combusting a first fuel fluid with a first portion of oxidant and partially expanding the first hot process fluid formed and delivering it to a first portion of hydrocarbon material, and combusting a second fuel fluid with a second portion of oxidant and directly delivering the hot process fluid to a second portion of hydrocarbon material.

5. The method according to claim 3 wherein combusting a portion of the light hydrocarbon fluid as fuel.

6. The method according to claim 1 comprising separating the hydrocarbon fluid into residual hydrocarbon and one of light hydrocarbon fluid and solvent fluid, and delivering a portion of solvent fluid to the hydrocarbon resource.

7. The method according to claim 3 further extracting mechanical power while partly expanding the hot process fluid and directly delivering the partly expanded hot process fluid to the hydrocarbon material.

8. The method according to claim 7 further partly expanding a plurality of hot process fluid streams.

9. The method according to claim 1 wherein the compressed, separated, light hydrocarbon is cooled through a processes of heat exchange.

10. The method according to claim 9 further comprising a second compression process.

11. The method according to claim 9 further comprising a second fluid separation system.

12. The method according to claim 11 wherein a lighter light hydrocarbon fraction is separated from the light hydrocarbon fraction.

13. The method according to claim 12 wherein at least a portion of the light hydrocarbon fraction or lighter, light hydrocarbon fraction is reacted in a wet cycle combustion process producing a hot process fluid.

14. The method according to claim 1 wherein the separation process is heated to enhance the separation of the light hydrocarbon fraction.

15. The method according to claim 1 further comprising separating a portion of the solids from gaseous hot process fluid.

16. The method according to claim 15 wherein solvent hydrocarbon is mixed with cleaned hot process fluid before delivery to the hydrocarbon bearing material.

17. The method according to claim 1 wherein a portion of the heavier hydrocarbon fraction is processed into a solvent hydrocarbon portion.

18. The method according to claim 1 wherein providing water in a ratio to fuel exceeding 4.

19. The method according to claim 1 wherein releasing carbon dioxide from heating solids comprising a carbonate.

20. The method according to claim 1 pressurizing the hot process fluid between 2 atm and 400 atm.

21. The method according to claim 1 combusting a diverted fuel comprising an acid-producing constituent and delivering the hot process fluid formed to the hydrocarbon resource and combusting a clean fuel upstream of an expander.

22. The method according to claim 1 comprising a clean fuel low in sulfur and an alternative fuel high in sulfur.

23. The method according to claim 1 comprising reacting oxides of sulfur with a carbonate fluid.

24. The method according to claim 1 comprising delivering hot process fluid into the bottom of a separation vessel containing heavy hydrocarbon material to separate heavy hydrocarbon from associated material.

25. A method for enhanced recovery of heavy hydrocarbons from heavy hydrocarbon bearing material comprising:

delivering fuel fluid comprising a fuel, oxidant fluid comprising an oxidant, and diluent fluid comprising a diluent to a diluted combustion system;

combusting fuel with oxidant;

forming a process fluid comprising products of combustion and diluent;

delivering the process fluid to the heavy hydrocarbon bearing material;

recovering a produced hydrocarbon fluid comprising hydrocarbon, water, and gas;

separating the produced hydrocarbon fluid into a lighter hydrocarbon fluid, a residual hydrocarbon fluid, an aqueous fluid comprising water, and a gaseous fluid comprising carbon dioxide; and delivering as diluent a portion of lighter hydrocarbon fluid and one of: water comprising dissolved solids, water comprising suspended solids, and a portion of the aqueous fluid; and delivering a portion of lighter hydrocarbon fluid to the heavy hydrocarbon bearing material.

26. The method according to claim 25 wherein separating a portion of carbon dioxide from the gaseous fluid and delivering it to the hydrocarbon fluid.

27. The method according to claim 25 wherein a separating a light hydrocarbon fluid from the hydrocarbon fluid and combusting a portion of the separated light hydrocarbon fluid as fuel.

28. The method according to claim 25 further controlling the portion of lighter hydrocarbon in the hot process fluid to increase over a portion of the time between the falling inflection point and the end of economic delivery in the rate of hydrocarbon production.

29. The method according to claim 25 controlling the distribution of lighter hydrocarbon to have a dropping boiling point for a portion of the production between peak hydrocarbon production and the end of production.

30. The method according to claim 25 further changing the composition of the process fluid between two of the production periods between the start of hydrocarbon production, the rising production inflection point, the peak of production, the declining production inflection point, and the end of production.

31. The method according to claim 25 varying the rate of change in the concentration in the hot product fluid of one of carbon dioxide and the lighter hydrocarbon, between a first and second production period selected from between the start of hydrocarbon production, the rising production inflection point, the peak of production, the declining production inflection point, and the end of production.

32. The method according to claim 25 wherein controlling the portion of steam in the hot process fluid to decline over a portion of the time between the rising and falling inflection points in the rate of hydrocarbon production.

33. The method according to claim 25 comprising diverting a portion of process fluid and recovering one of a portion of mechanical energy and thermal energy from the diverted portion of process fluid.

34. The method according to claim 25 further comprising pressurizing the oxidant fluid using mechanical energy extracted from a portion of the diverted process fluid.

35. The method according to claim 25 further separating the lighter hydrocarbon fluid into a first lighter hydrocarbon fluid delivered to a first portion of the heavy hydrocarbon material and a second lighter hydrocarbon fluid delivered to a second portion of the heavy hydrocarbon material.

36. The method according to claim 35 wherein changing the composition of one of the first lighter hydrocarbon fluid and the second lighter hydrocarbon fluid with time.

37. The method according to claim 25 further separating the lighter hydrocarbon fluid into a light hydrocarbon fluid and a solvent hydrocarbon fluid.

38. The method according to claim 37 comprising controlling the composition of three of carbon dioxide, steam, light hydrocarbon fluid, and solvent hydrocarbon fluid in the process fluid.

39. The method according to claim 38 comprising forming and controlling the composition of a first process fluid delivered to a first heavy hydrocarbon material portion and controlling the composition of a second process fluid delivered to a second heavy hydrocarbon material portion.

40. The method according to claim 38 comprising controlling the process fluid composition to recover heat from the heavy hydrocarbon material.

41. The method according to claim 25 wherein delivering the process fluid through one U shaped well and thence through a second U shaped well.

42. The method according to claim 25 wherein the fuel comprises one of heavy hydrocarbon, bitumen, coke, coal, and sulfur.

43. The method according to claim 25 wherein the ratio of diameters of an injection or delivery well to a respective internal tube between about 1.1 and 3.0.

44. The method according to claim 25 wherein the oxidant fluid comprises from 22% to 94% oxygen.

45. The method according to claim 25 further comprising separating a portion of the solids from the process fluid.

46. The method according to claim 25 further comprising treating the process fluid with an aqueous carbonate fluid.

* * * * *